US008187153B2

(12) United States Patent
Douglas et al.

(10) Patent No.: US 8,187,153 B2
(45) Date of Patent: May 29, 2012

(54) CONCENTRIC AND ECCENTRIC EXERCISING AND TRAINING APPARATUS AND METHOD

(75) Inventors: D. Scott Douglas, Belleair, FL (US); John D. Webb, Clearwater, FL (US); Alexis D. Webb, Clearwater, FL (US)

(73) Assignee: Center for Rotational Exercise, Inc., Clearwater, FL (US)

( * ) Notice: Subject to any disclaimer, the term of this patent is extended or adjusted under 35 U.S.C. 154(b) by 0 days.

(21) Appl. No.: 12/880,688

(22) Filed: Sep. 13, 2010

(65) Prior Publication Data

US 2011/0118085 A1 May 19, 2011

Related U.S. Application Data

(63) Continuation-in-part of application No. 11/835,379, filed on Aug. 7, 2007, now Pat. No. 7,922,620.

(60) Provisional application No. 60/836,249, filed on Aug. 7, 2006.

(51) Int. Cl.
*A63B 71/00* (2006.01)

(52) U.S. Cl. ..... 482/8; 482/51; 482/137

(58) Field of Classification Search ..... 482/1–9, 482/51, 134–142, 900–902; 434/247
See application file for complete search history.

(56) References Cited

U.S. PATENT DOCUMENTS

| | | | |
|---|---|---|---|
| 1,783,376 | A | 12/1930 | Duff |
| 1,869,673 | A | 8/1932 | Duff |
| 3,424,005 | A | 1/1969 | Brown |
| 3,874,659 | A | 4/1975 | Aharoni |
| 3,926,430 | A | 12/1975 | Good, Jr. |
| 4,077,626 | A | 3/1978 | Newman |
| 4,396,188 | A | 8/1983 | Dreissigacker et al. |
| 4,470,597 | A | 9/1984 | McFee |
| 4,506,885 | A | 3/1985 | de Wet |
| 4,542,898 | A | 9/1985 | Grushkin |
| 4,625,962 | A | 12/1986 | Street |
| 4,673,177 | A | 6/1987 | Szymski |
| 4,673,180 | A | 6/1987 | Rice |
| 4,674,741 | A | 6/1987 | Pasierb, Jr. et al. |
| 4,725,055 | A | 2/1988 | Skowronski |
| 5,050,871 | A | 9/1991 | Douglas et al. |
| 5,324,247 | A | 6/1994 | Lepley |

(Continued)

OTHER PUBLICATIONS

PCT, International Search Report and Written Opinion of the International Searching Authority, PCT/US2007/075408, May 12, 2008, pp. 1-5.

Gerber et al., Effects of Early Progressive Eccentric Exercise on Muscle Structure after Anterior Cruciate Ligament Reconstruction, The Journal of Bone & Joint Surgery, vol. 89-A, No. 3, Mar. 2007, pp. 559-570.

(Continued)

*Primary Examiner* — Glenn Richman
(74) *Attorney, Agent, or Firm* — Gray Robinson, P.A.

(57) ABSTRACT

An exercising machine for exercising of a user's torso, arm, leg or other body part, including an exercising attachment for exercising of the user's torso, arm, leg or other body part, a computer-controlled resistance actuator operatively connected to the exercising attachment to impart a resistance for concentric exercising of the user's torso, arm, leg or other body part through a forward range of motion, a computer-controlled force actuator operatively connected to the exercising attachment to impart a force for eccentric exercising of the user's torso, arm, leg or other body part through a reverse range of motion, a computer for controlling the actuators and a method for exercising, including imparting a resistance for concentric exercising of a user's torso, arm, leg or other body part through a forward range of motion and imparting a force for eccentric exercising of the user's torso, arm, leg or other body part through a reverse range of motion.

15 Claims, 77 Drawing Sheets

U.S. PATENT DOCUMENTS

| | | | |
|---|---|---|---|
| 5,766,115 | A | 6/1998 | Huang |
| 6,013,013 | A | 1/2000 | Wolf |
| 6,050,920 | A | 4/2000 | Ehrenfried |
| 6,666,801 | B1 | 12/2003 | Michalow |
| 6,672,998 | B2 | 1/2004 | Cook |
| 6,685,602 | B2 | 2/2004 | Colosky, Jr. et al. |
| 7,083,554 | B1 | 8/2006 | Lo Presti |
| 7,121,987 | B2 | 10/2006 | Sharps |
| 7,121,989 | B2 | 10/2006 | Kerry |
| 7,235,039 | B2 | 6/2007 | Anders |
| 2007/0037663 | A1 | 2/2007 | Goel et al. |

OTHER PUBLICATIONS

Nyland et al., Progressive Movement-Related Valgus Knee Impairments: Clinical Examination, Classification, and Treatment, Physical Therapy Reviews, Copyright 2007, pp. 297-313.

Smith et al., Dynamic Trunk Stabilization: A Conceptual Back Injury Prevention Program for Volleyball Athletes, Journal of Orthopaedic & Sports Physical Therapy, vol. 38, No. 11, Nov. 2008, pp. 703-720.

Myers, Thomas W., "Anatomy Trains—Myofascial Meridians for Manual and Movement Therapists", Chapter 6—The Spiral Line, 2001 Churchill Livingstone.

FIG 15

PVC / NBR

| Product Code | | | FBC | AHC | MLC-2 |
|---|---|---|---|---|---|
| PROPERTY | TEST METHOD | UNITS | | | |
| Density | ASTM D 1056 | PCF | 4.5 - 6.5 | 6.5 - 8.5 | 3 - 4.5 |
| Compression Deflection (25%) | ASTM D 1056 | PSI | 2.5 - 4 | 7 - 9 | 1.5 - 3.5 |
| C/D Heat Aging (7 days @158 F) | ASTM D 1056 | % MAX CHG | +/- 30 | +/- 30 | |
| Shore OO Durometer | | | | 60 - 70 | |
| Compression Set (1) (50%) | ASTM D 1056 | % MAX | 30 | 30 | 30 |
| Tensile | ASTM D 412 | PSI MIN | 50 | 90 | 30 |
| Elongation | ASTM D 412 | % MIN | 175 | 100 | 125 |
| Fluid Immersion (2) | ASTM D 1056 | WT % MAX | | | |
| Water Absorption | ASTM D 1056 | WT % MAX | 5 | 5 | 10 |
| | ASTM D 1667 | LBS/SQ FT | 0.1 | 0.1 | 0.1 |
| Linear Shrinkage (7 days @ 158 F) | ASTM C 534 | % MAX | 3.0 | 3.0 | 5.0 |
| Ozone Resistance (72 hours @ 50 pphm) | ASTM D 1171 | RATING | | | |
| Thermal Conductivity (3) | ASTM C 177 | | | | |
| Bashore (% Rebound Average) | | | | | |
| Resilience (1/2" thickness @ 72 F) | | | | | |
| Temperature Use: Cold Crack | ASTM D 1056 | °F | -10 | 10 | -30 |
| High (10) | | °F | 200 | 200 | 200 |
| Flammability Rating (4) | FMVSS302 | | PASS | PASS | PASS |
| | U.L. 94* | | | LISTED | LISTED |
| Standard Width | +2" -0 | INCHES | 60 | 56 | 56 or 60 |
| Maximum Thickness | | INCHES | 1.50 | 1.25 | 1.75 |
| Specifications | ASTM D 1056-67 | | | | |
| | ASTM D 1056-98 | | | 2B2 | |
| Special Orders (7) | | | | X | |
| Colors | | | BLK | GRAY | NAT |
| Colt | | | | | |
| Bedford | | | | | |
| Conover | | | X | X | X |

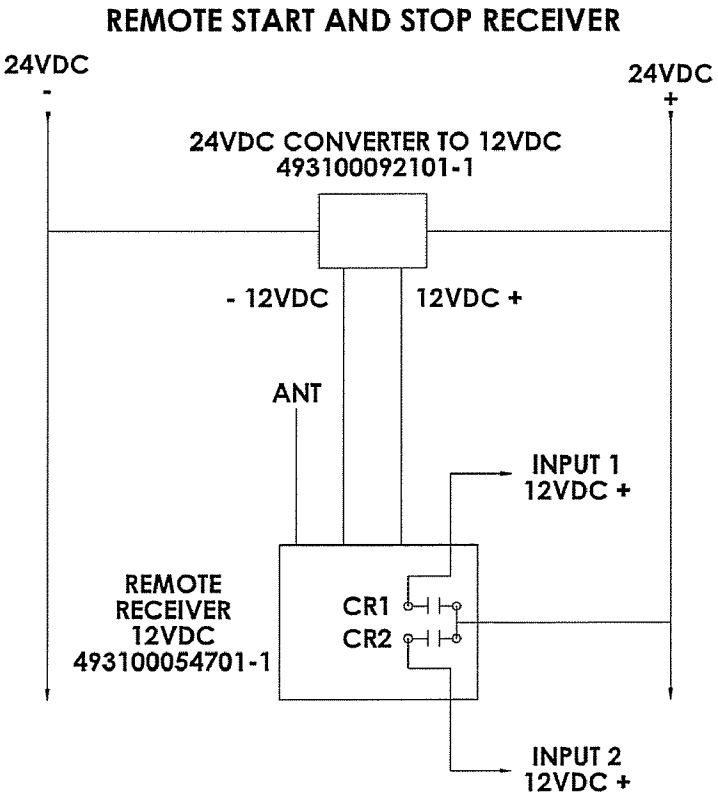
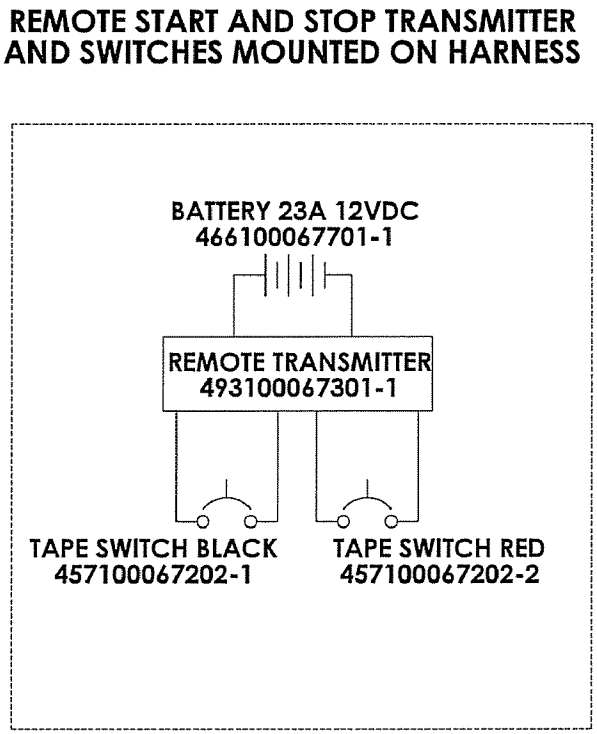
FIG 17L

CONCENTRIC AND ECCENTRIC EXERCISING AND TRAINING APPARATUS AND METHOD

CROSS-REFERENCE TO RELATED INVENTIONS

This application is a continuation-in-part of pending application Ser. No. 11/835,379, filed Aug. 7, 2007, which claims the benefit of provisional application No. 60/836,249, filed Aug. 7, 2006, the disclosures of which are hereby incorporated by reference herein.

BACKGROUND OF THE INVENTION

1. Field of the Invention

This invention relates to exercising and training machines. More particularly, this invention relates to exercising and training machines allowing a user to concentrically exercise a portion of his body through a first path of motion against a resistance and to forcibly eccentrically exercise the portion of his body in an opposite path of motion.

2. Description of the Background Art

Presently there exist many types of exercising and training machines designed to exercise portions of a person's body. The most predominant type of exercising and training machine utilizes weight resistance which, through repetition, builds the person's muscles. In our prior invention disclosed in U.S. Pat. No. 5,050,871, the disclosure of which is hereby incorporated by reference herein, we presented an exercise and training machine that exercises a person's ability to accelerate a portion of his body through a path of motion, such as what occurs during the swinging of a baseball bat or a golf club. Our prior exercising and training machine isolated individual muscle groups and measured acceleration of a portion of a person's body. Our prior invention overcame the hesitancy of many professional athletes such as golfers and baseball players who would refrain from resistance weight training during season in fear of adversely affecting their flexibility and ability to swing their golf club or baseball bat in a controlled manner.

For the purpose of summarizing our prior invention, the invention comprised an energy absorbing exercising and training machine for concentrically exercising a person's ability to accelerate a portion of his body through a path of motion. The machine comprised a flywheel rotatably connected to a frame by means of a pair of journal bearings. A harness assembly was provided for connection to the portion of the person's body to be concentrically exercised. Means were provided for interconnecting the flywheel and the harness assembly allowing the flywheel to rigidly engage relative to the harness assembly upon acceleration of the harness assembly relative to the flywheel in a first direction along the path of motion of the body portion being concentrically exercised. The interconnecting means also allowed the flywheel to disengage and freely rotate relative to the harness assembly upon deceleration of the harness assembly relative to the flywheel.

By using our prior invention, the body portion being concentrically exercised moved in the first direction along the path of motion against the inertial resistance of the flywheel. Upon deceleration of the body portion, the flywheel disengaged relative to the harness assembly to thereby preclude the inertia of the flywheel from exerting a force on the body portion along the path of motion. In the preferred embodiment, the interconnecting means comprised an over-running clutch.

The exercising and training machine of our prior invention could be utilized in conditioning and training for many sports and other activities that encouraged the rapid acceleration of a portion of the person's body during concentric exercising, such as what occurred in baseball, golf, and other swing-type activities. The machine was also usable in concentrically exercising individual muscle groups that were customarily exercised through concentric weight lifting exercises like bench presses, bicep curls and overhead presses. The exercising and training machine was most often utilized in conditioning for golf by concentrically exercising the twisting acceleration of the golfer's torso and legs during a golf swing.

Specifically, when utilized as a torso and legs exercising machine for golfers, the exercising and training machine comprised a stand which adjustably positioned the flywheel, shaft, and overrunning clutch in a position above the golfer's head, with the harness assembly connected to the lowermost end of the shaft by means of a universal joint, preferably a constant velocity universal joint. The harness assembly comprised an inverted substantially U-shaped or V-shaped rigid configuration for fitting over the shoulders and upper torso of the golfer's body. The universal joint allowed the torso harness assembly to universally pivot during the golf swing.

Preferably, the frame comprised a carriaged frame that was operatively connected to the stand by means of slide bearings which allowed the frame, flywheel, shaft and torso harness assembly to freely reciprocate sideways above the golfer's head, the sideways movement being geared to the rotation of the torso harness of the shaft. Furthermore, the shaft was slidably journaled within the pair of journal bearings and the inner race of the over-running clutch to allow the shaft to easily reciprocate vertically. The sideways movement of the carriaged frame, the vertical movement of the shaft, and the pivoting of the torso harness assembly via the universal joint allowed the golfer to concentrically exercise and be trained in a recommended golf swing which requires canting and vertical and sideways movement of the golfer's torso during the backswing and through the golf swing.

During the golf swing, the golfer's torso concentrically accelerated to his fullest ability and the energy created thereby forced the flywheel into accelerating rotational movement and such energy was absorbed. When the golfer's torso began to decelerate at the end of the golf swing, the overrunning clutch disengaged the shaft allowing the flywheel to freely rotate. Thus, the inertia of the rotating flywheel did not exert a force on the golfer's torso once the golfer's torso began to decelerate or stop. Over-twisting and possible physical damage was therefore precluded.

When the exercising and training machine of our prior invention was adapted to be utilized as a golf and general exercising and training machine, it additionally included means for providing an eccentric force to the golfer's torso during the backswing and partial extension of the torso at the end of the backswing immediately prior to beginning the golf swing. More particularly, such means comprised a cammed clutch for interconnecting the flywheel and the shaft. The cammed clutch allowed the flywheel to rigidly engage the shaft only during a predefined arc of rotation. Thus, during the predefined arc of rotation, the flywheel was rigidly connected relative to the harness and provided a momentary inertial eccentric force to the golfer's torso during the end of the backswing. Toward the end of the backswing, the inertial force of the flywheel provided a momentary slight extension of the golfer's upper torso while the golfer exerted energy by twisting his lower torso in the opposite direction corresponding to a golf swing thereby overcoming the inertial force of the flywheel and reversing its direction.

Finally, a transducer was operatively connected to the frame to sense the rotational speed of the flywheel over time, which information was then fed into a displayed device to inform the golfer of his progressive ability to concentrically accelerate the flywheel. Additional transducers were also operatively connected to the frame to sense the vertical movement of the shaft, the sideways shifting of the frame and the angular position of the torso harness assembly relative to the shaft. All of such information was then supplied to a computer and analyzed to determine the quality of the golf swing.

More particularly, FIGS. 1-5 illustrate the exercising and training machine 10 of our prior invention. Referring to FIG. 1, a carriaged frame 12 was reciprocatably mounted within a vertically adjustable stand, generally indicated by numeral 14. A flywheel 16 was rotatably mounted to the carriaged frame 12 by means of a shaft 18. A torso harness assembly 20 was pivotably connected to the lowermost end of the shaft 18 by means of a universal joint 22. The torso harness assembly 20 was configured to fit over a golfer's shoulders and onto his torso as shown in the phantom in FIG. 1. As described below in greater detail, the exercising and training machine 10 exercised and trained the golfer's ability to concentrically accelerate his torso through a twisting path of motion against the inertial resistance of the flywheel in a first direction corresponding to proper golf swing. As also described below in greater detail, the flywheel of the exercising and training machine 10 eccentrically forced his torso in the reverse direction opposite to that of the first direction corresponding to a through-swing, thereby providing a momentary eccentric extension of the golfer's torso at the beginning of the through-swing.

As shown in FIG. 2, the torso harness assembly 20 comprised a horizontal member 24 having a substantially horizontal bracket 26 welded thereto and inverted, substantially V-shaped arms 28 extending downwardly from opposing ends thereof. The universal joint 22 was rigidly secured to the bracket 26 by means of threaded fasteners or the like. Inwardly extending pad members 30 were rigidly connected to the aims 28.

As shown in FIG. 1, when the inverted V-shaped arms 28 straddled the golfer's head and slid over the golfer's shoulders onto his torso, the horizontal member 24 was positioned sufficiently above the golfer's head so as to not interfere therewith. As thus configured, the golfer's torso was firmly seated within the torso harness assembly 20 and any rotational or other movement of the torso was transferred to the shaft 18 via universal joint 22. Preferably, universal joint 22 comprised a constant velocity universal joint.

Referring to FIGS. 3 and 4, stand 14 comprised a generally rectangular framework having front, rear and left and right side members 32F, 32R, 32LS and 32RS, respectively, rigidly connected together to define a generally rectangular configuration having an opened center 32O. A bracket 34 extended from the front 32F and rear 32R frame members for rigid connection to respective cylindrical support guides or collars 36. Each support guide 36 was slidably fitted over an upstanding cylindrical support tube or pipe 38. The tubes 38 were rigidly secured in their upright position to a ground platform 40 (see FIG. 1).

The rectangular framework 32 was vertically adjustable along the length of the tubes 38. Specifically, vertical adjustment was provided by means of rotatable lifting rings 42 positioned about the respective tubes 38, each of which included a plurality of off-axis roller bearing 44 which caused the lifting ring 42 to ascend the tube 38 when rotated in one direction and descend the tube 38 when rotated in the other direction. Thus, the height of the rectangular framework 32 was easily adjusted by rotation of the lifting ring 42 on each tube 38.

The carriaged frame 12 comprised a generally rectangular framework 46 oriented vertically and having top and bottom frame members 46T and 46B and front and rear frame members 46F and 46R rigidly connected together at their respective corners to define a substantially rectangular configuration. The rectangular framework 46 of the carriaged frame was dimensioned to fit within the opening 32O defined by the rectangular framework 32 of the stand 14.

The rectangular framework 46 of the carriaged frame 12 was supported by the rectangular framework 32 of the stand 14 by means of a pair of rails 48 which were rigidly secured to left and side frame members 32LS and 32RS of the framework 32 of the stand 42 to span the central opening 32O thereof. Slide bearings 50 were rigidly connected to the underside of the top frame member 46T of the rectangular framework 46 of the carriaged frame 12 for slidable engagement with rails 48, which allowed the carriaged frame 12 to reciprocate sideways within the opening 32O of the rectangular framework 32 of the stand 14.

As shown in FIG. 5, the shaft 18 was rotatably journaled to the carriaged frame 12 by means of a pair of journal bearings 52 connected to the top and bottom frame members 46T and 46B of the rectangular framework 46. Preferably, shaft 18 comprised a spline shaft and the upper journal bearing 42 included a sleeve 52B and a ball spline bearing 54 with keyway 51 which allowed the shaft 18 to reciprocate vertically relative to the journal bearing 52U and rotate. A stop 56 was connected to the upper end of the shaft 14 by means of threaded fastener 58. Spring 60 was positioned between stop 56 and the sleeve 52B for cushioning.

Preferably, the sideways movement of the carriaged frame 12 was geared to the rotation of the shaft 18 by means of a cable 53 which was wrapped once around the sleeve 52B and with the trailing ends 55 of the cable 53 being rigidly connected to the left and right side members 32LS and 32RS of the rectangular framework 32. Thus, rotation of the harness assembly 20, shaft 18 and sleeve 52B caused the carriaged frame 12 to travel sideways along the length of the cable 53. Preferably, the cable 53 was wrapped about the sleeve 52B in such a manner that the carriaged frame 12 was in its fully rightward position when the harness assembly 20 was rotated to a position corresponding to the start of the golfer's swing. Thus, as the golfer took his golf swing, the carriaged frame 12 was forcibly moved leftward in synchronism to the rotation of the golfer's torso, thereby training the golfer to exercise a proper golf swing.

The flywheel 16 comprised a generally disk-shaped configuration (see FIG. 3). A plurality of upstanding pins 62 were positioned equidistantly about an outer periphery of the flywheel 16 for receiving removable weights 64 to attain a flywheel having a desired mass.

The flywheel 16 was rigidly connected to the upper protruding portion of the lower sleeve bushing 52LB by means of welding 66 or the like. The flywheel 16 was operatively connected to the shaft 18 by means of an over-running clutch 68 having an outer raceway 680 rigidly connected at a lower surface to the flywheel 16 by means of threaded fasteners 70. A ball spline bearing 72 was positioned within the inner raceway 68I of the clutch 68 and was keyed thereto by means of keyway 74. Ball spline bearing 72 allowed vertical movement of the shaft 18 therethrough while non-rotatably securing the inner raceway 68I to the shaft 18. A shim bushing 76 was interposed between the inner raceway 68I and the spline bearing 72.

Rotation of shaft 18 in one direction caused the inner raceway 68I to rigidly engage the outer raceway 680 of the clutch 68 thereby rigidly interconnecting the flywheel 16 to the shaft 18, thereby providing an inertial resistance. Deceleration of the shaft 18 relative to the flywheel 16 caused the raceway 680 and 68I to disengage allowing the flywheel 16 to freely over-run without exerting any torque on the shaft 18. Thus, with the torso harness assembly 20 connected to the end of the shaft 18, the golfer's twisting of his torso during the golf swing forcibly accelerated the flywheel 16 against the inertial resistance of the flywheel 16 and, at the end of the golf swing when the torso began to decelerate, the flywheel 16 freely overran to prevent any force being imparted to the torso harness assembly 20 which would have otherwise adversely affected the golf swing and possibly cause physical damage to the golfer.

The exercising and training machine 10 of our prior invention further included a cammed clutch, generally indicated by numeral 78, which interconnected the flywheel 16 and the shaft 18 and allowed the flywheel 16 to rigidly engage the shaft 18 during a predefined arc of rotation of the shaft 18 in a reverse direction corresponding to the golfer's backswing opposite to the first direction corresponding to the golfer's golf swing. With the clutch 78 engaged, the inertial force of the rotating flywheel 16 imparted a momentary eccentric force to the golfer's torso at the beginning of the through swing.

More particularly, the cammed clutch 78 comprised a first clutch plate 80 which was rigidly connected to the upper sleeve bushing 52LB of the upper journal bearing 52. The cammed clutch 78 further comprised a second clutch plate 82 positioned in alignment with the first clutch plate 80 and rigidly connected to the upper surface of the outer raceway 680 of the over-running clutch 68 by means of threaded fastener 84. A wearable clutch 86 was positioned between the clutch plates 80 and 82. An arcuate cam 88 was rigidly connected to the upper surface of the first clutch plate 80 and included end ramp 88R. A corresponding cam roller 90 was rotatably connected to a bracket 92 depending from the top frame member 46T of the rectangular framework 46 in alignment with cam 88. A lower cam roller 94 was rotatably connected to bracket 92 for support to the underside of the second clutch plate 82.

The cam 88 was accurately shaped to be engaged by the cam roller 90 along the predefined arc of rotation which corresponded to the backswing of the golfer when the golfer was facing forwardly. Thus, as the golfer began his backswing, cam roller 90 engaged cam 88 to frictionally engage the clutch plates 80 and 82 together and rigidly interconnect the flywheel 16 to the shaft 18 via sleeve 52B and ball spline bearing 54. After the golfer exerted enough backswing force to rotate flywheel 16, the flywheel 16 would continue on to impart a momentary eccentric force to the golfer's torso as the golfer rotated his lower body in the through swing direction. When the cam roller 90 rolled off ramp 88R of cam 88, the plates 80 and 82 disengaged and allowed flywheel 16 to freely rotate, thereby terminating the imparting of the eccentric force. The relative positioning of ramp 88R of cam 88 determined when the flywheel 68 was disengaged such that a certain amount of eccentric extension of the golfer's torso was achieved by proper positioning of the cam ramp 88R relative to the golfer's backswing.

The inertia created by the rotating flywheel 16 of our prior exercising and training machine 10 functioned to absorb all of the energy of the rotating golfer's swing. However, our prior exercising and training machine 10 lacked any ability to exert control over the inertial resistance of the flywheel 16, other than to disengage the clutch 68 at the end of the golf swing when the torso, began to decelerate allowing the flywheel 16 to freely overrun and prevent any force being imparted to the torso harness assembly 20.

Unfortunately, the use of the flywheel 16 in our prior exercising and training machine 10 was limited in its flexibility to provide eccentric force during the backswing. Moreover, the use of the flywheel 16 and the clutch 68 created apprehension in the minds of the user during concentric exercising of the golfer's swing. Further apprehension was created due to the use of the cam roller 90 that terminated the eccentric force of the flywheel during the backswing. Therefore, despite the tremendous functionality of our prior exercising and training machine 10 and the benefits attained during use thereof, there nevertheless existed a need for an improved exercising and training machine that eliminated the use of the flywheel 16.

Therefore, it is an object of this invention to provide an improvement which overcomes the aforementioned inadequacies of the prior art devices and provides an improvement which is a significant contribution to the advancement of the exercising and training art.

Another object of this invention is to provide an exercising and conditioning apparatus and method that imparts a force for eccentric exercising of a user's torso, arm, leg or other body part to thereby lengthen the duration of eccentric force on the complete range of motion of the applicable muscle group.

Another object of this invention is to provide an exercising and conditioning apparatus and method that imparts a force for eccentric exercising of a user's torso, arm, leg or other body part through a selectable range of motion appropriate for the condition and flexibility of the user.

Another object of this invention is to provide an exercising and conditioning apparatus and method that imparts a resistance for concentric exercising of a user's torso, arm, leg or other body part through a selectable range of motion.

Another object of this invention is to provide an exercising and conditioning apparatus and method that imparts a fixed or variable resistance or a fixed or variable force for concentric or eccentric exercising of a user's torso, arm, leg or other body part through a fixed or selectable range of motion.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing this invention, our present exercising and training apparatus and method imparts a force for eccentric exercising of a user's torso, arm, leg or other body part through a selectable range of motion appropriate for the condition and flexibility of the user. The apparatus and method of the invention additionally imparts a resistance for concentric exercising of a user's torso, arm, leg or other body part through a selectable range of motion. The selectable ranges of motion during concentric or eccentric exercising may be the same ranges or different ranges. The amount of the resistance or force applied during the respective ranges of motion may each be fixed or may vary throughout the range of motion.

The exercising and training apparatus and method of the invention uniquely addresses the growing attention by strength and conditioning practitioners, as well as physical therapists, to the benefits of functional exercise. The cornerstone of functional training and rehabilitation is to train movements, not individual muscles. Functional training incorporates the movement of multiple body parts moving through multiple planes. This applies both to human force production as well as force reduction. When multiple body parts are recruited in functional exercise one can have eccentric, concentric, and isometric (stabilization) muscle activity taking place simultaneously which duplicates what transpires in athletic movements as well as activities of daily living.

One embodiment of the invention comprises a core/torso exerciser designed for exercising or training the user while standing. Advantageously, since almost all activities requiring dynamic movement of one's torso, whether sports related or activities of daily living, are performed while standing, the core/torso exerciser of the invention involves the functional, integrated involvement of the ankles, knees, and hips, as opposed to exercises that focus on isolating individual muscles. In such functional exercising and training (where stabilization is not provided through an outside support mechanism), the joints through which movement takes place are required to recruit adjacent muscles for additional range of motion or stabilization.

The apparatus and method of the invention may be implemented using double-acting actuators (or two oppositely mounted single-acting actuators) under computer control. The actuators may comprise electric actuators, pneumatic actuators or hydraulic actuators, or a mixture thereof. In the preferred embodiment, the actuators are computer-controlled to provide a fixed or variable concentric resistance along a fixed or variable path of motion in one direction and to provide a fixed or variable eccentric force along a fixed or variable path of motion in an opposite direction.

Advantageously, the use of computer-controlled actuators eliminates the use of the rotating flywheel of our prior invention that must be mechanically disengaged at the end of each path of motion. Moreover, the computer-controlled actuators of our present invention may be employed in lieu of dead weights in many types of machines adapted for exercising parts of the user's body, such as for example, in a squat machine, in a dead-lift machine, a biceps curl machine. Further, the affects of inertia attendant to rapid lifting or lowering dead weights is eliminated. Finally, the computer-controlled actuators of our present invention provides variable resistance or force with significantly greater control than what may be attained by popular full-range variable resistance cams and converging axis movements employed in popular dead-weight exercising machines.

In addition to computer control of actuators, our present exercising and training apparatus and method significantly improves our prior exercising machine to be more ergonomic and user friendly as well as easier to be dismantled and packaged for shipping.

Our present exercising and training apparatus and method may be used by any user such as an athlete, body-builder or layperson. Indeed, our exercising and training apparatus and method is particularly suitable for elderly users or users undergoing rehabilitation who simply wish to increase the range of motion of a certain body part or improve their balance. Improved rotational strength and rotational awareness through use of the machine should reduce the incidence of falls by the elderly and a reduction in the severity of injury in the event of a fall.

Our present exercising and training apparatus and method may be used to enhance a user's response to stimuli to provide for the measurement of the time the user takes to initiate a movement in response to the audible or visual cue. For example, after completing selected range of motion in a counter-clockwise direction the user waits for a visual or audible cue to start a clockwise motion to return to the original starting point. The time for the user to respond to the visual or audible cue is measured as well as the total time to return to the original stating point. The ability to accurately measure reaction time is important in evaluating rehabilitation issues as well as human performance issues. In a another example, the user turns the harness in a counter-clockwise direction to a selected position against a selected resistance level at which time the resistance imparted by the harness is released for a period of delay time unknown to the user. After the preselected delay period has lapsed, under computer control movement of the harness is imparted and the time it takes the user to stop the movement of the harness is recorded by virtue of the encoder located on the shaft detecting that rotation of the harness has been arrested by the user. In the rehabilitation and conditioning industry, the unanticipated movement on the user is known as a perturbation exercise. Perturbation exercises are believed to improve the efficiency of proprioceptive signals to the musculoskeletal system which aids in injury prevention and human performance. In still another example, a user is situated in a neutral position, which means the user's shoulders have zero degrees of rotation to the left or right, as shown by the touch screen monitor. Through the use of the computer controls over the pneumatic system the harness is programmed to move with no visual or audible cue to the user. Once harness rotation is initiated, the computer controls tracks the signals from the encoder mounted on the harness shaft to record how many degrees the harness moved before its rotational movement is arrested and how long it takes the user to arrest the rotational movement. At the point of the harness rotation being arrested, the resistance imparted to the shaft can be programmed to be released or the programming can require the user to rotate the harness in the opposite direction of the initial rotation until a preselected number of degree of counter rotation has been reached. It is believed that the analyzing of a user's ability to recognize and respond to outside forces is a valuable aid in monitoring physical rehabilitation and human performance.

Background information relating to the foregoing may be found in Chapter 6 of *Anatomy Trains-Myofascial Meridians for Manual and Movement Therapists*, by Thomas W. Myers, published in by Churchhill Livingstone, IBSN 0 443 06351 6, the disclosure of which is hereby incorporated by reference herein.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 15 illustrate the characteristics of the foam pad on which the user stands during use of the core-exercising embodiment of the present invention;

FIGS. 16A-16H and 16J-16N illustrate the input screens of the core-exercising embodiment of the present invention;

FIGS. 17A-17M illustrate the electrical schematics of the core-exercising embodiment of the present invention;

FIG. 21A-21G illustrates an arm rotation exercising embodiment of the present invention.

Similar reference characters refer to similar parts throughout the several views of the drawings.

DETAILED DESCRIPTION OF THE PREFERRED EMBODIMENT

The preferred embodiments of the exercising and training apparatus and method 110 of the invention described below employ pneumatic actuators. However, it shall be understood that without departing from the spirit and scope of the present invention, other types of actuators may be employed in lieu of pneumatic actuators. The three preferred embodiments of the exercising and training apparatus and method 110 comprise a core-exercising embodiment 110C, a vertical-lift embodiment 110V and an multi-function (leg extension, arm curl, lat pull-down, chest press and butterfly) embodiment 110M. However, it shall be understood that without departing from the spirit and scope of the present invention, other types of equipment may be employed to exercise other parts of a user's body.

The preferred embodiments of the exercising and training method 110 of the invention employs computer controlled pneumatics for each apparatus embodiment 110 to control fixed or variable resistance(s) along the path of motion in one direction during concentric exercising and to control fixed or variable force(s) during return movement in the opposite direction during eccentric exercising (as used herein in describing concentric and eccentric exercising, the term "resistance" implies concentric exercising whereas the term "force" implies eccentric exercising). The desired range(s) of motion (i.e., the stroke distances) and the desired fixed or variable resistance(s) and force(s) may each be selected by the user through graphical user interface screens 1105 under computerized control 110C.

Figure 1:
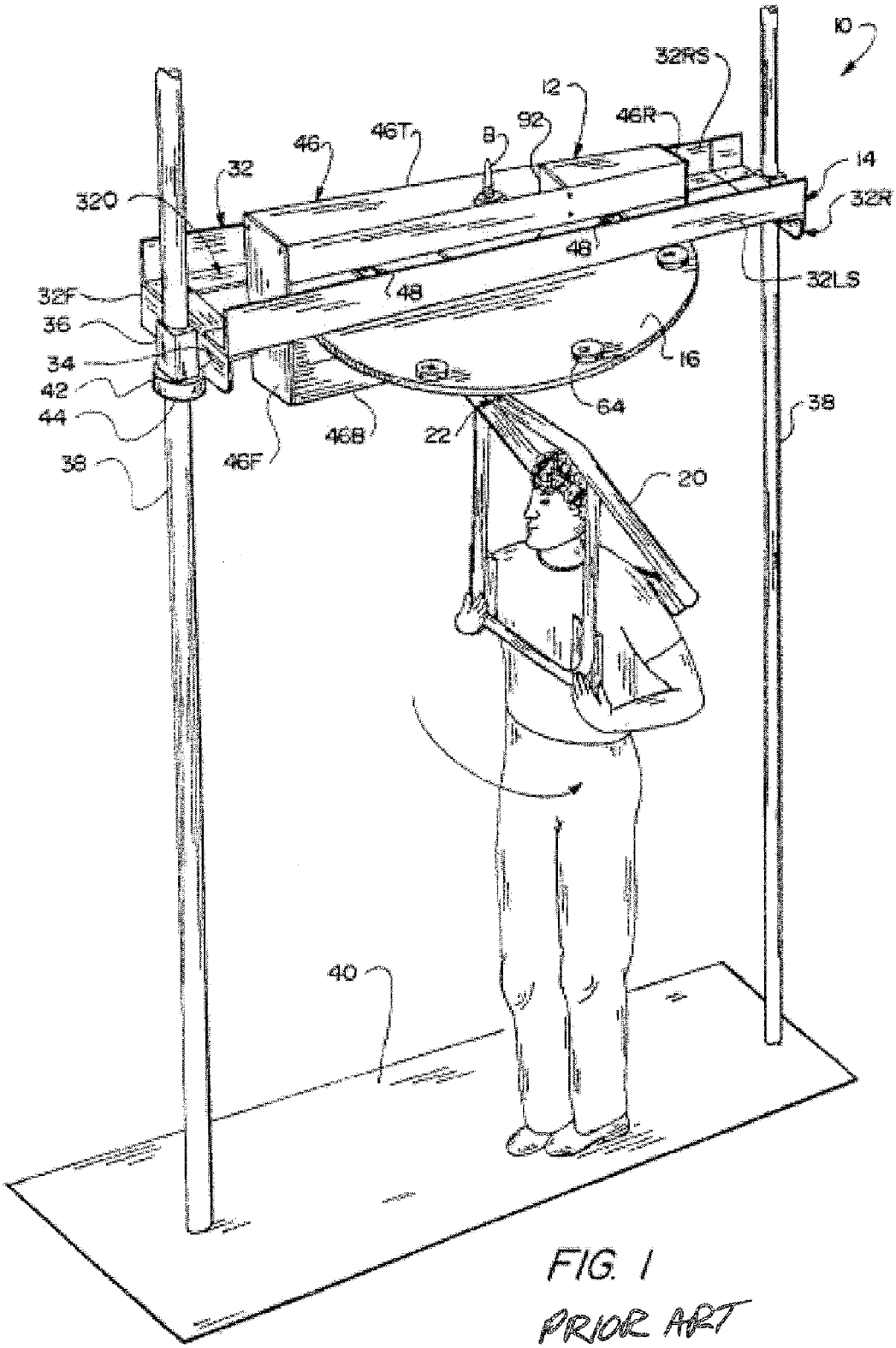
FIG. 1 PRIOR ART
FIGS. 1-5 illustrate our prior art exercising machine.
Figure 5:
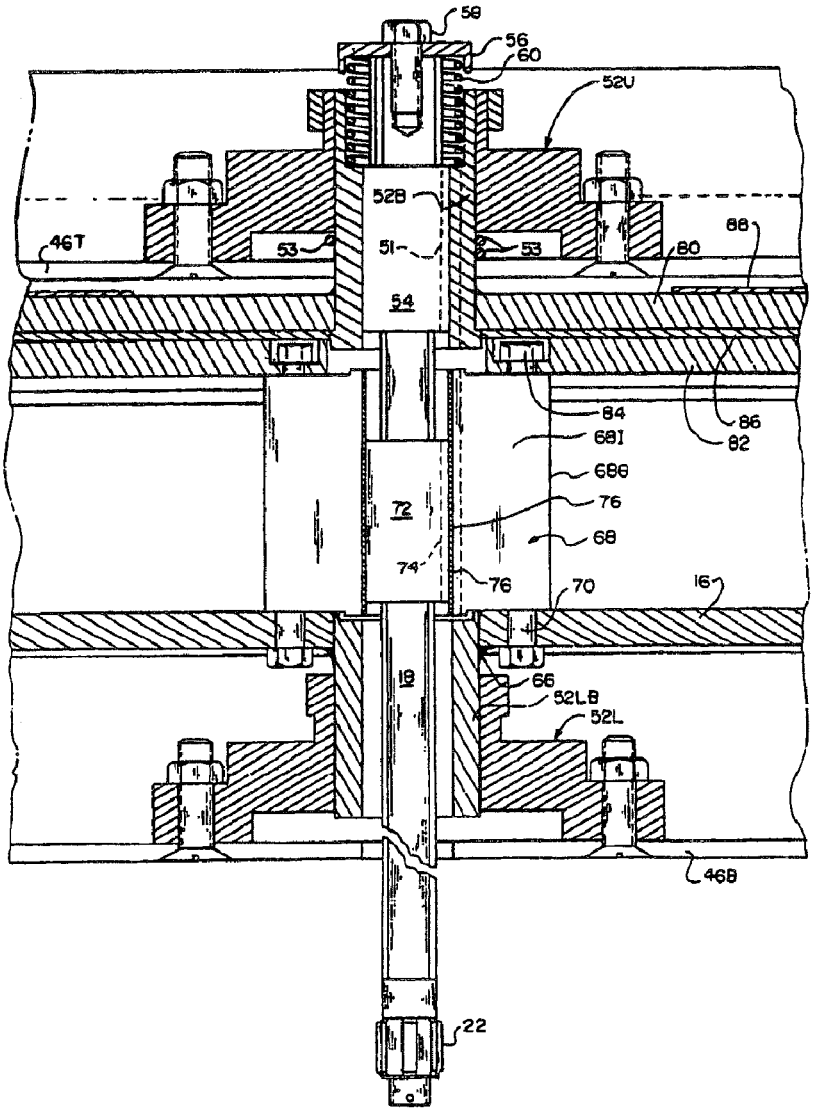
FIG. 5 PRIOR ART
Figure 2:
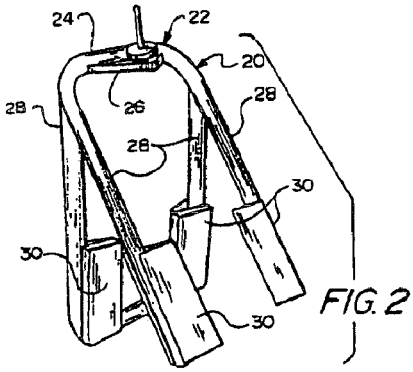
FIG. 2 PRIOR ART
Figure 3:
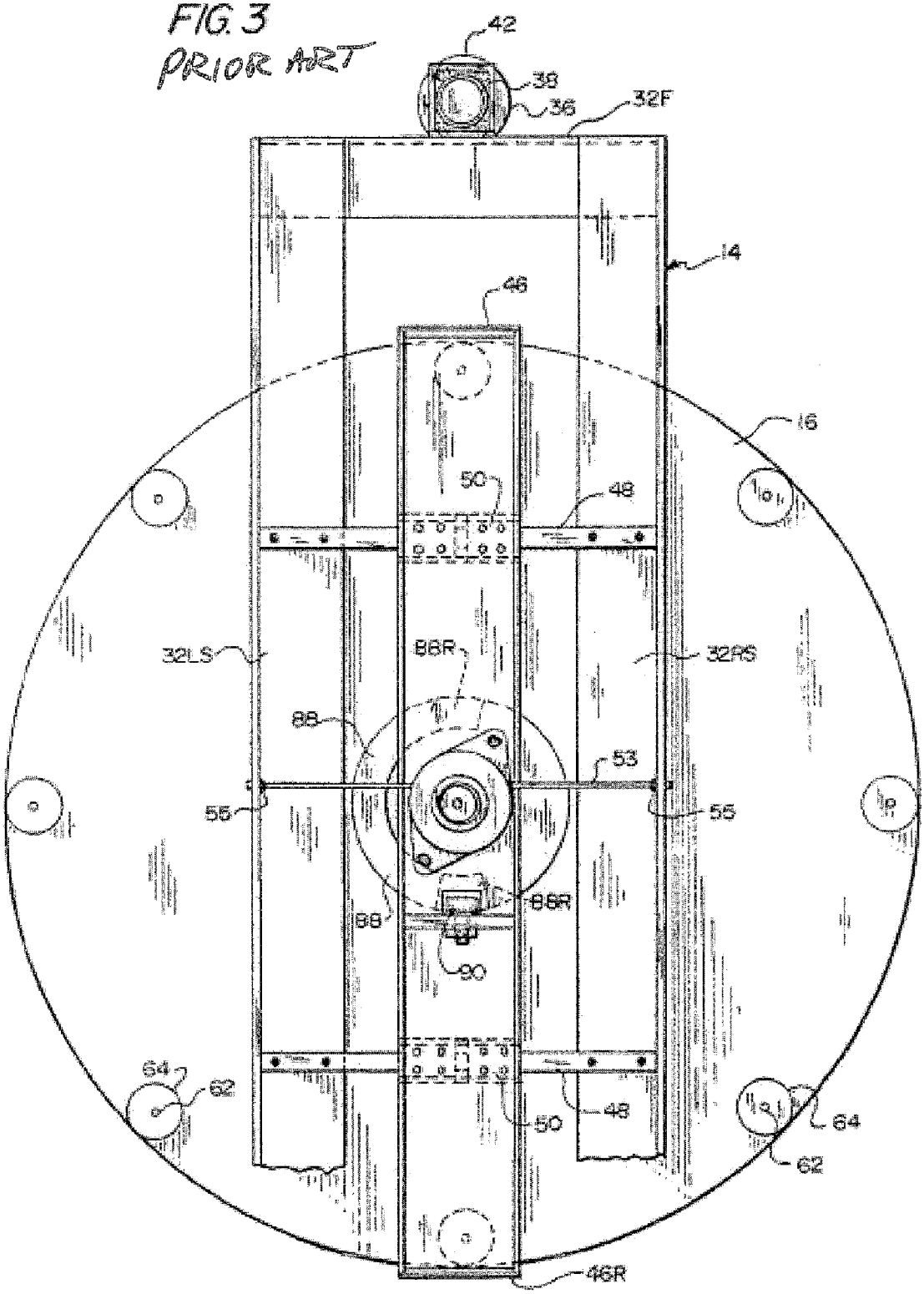
FIG. 3 PRIOR ART
Figure 4:
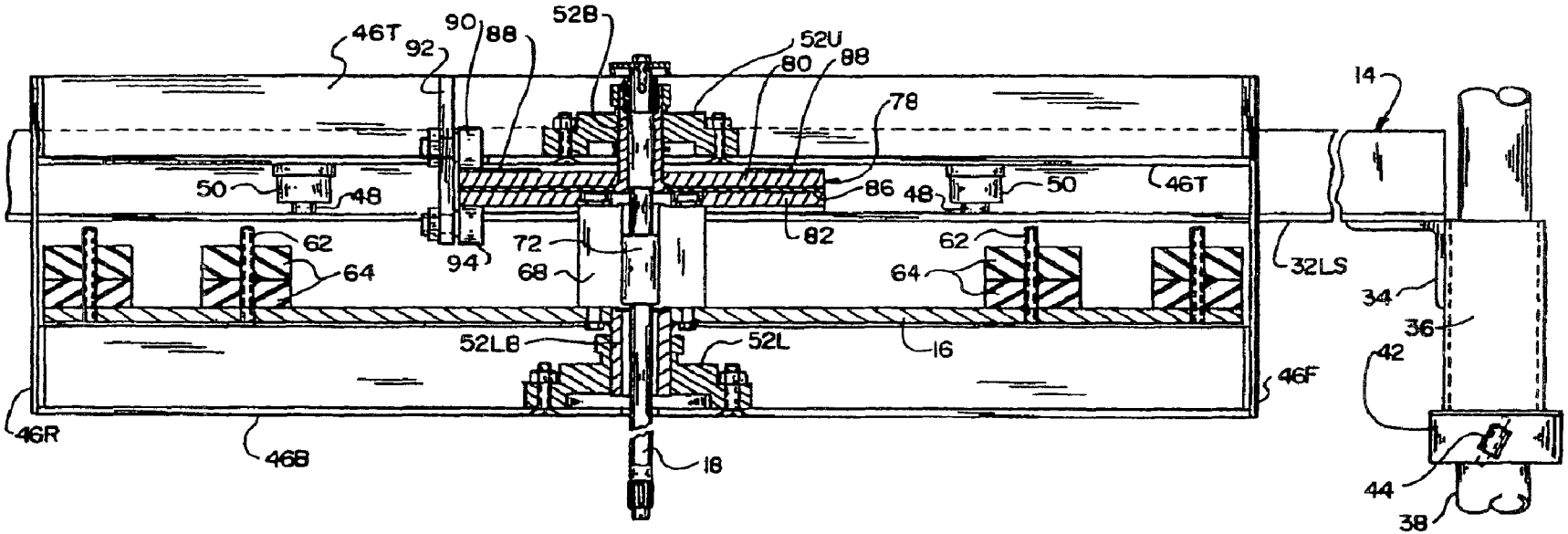
FIG. 4 PRIOR ART
Figure 6A:
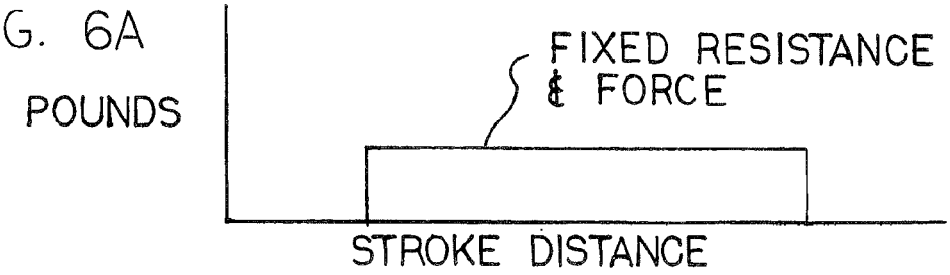
FIGS. 6A-6E illustrate the method of the present invention.
Figure 6B:
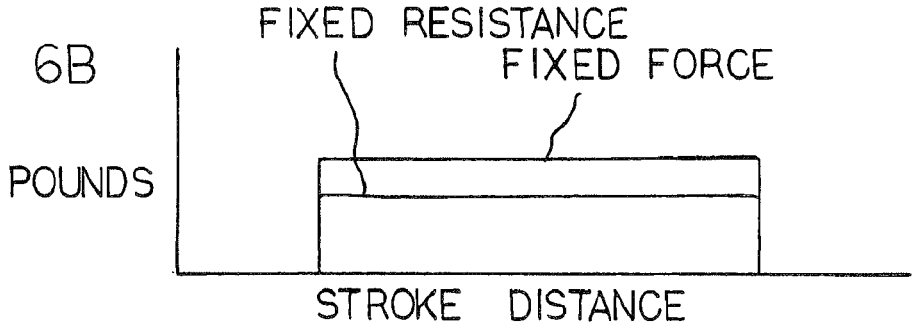
Figure 6C:
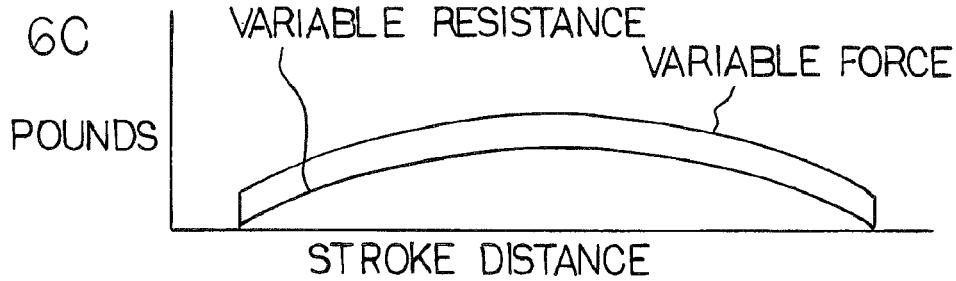
Figure 6D:
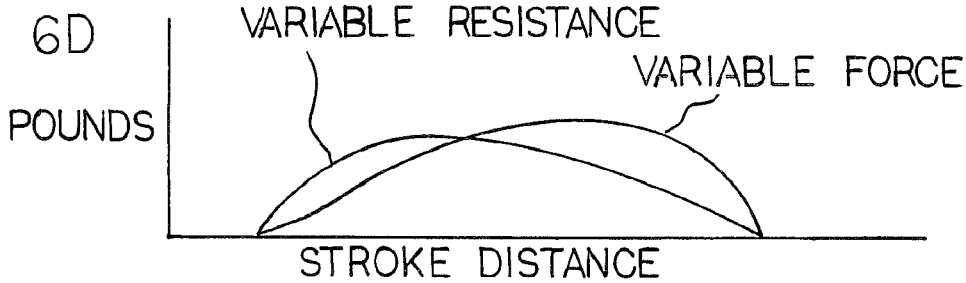
Figure 6E:
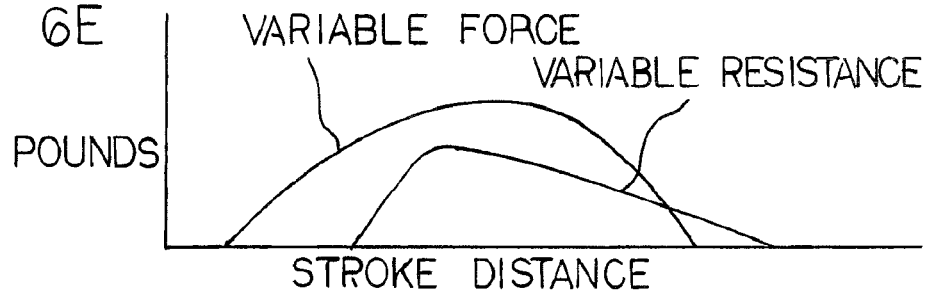

More particularly, as shown in FIG. 6A, the amount of resistance and the amount of force and their stroke distances may be the same. As shown in FIG. 6E, the amount of force may be proportionally greater than the amount of resistance over the same stroke distance (11/2:1 illustrated). As shown in FIG. 6C, the amount of force and the amount of resistance may vary in the same proportion over the same stroke distance. As shown in FIG. 6D, the amount of force and the amount of resistance may vary in different proportions over the same stroke distance. As shown in FIG. 6E, the amount of force and the amount of resistance may vary in different proportions over different stroke distances. Each of such parameters are preferably selectable by the user.

Core-Exercising Embodiment

Exercising one's core muscle groups often involves rotation of the person's torso. For rotation to take place in one's torso, recruitment of a spiral line of the myofascia is required. The myofascia is descriptive of the inseparable nature of muscle tissue (myo) and its related web of connective tissue (fascia). In using the core-exercising embodiment of the invention, a rotational movement recruits a spiral line of the myofascia that loops around the body in a helix, running from the skull down to a foot and spiraling back to the base of the skull. To maintain stability in the torso and lower extremities, this rotational activity requires co-activation of agonist and antagonist muscle groups which are linked in the spiral line being recruited. The knees and abdomen are two of the most obvious areas which require co-activation of the myofascia for one to produce stabilized rotational movement, whether producing or absorbing rotational force. Since the person is connected by his feet to the ground and by his shoulders to the harness, there is no outside support for the numerous joints being moved between such points of connection. Through the invention's ability to increase eccentric force over what one can produce through concentric muscle activity, both the muscle and fascia systems encounter tension above what they can produce on their own. This simultaneous linkage of multiple body components encountering high force eccentric muscle activity is believed to elicit an adaptive response to the linked myofascia which promotes increased strength and protection from injury.

Figure 7A:
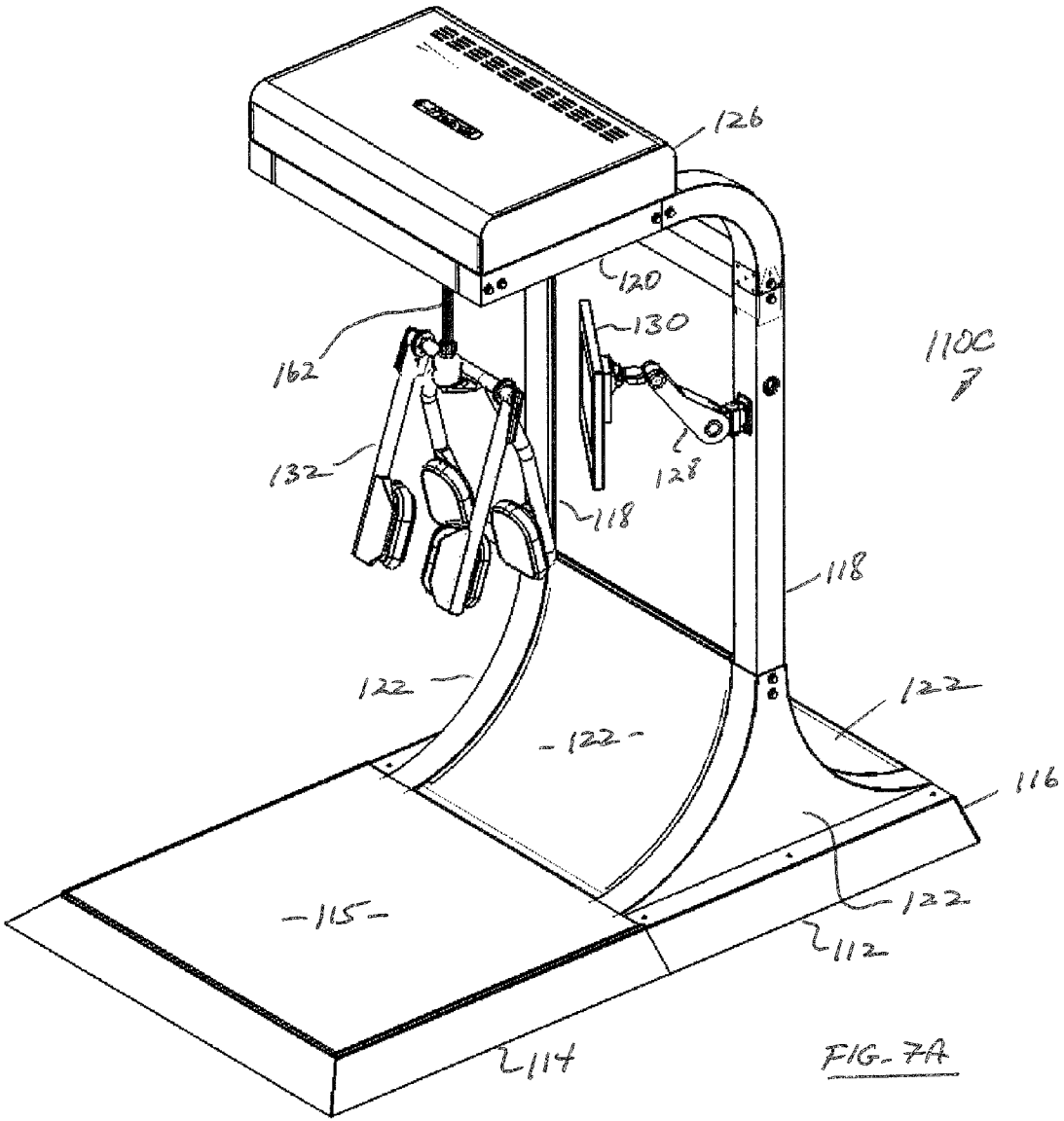
FIGS. 7A-7B illustrate the core-exercising embodiment of the present invention.
Figure 7B:
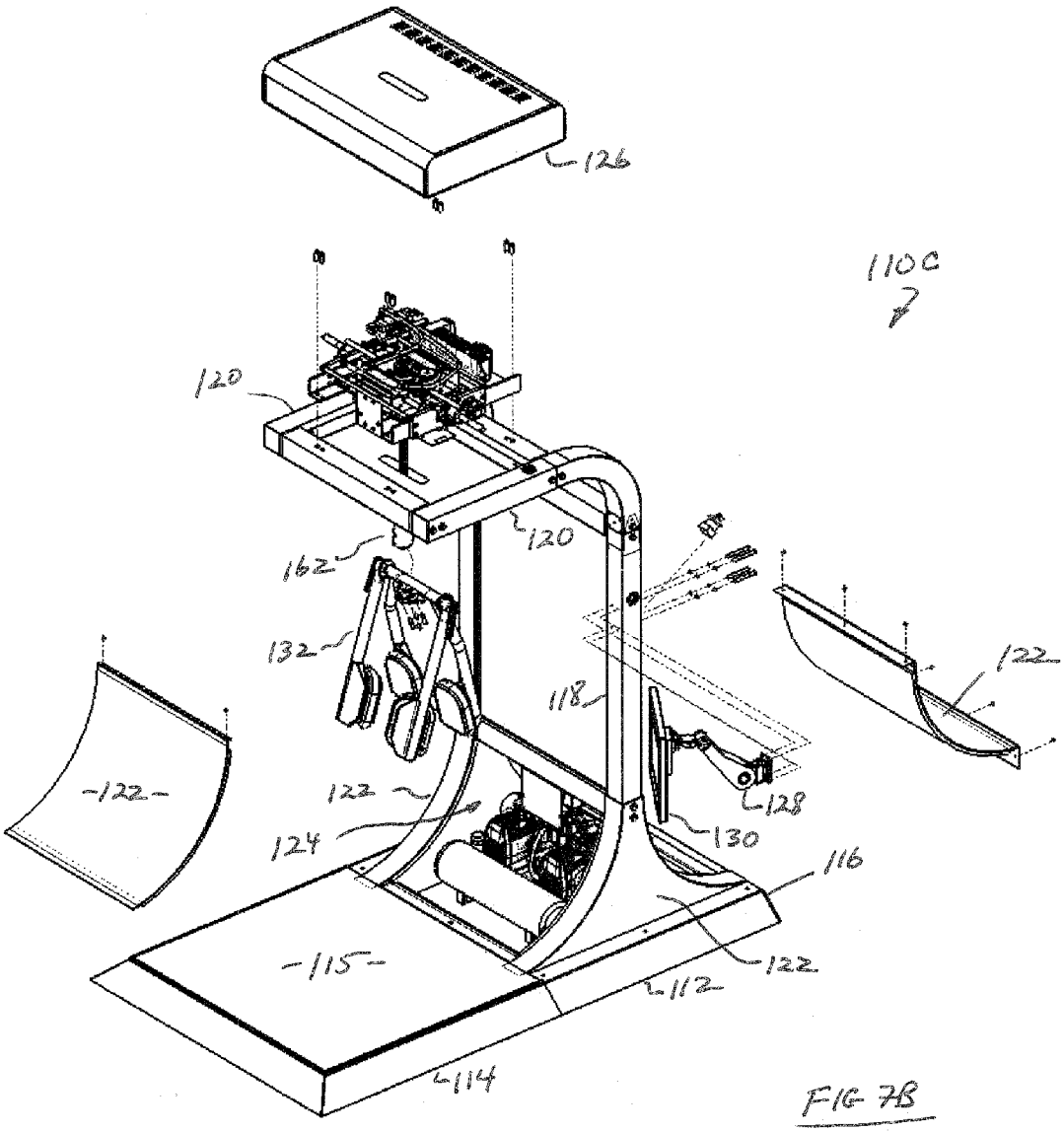

Referring to FIG. 7, the core-exercising embodiment 110C of the exercising machine of our present invention 110 comprises an ergonomic structure having a base platform 112 with a front deck area 114 on which the user is intended to position himself for exercising. An exercise pad 115 is preferably positioned onto the front deck area 114.

The rear portion 116 of the platform 112 supports upstanding side supports 118 in an inverted L-shaped configuration which are curved forwardly at their top portion 120 to extend over at least a portion of the deck 114 of the platform 112.

The lower portion of the supports 118 comprise front, rear and side gusset panels 122 which define a lower compartment 124 in which are positioned various pneumatic components as more particularly described hereinafter. An upper compartment 126 is supported by the top portion 120 of the supports 118. As more particularly described hereinafter, the upper compartment 126 contains various mechanical components from which the harness assembly 132 is operatively suspended by a drive shaft 162. Preferably, the supports 118 are hollow to define raceways for pneumatic lines and electrical control cables to extend to and from the lower compartment 124 to the upper compartment 126.

A computer monitor bracket 128 is connected to one of the supports 118 for supporting a touch screen computer monitor 130 at a convenient level for operation by the user while standing on the deck 114 of the platform 112.

As shown in FIG. 8, one embodiment of an improved harness assembly 132 of our new invention comprises an adjustable assembly to accommodate users with larger or smaller torsos. More specifically, the top ends of the rear inverted U-shaped frames 132R each include an angularly-adjustable ratchet assembly 133 operatively connected to a horizontal cross member 132H. The ratchet assembly 133 allows the user to selectively ratchet-adjust the angular separation of the front and rear inverted U-shaped frames 132F and 132R of the harness assembly 132. Increasing the angular separation accommodates larger-torso users whereas decreasing the angular separation accommodates smaller-torso users.

Figure 8A:
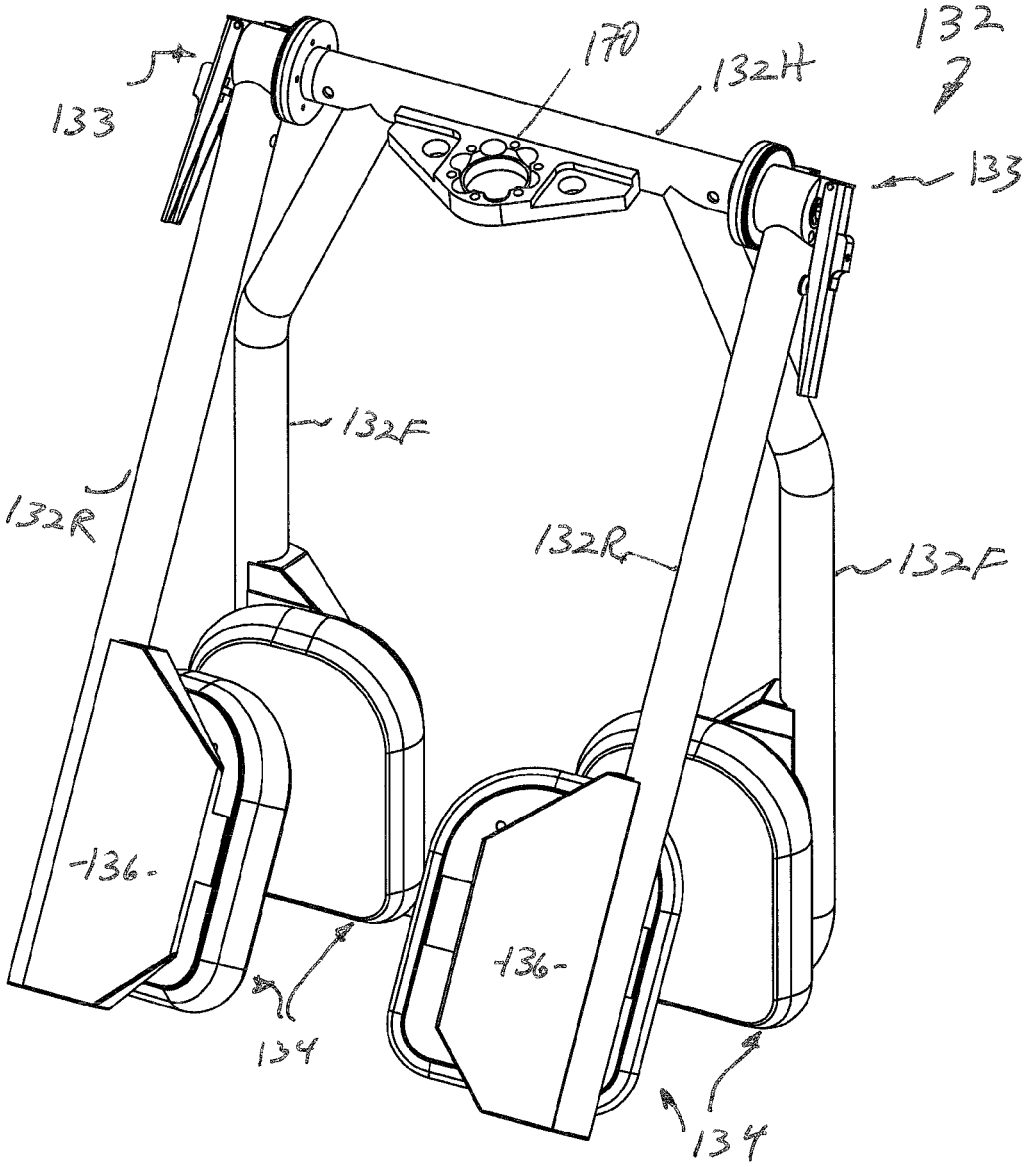
FIGS. 8A-8E illustrate the harness assembly of the core-exercising embodiment of the present invention.
Figure 8B:
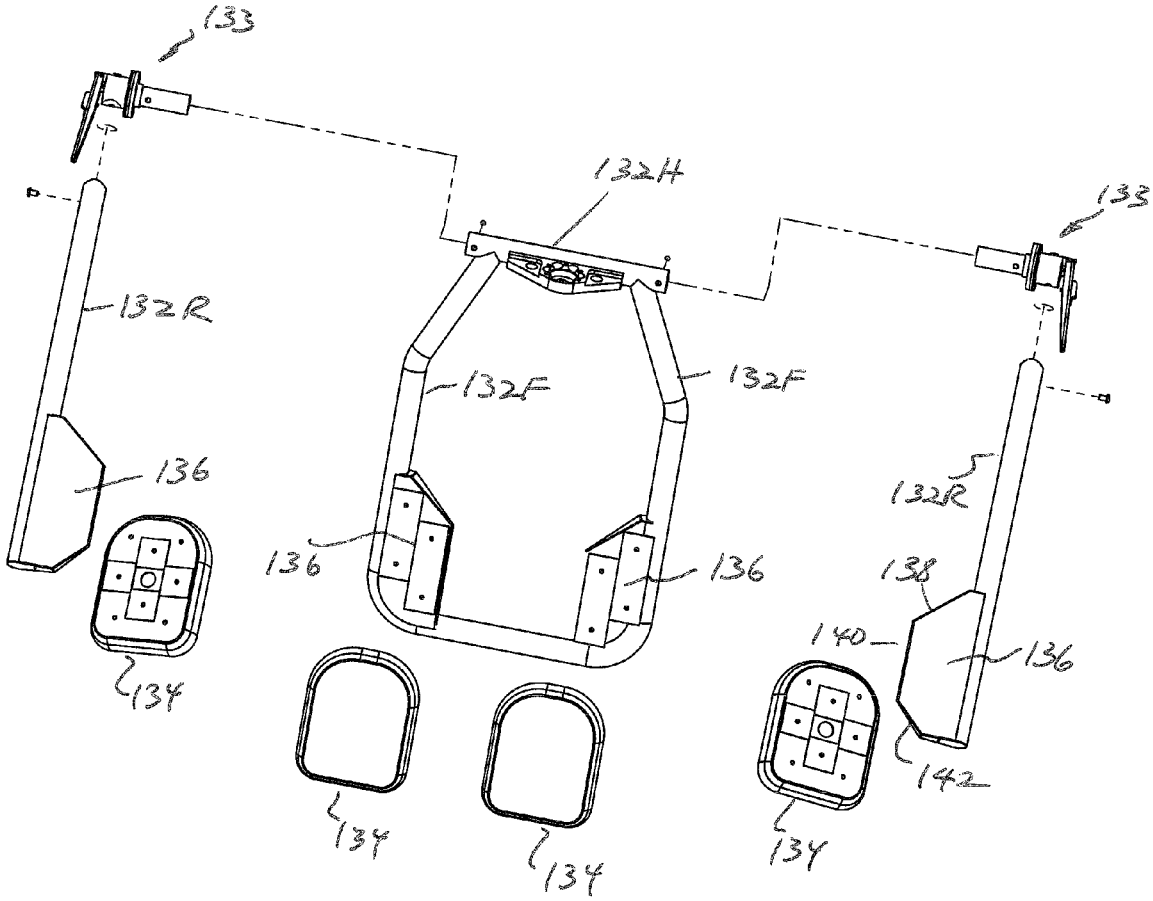
Figures 2, 8C:
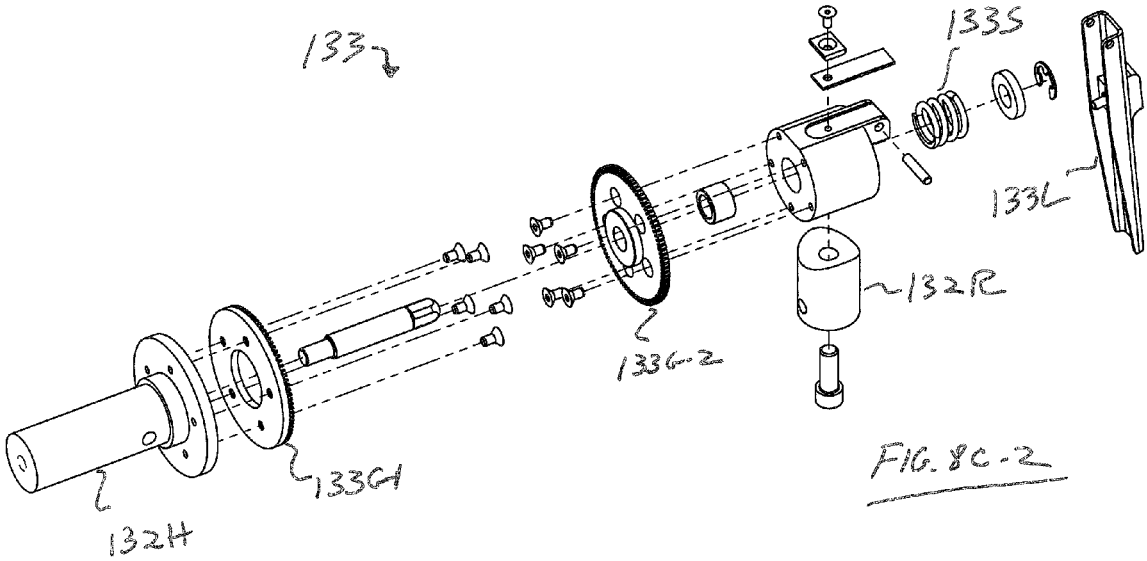
Figures 1, 8C:
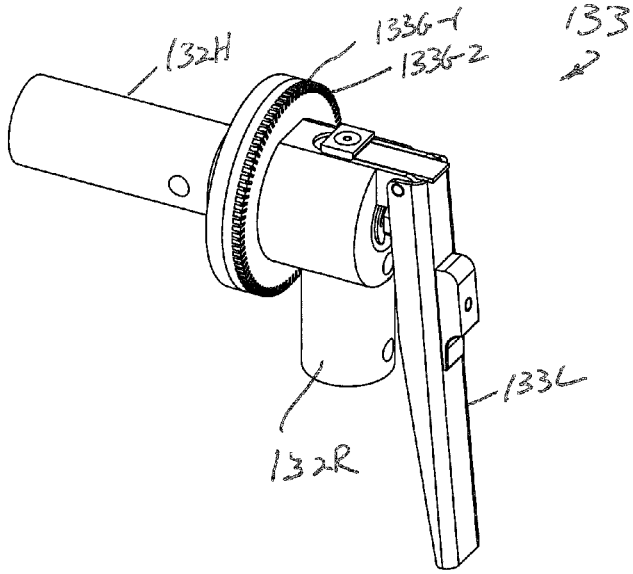
Figures 1, 80:
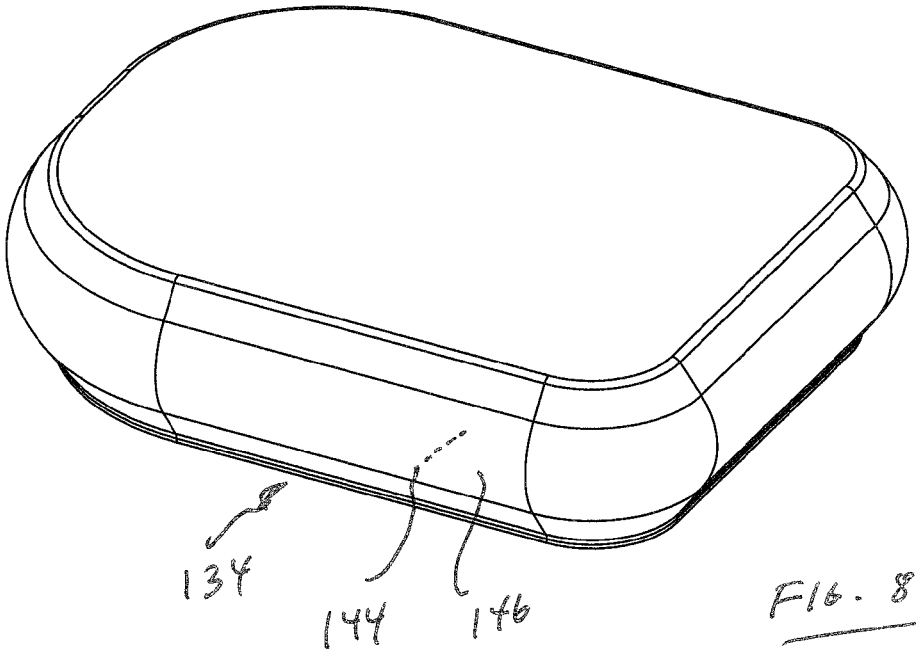
Figures 2, 8D:
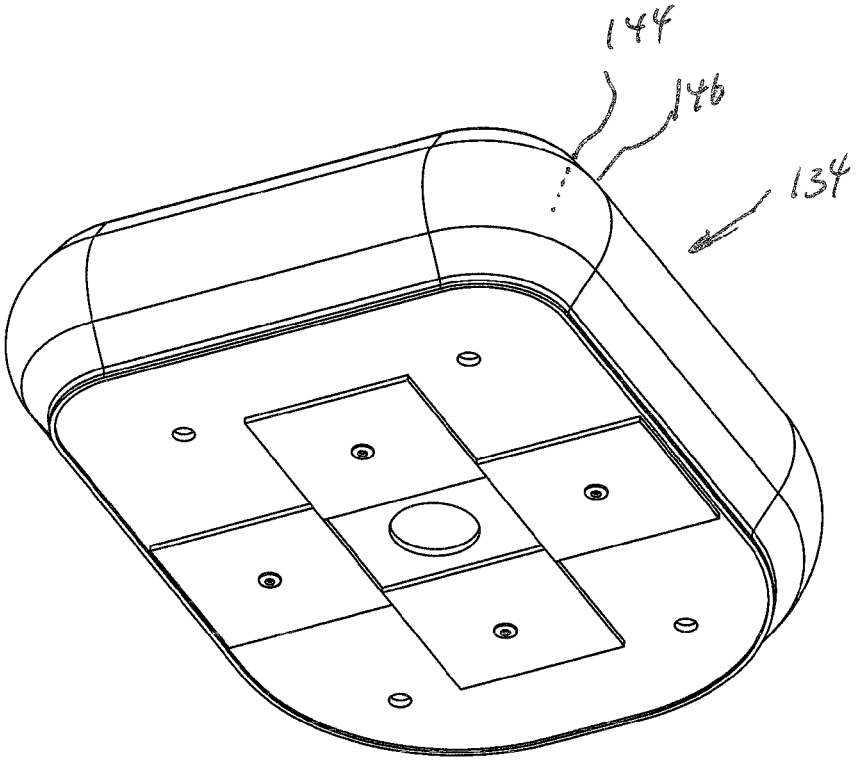
Figure 8E:
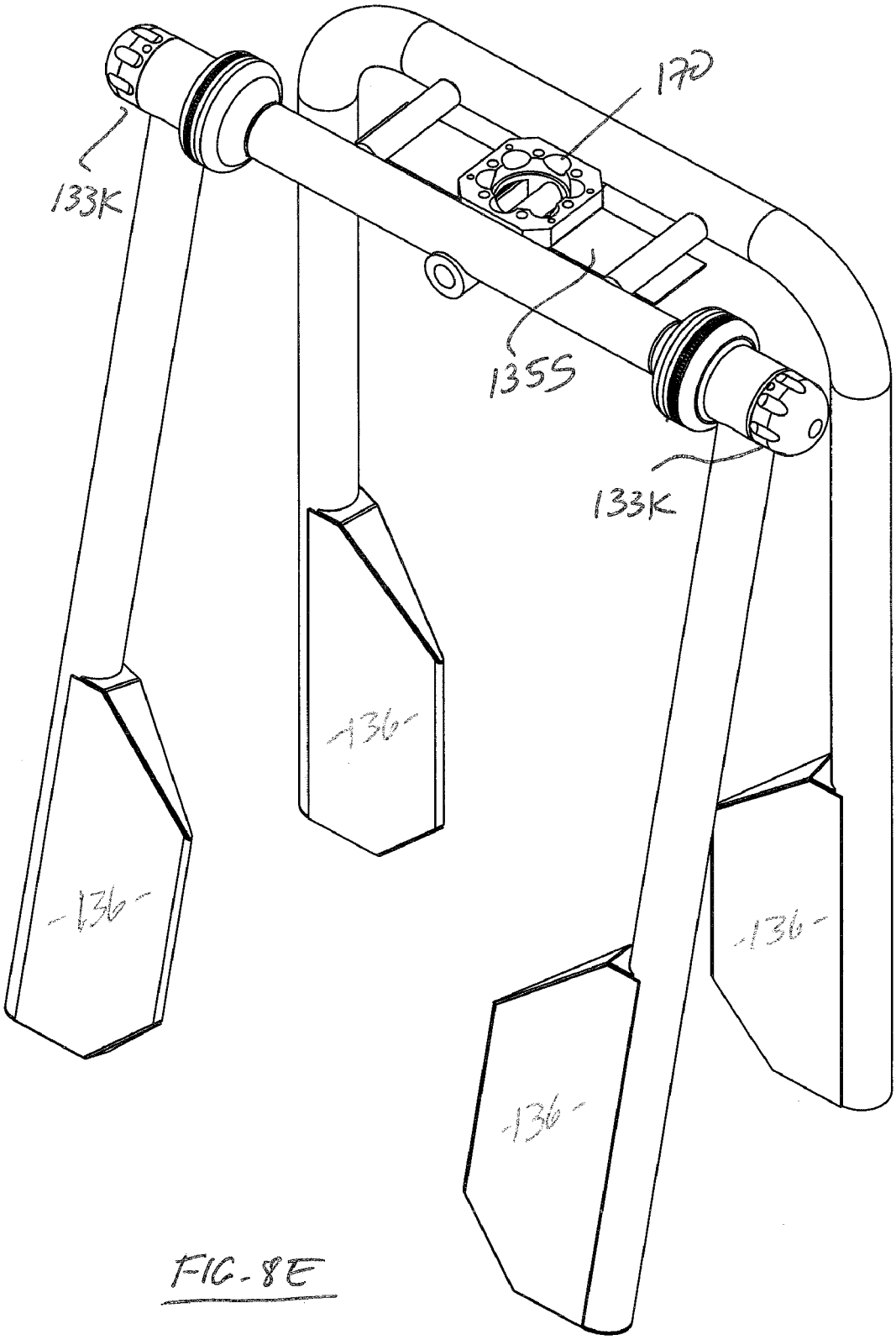

As shown in FIG. 8C, the ratchet assembly 133 comprises a first gear 133G-1 fixed relative to the horizontal cross member 132H to which is engaged a second gear 133G-2 fixed relative to the frame 132R. The gears 133G-1&2 are urged into engagement by a spring 133S. A pivot lever 133L is operatively connected to the end of the horizontal cross member 132H to relieve, upon pivoting, the force of the spring 133S thereby allowing the gears 133G-1&2 to be disengaged and angularly adjusted. Return pivoting of the spring lever 133L re-engages the gears 133G-1&2 to lock their relative angular movement. As shown in FIG. 8E, a rotary knob 133K may be employed in lieu of the pivot lever 133L. As also shown in FIG. 8E, the quick-disconnect connection 170 (described below) for the drive shaft 162 may be mounted to a slide 1355 to allow side-to-side movement of the drive shaft 162 relative to the harness assembly 132.

The improved harness assembly 132 comprises improved shoulder pad assemblies 134 each composed of a generally triangular rigid member 136 positioned at the ends of front and rear inverted U-shaped frames 132F&R of the harness assembly 132. Each of the assemblies 134 comprise a generally triangular rigid member 136 including an angled upper surface 138, a flat vertical inward surface 140 and, in the case of the rear frame 132R, upwardly angled bottom edges 142. Connected to each of the triangular rigid member 136 is a pad assembly 134 comprising a pad 144 preferably composed of a foam covered by a resilient material 146 such as silicone rubber selected to be textured so as to fit against the user's torso and keep the harness assembly 132 from riding up. Each of the pads 144 may be removably fastened to their respective triangular rigid members 136 by a removable fastener such as a hook and loop fastener. The removability of the pads 144 allows the pads to be easily removed to allow positioning side to side to fit any torso width and for cleaning and replacement once worn.

Notably, the core-exercising embodiment 110C shown in FIG. 7 is disassemable for shipping in conventional-sized shipping containers by separating the deck 114 and rear portion 116 of the platform 112, separating the upstanding supports 118 at a lower portion and upper portion thereof, removing the touch screen monitor 130 on which the various graphical user interface screens 110S are displayed, removing the screen's bracket 128, removing the harness assembly 132 and positioning such components in a plurality of shipping containers.

Figure 9A:
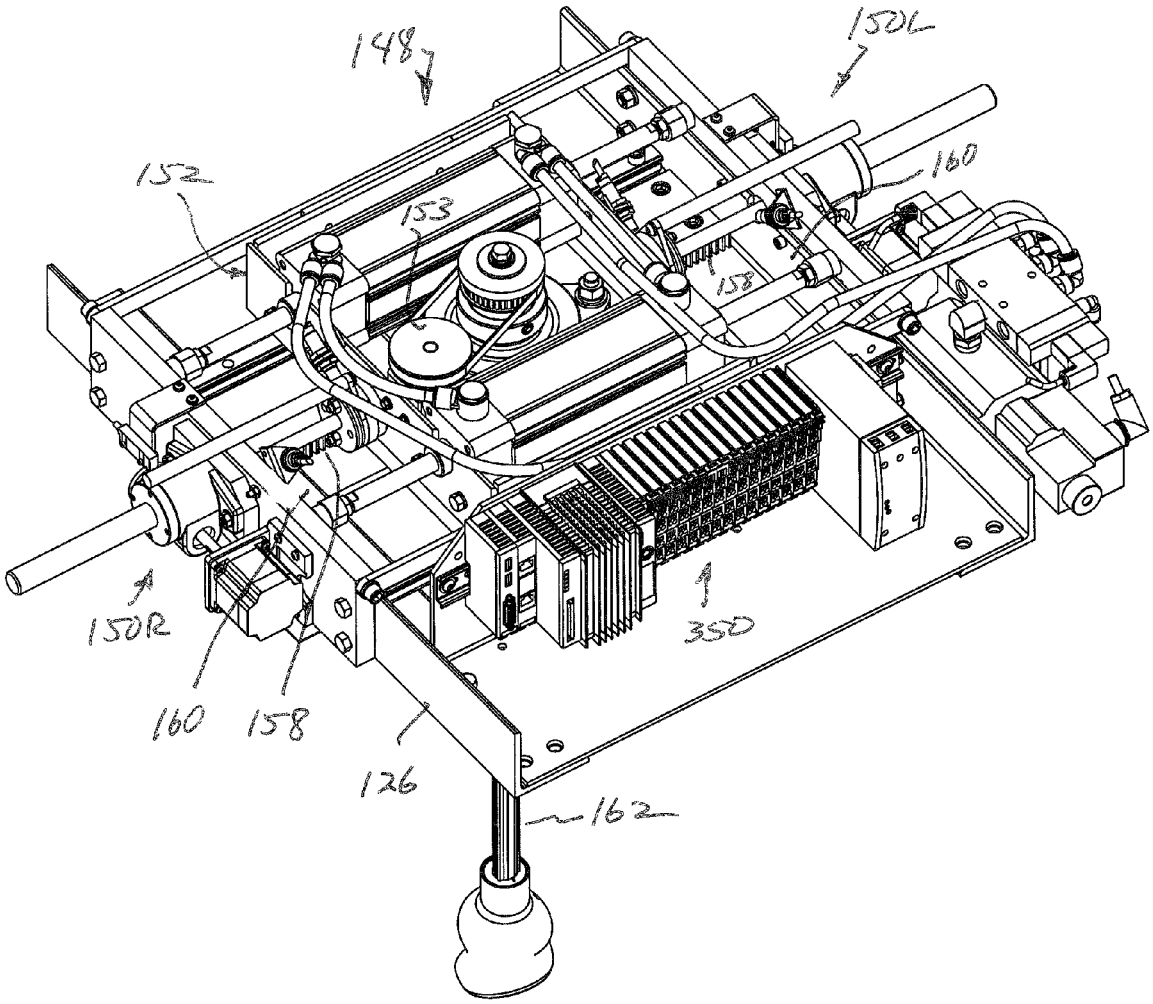
FIGS. 9A-9C illustrate the resistance/force assembly of the core-exercising embodiment of the present invention.
Figure 9B:
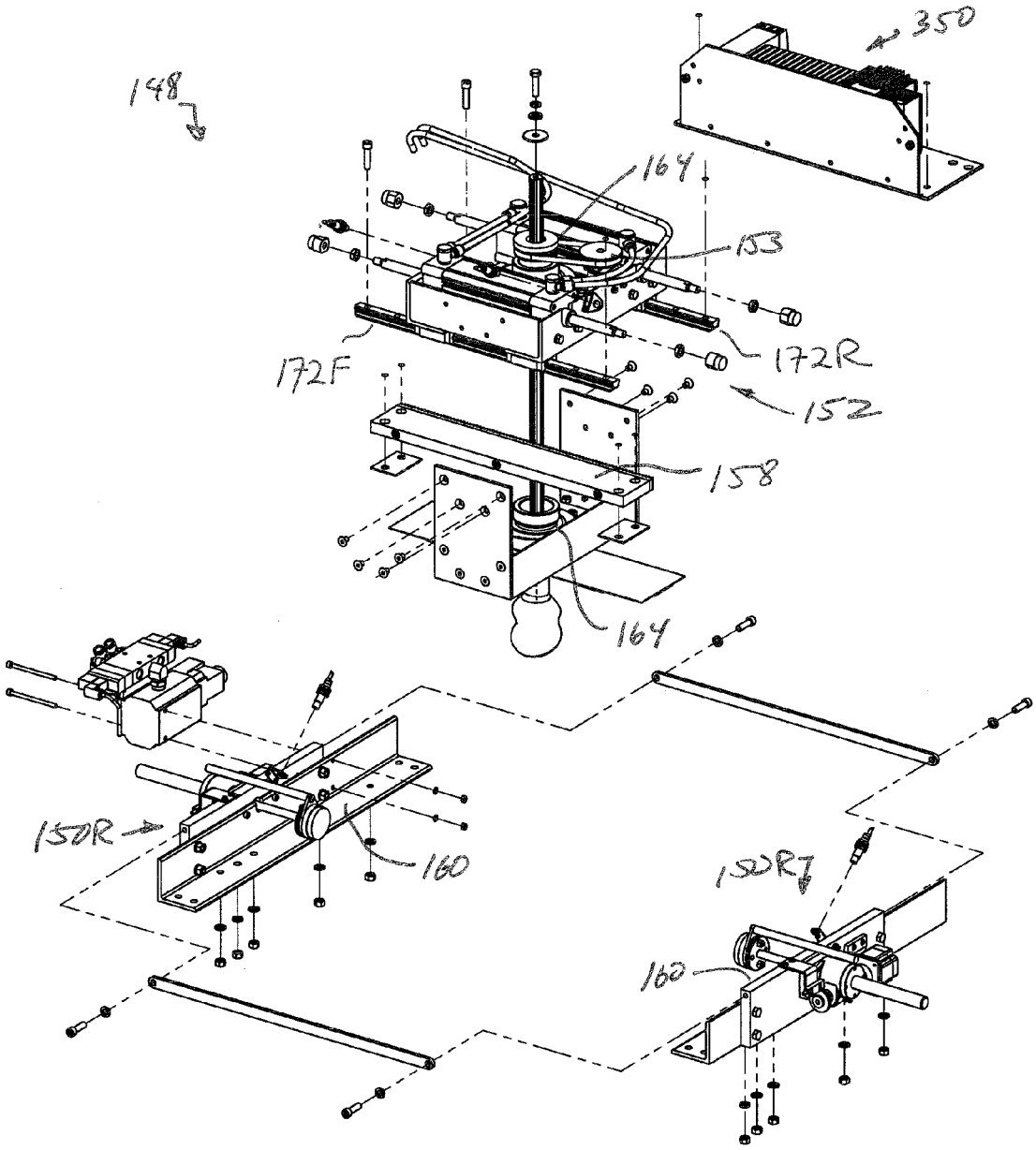
Figure 9C:
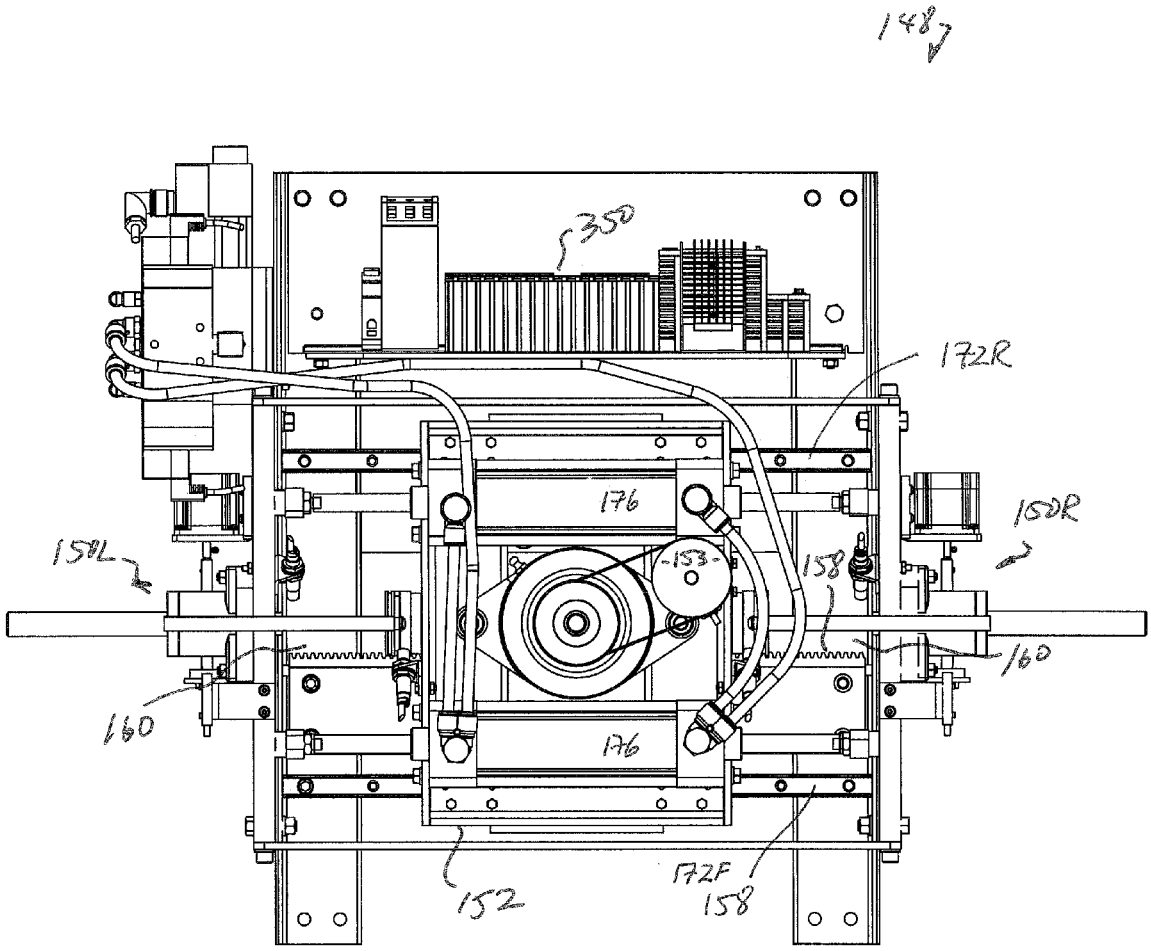

Referring to FIG. 9, a resistance/force assembly 148 is mounted within the upper compartment 126. The resistance/force assembly 148 includes a pair of left and right stop assemblies 150L and 150R between which is positioned a reciprocating rack assembly 152. The rack assembly 152 contains a pair of double rod double acting cylinders 154 that, under computer control, provide variable resistance along the path of motion upon rotation of the harness assembly 132.

More specifically, the rack assembly 152 comprising a rack 158 mounted to a support 160 within the resistance/force assembly 148, is supported by the teeth of the rack 158 being engaged with the teeth of the splines of the vertical drive shaft 162 connected to the harness assembly 132 such that upon sideways movement of the rack assembly 152, the shaft 162 and hence the harness assembly 132 are caused to rotate.

The vertical drive shaft 162 slidably extends through upper and lower bearings 164 of the rack assembly 152 to suspend it therefrom during operation while allowing free vertical movement relative to the rack assembly 152. An encoder 153 is provided for rotational position monitoring and resistance/force control of the drive shaft 162. Finally, the computer 350 of the computerized control 110C is supported by the rack assembly 148.

Figure 10:
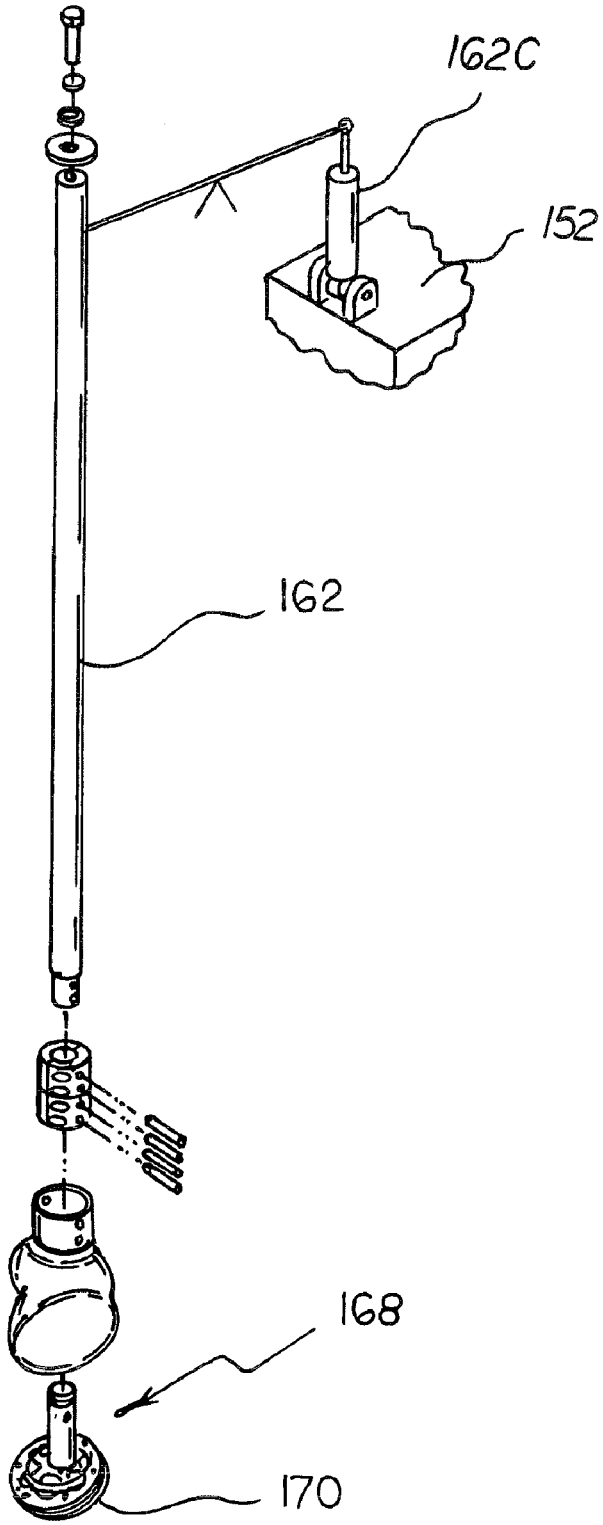
FIG. 10 illustrates the drive shaft of the core-exercising embodiment of the present invention.

As shown in FIG. 10, the lower end of the vertical drive shaft 162 comprises a constant velocity universal joint 168. The harness assembly 132 is coupled to the CV joint 168 by a quick disconnect fitting 170 formed of two halves, one coupled to the CV joint. 168 and the other coupled to the harness assembly 132, which may be quickly disengaged to allow removal of the harness assembly 132 from the end of the drive shaft 162.

Figure 17B:
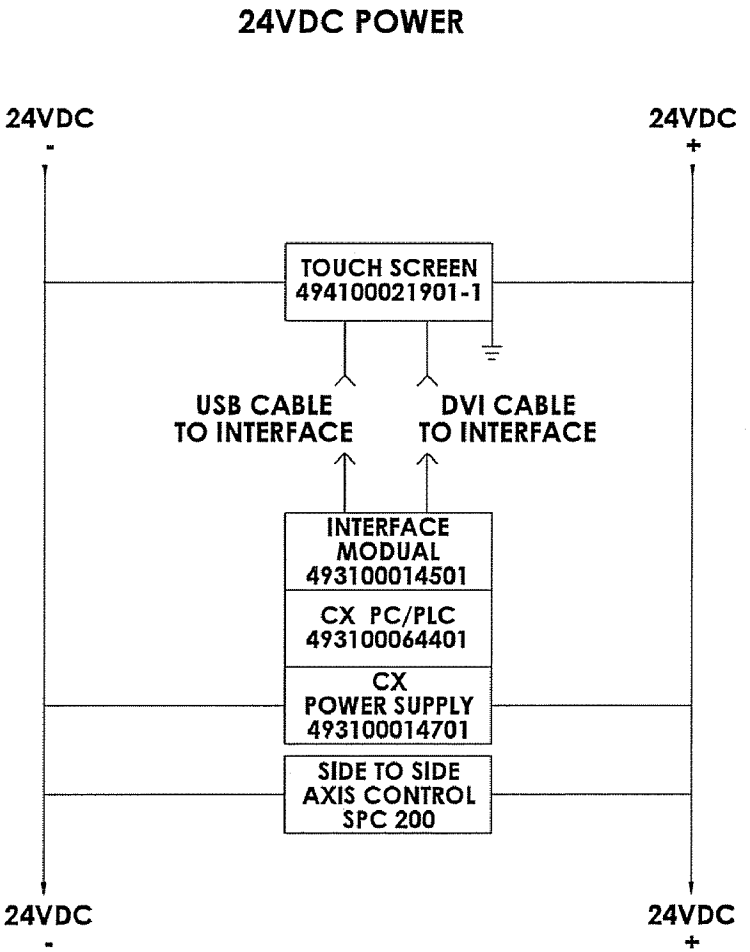
Figure 17A:
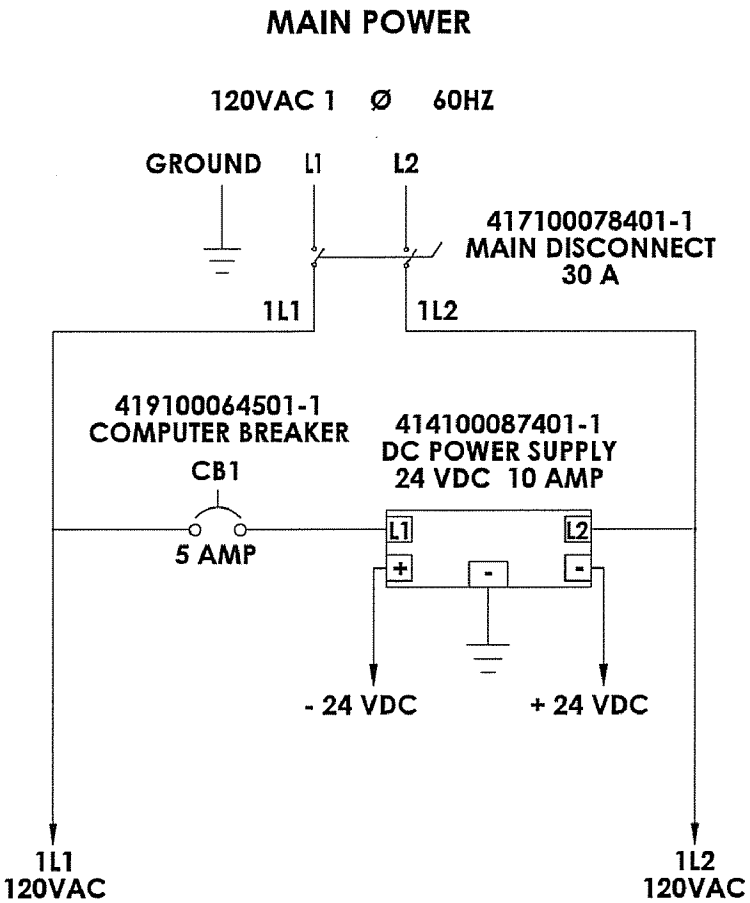
Figure 17C:
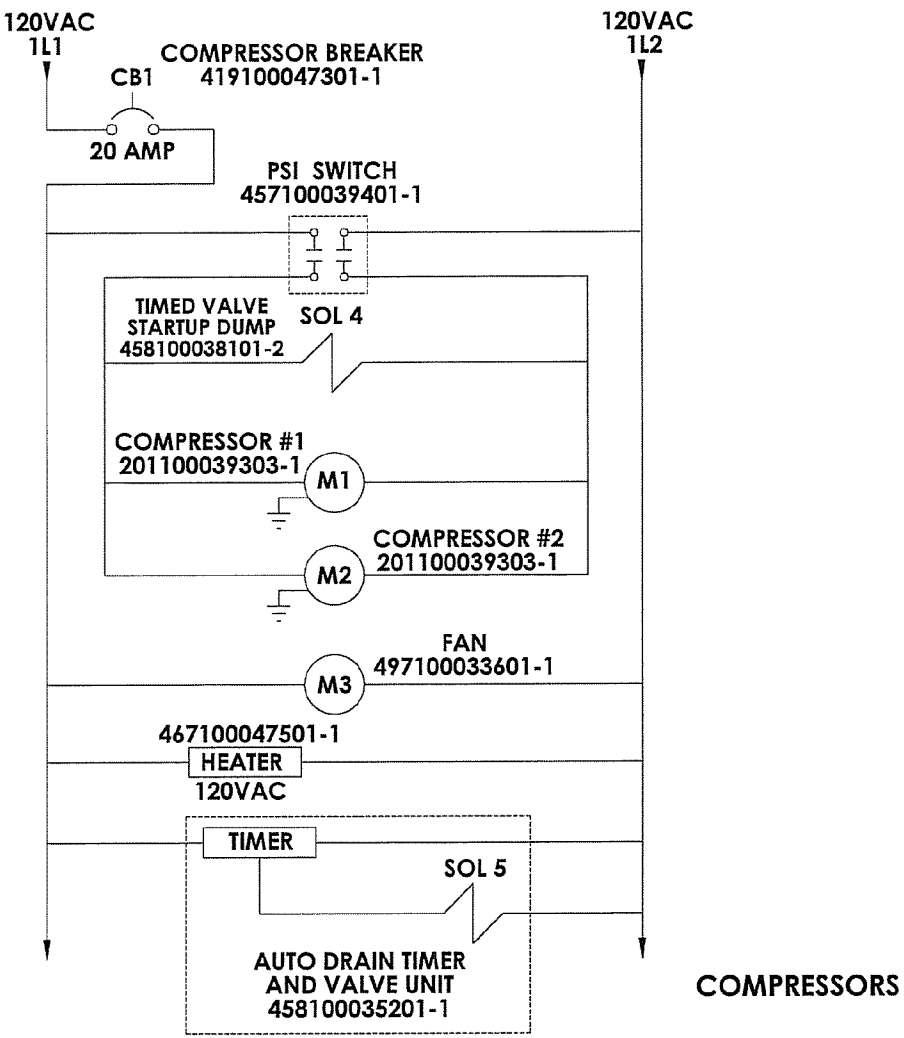
Figure 17E:
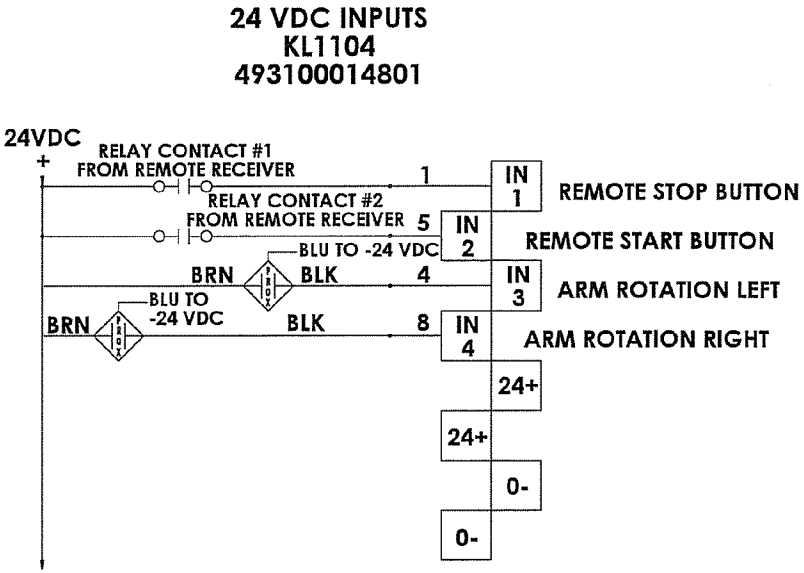
Figure 17D:
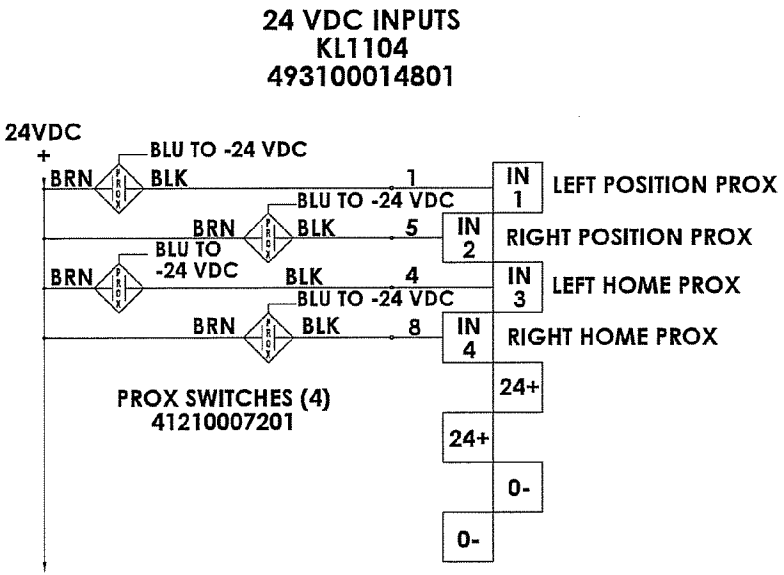
Figure 17G:
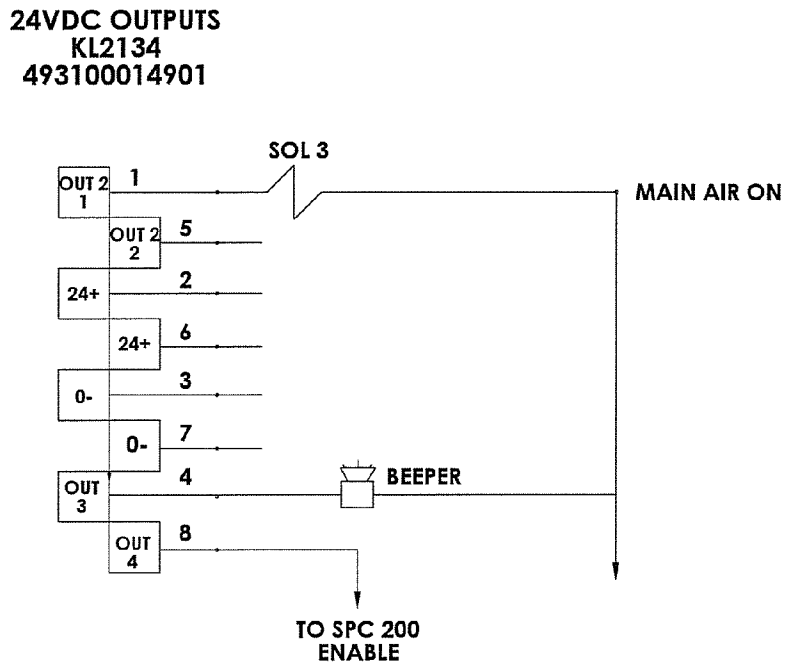
Figure 17F:
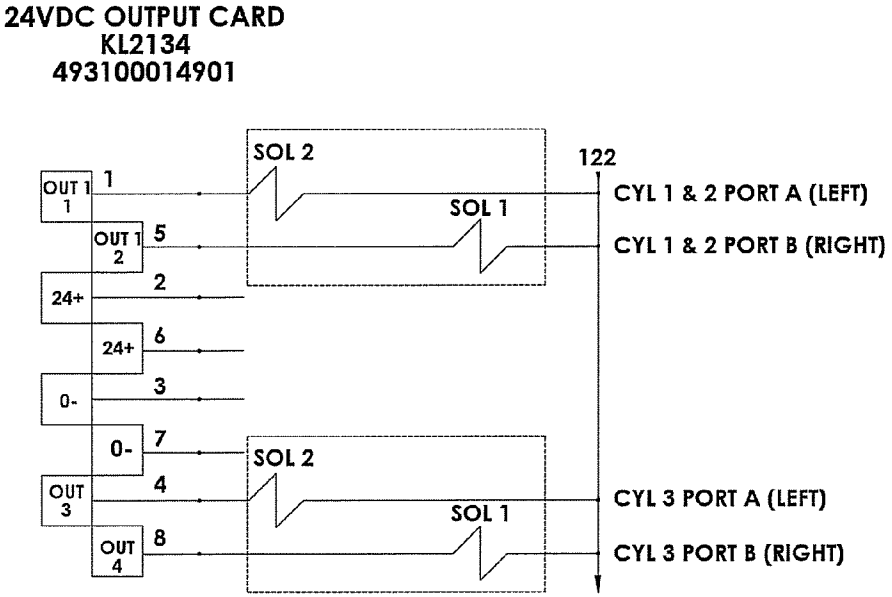
Figure 17H:
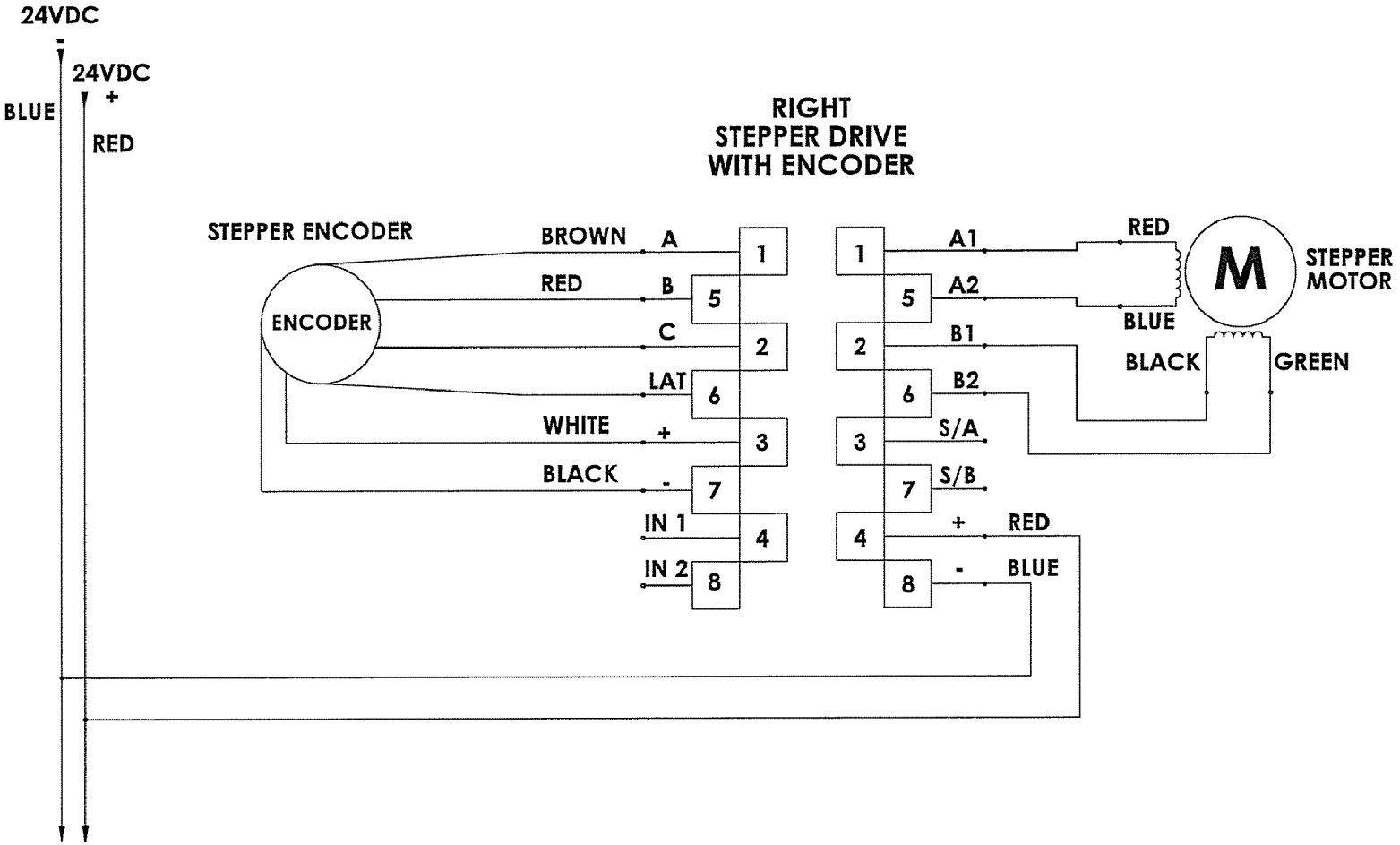
Figure 17I:
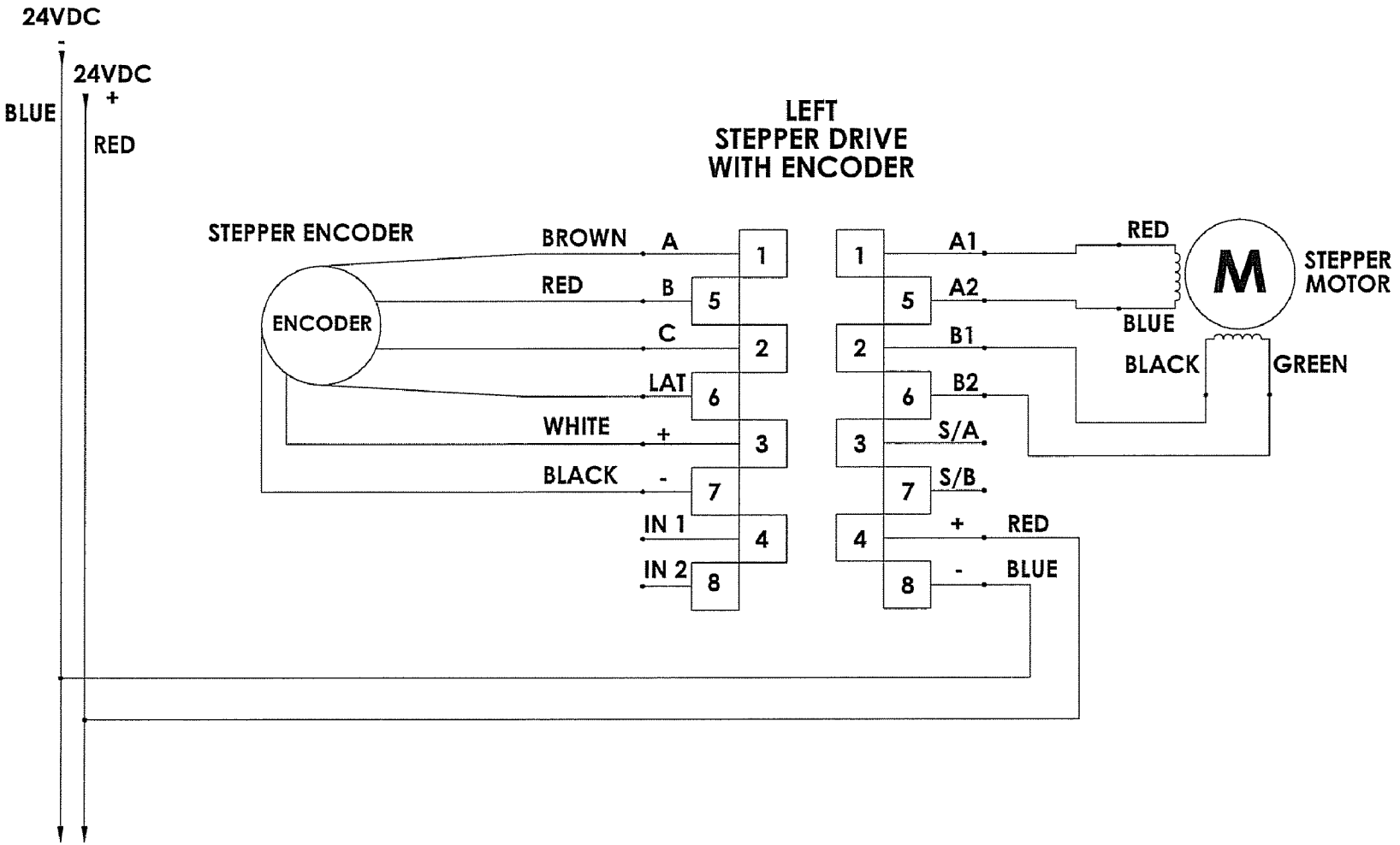
Figure 17J:
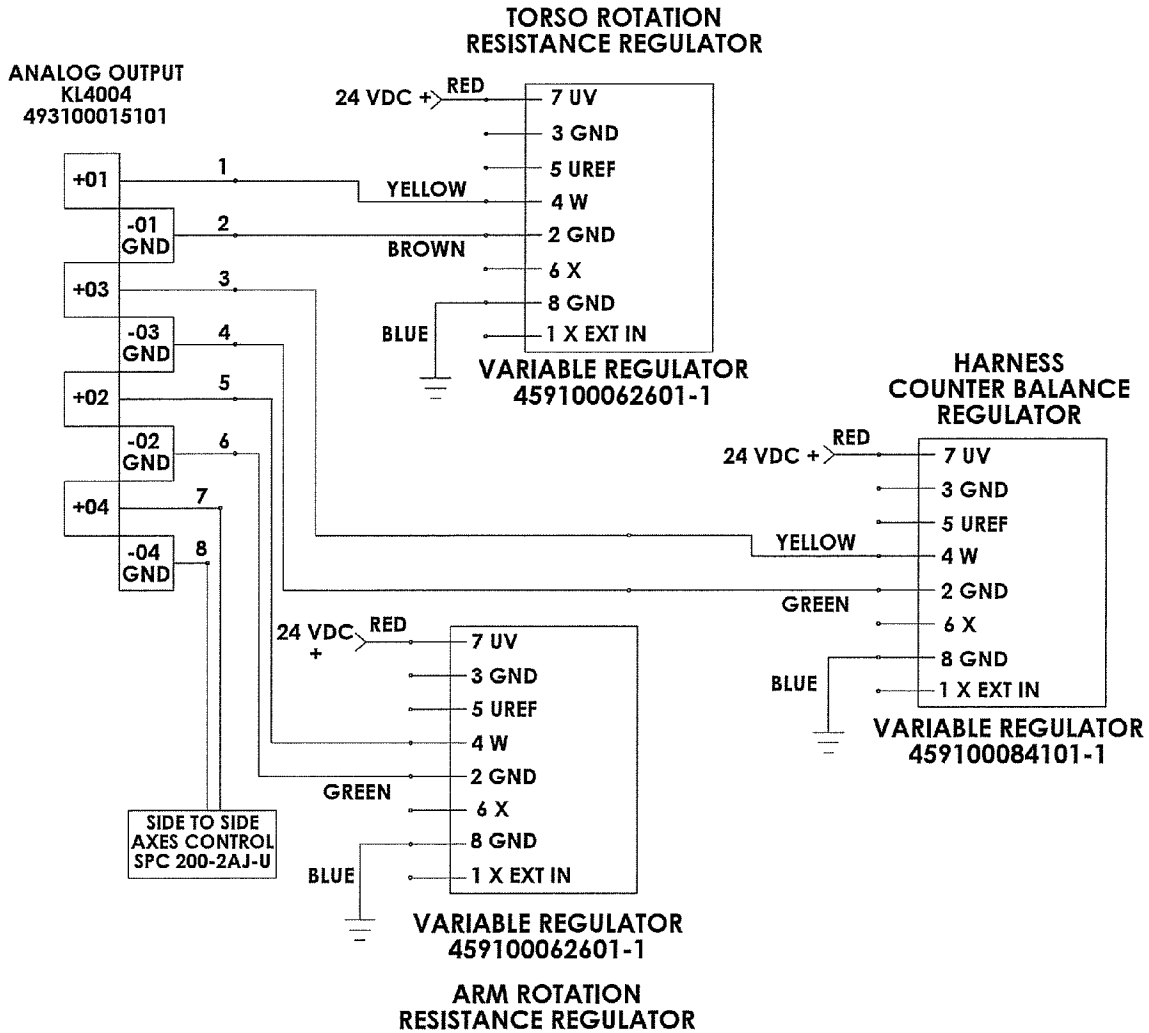
Figure 17K:
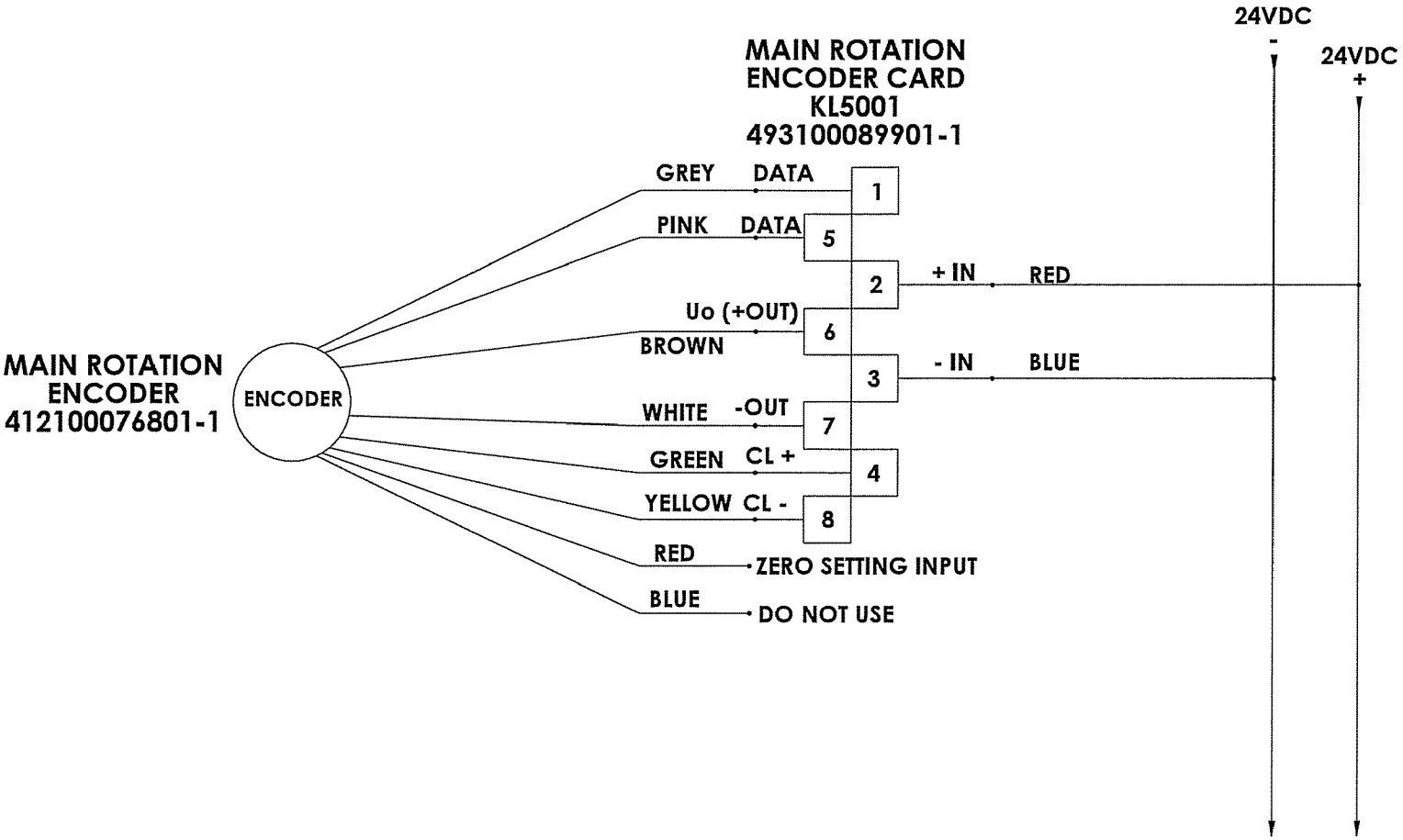
Figure 17M:
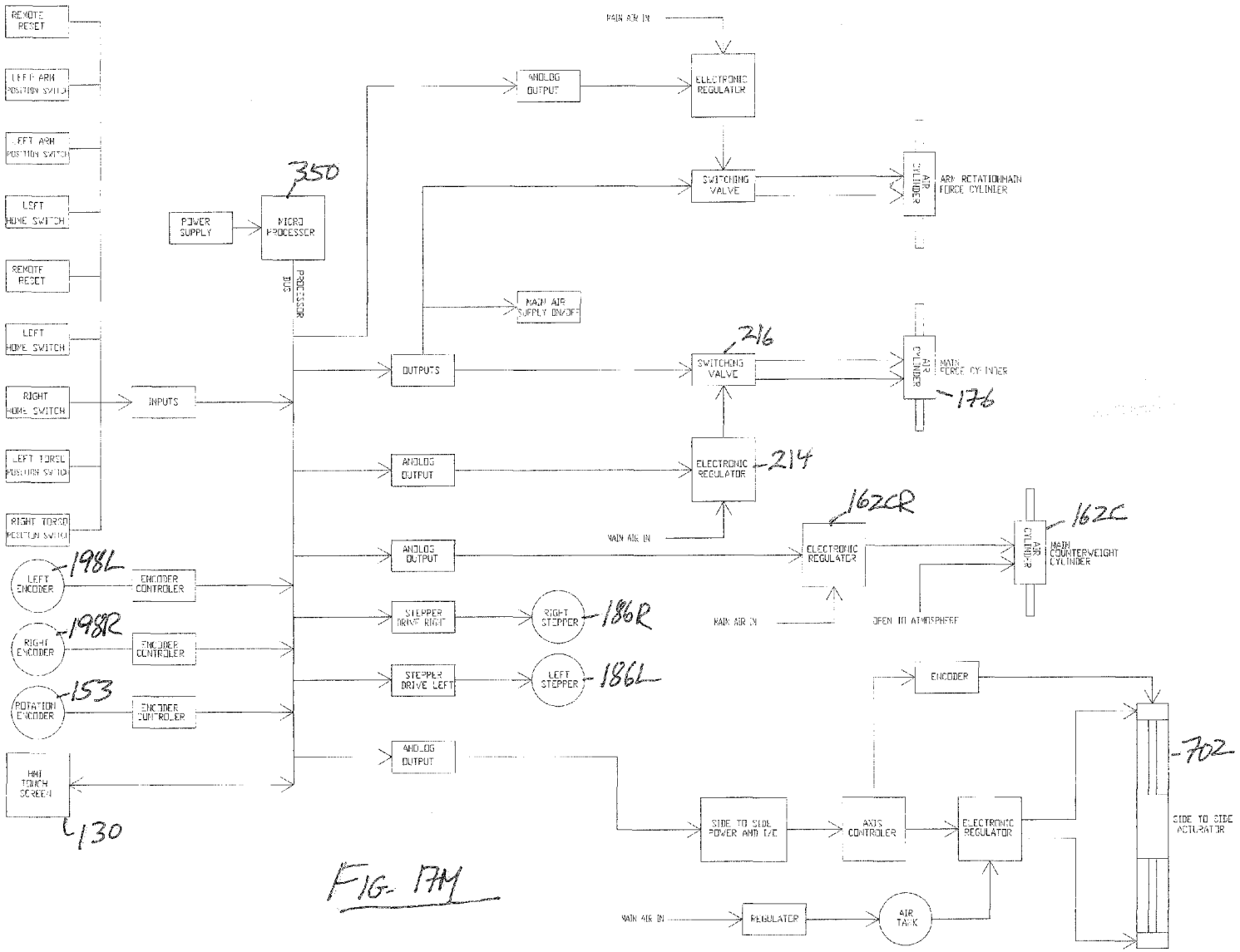

It is noted that the user's shoulders support the weight of the harness assembly 132. As shown in FIGS. 10 and 17M, to provide a counterweight relieving the user's shoulders from having to support the weight of the harness assembly 132 or to increase the weight of the harness assembly 132, a pneumatic cylinder 162C whose carrier is connected to the end of the vertical drive shaft 162, is supported by the rack assembly 152 and controlled by the computerized control 110C to exert a lifting force to the vertical drive shaft 162 sufficient to relieve all or some of the weight of the harness assembly 132 on the user's shoulders or to impart an additional downward force onto the harness assembly 132 to make it weigh heavier on the user's shoulders.

Figure 11A:
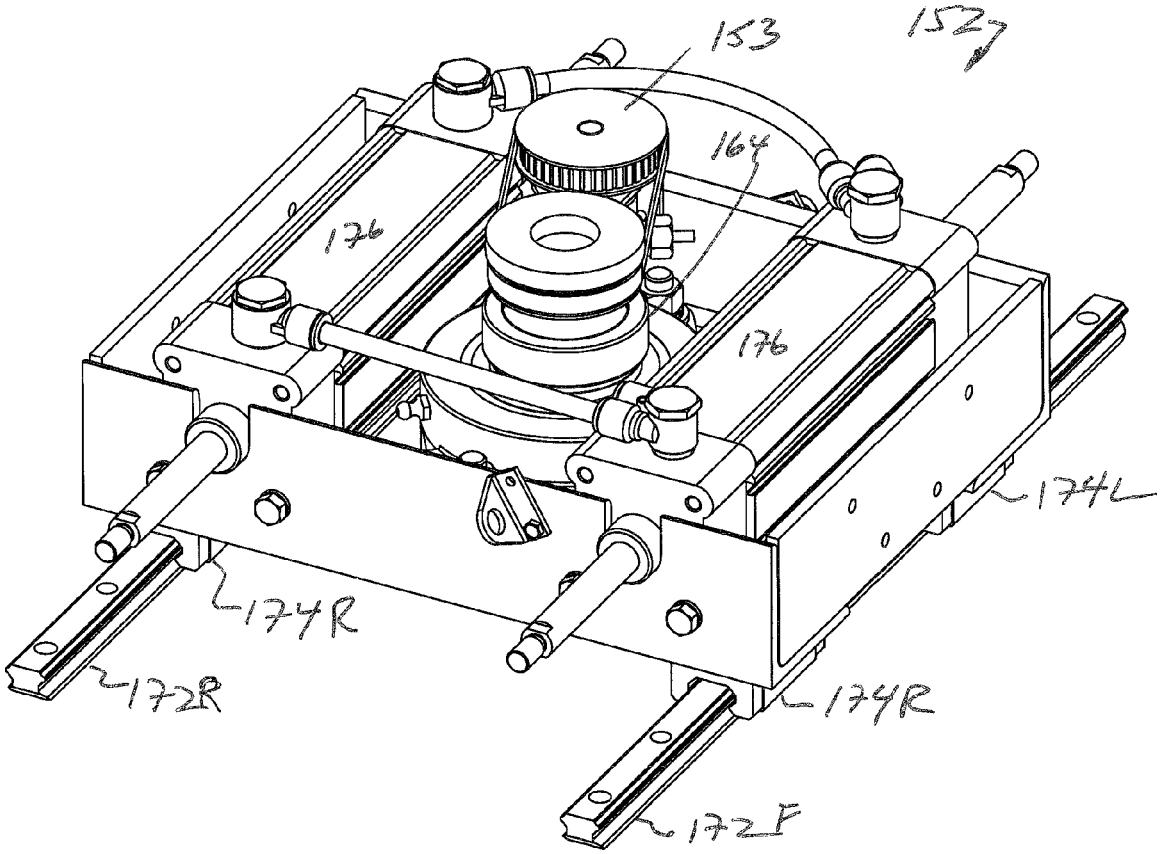
FIGS. 11A-11B illustrate the rack, assembly of the core-exercising embodiment of the present invention.
Figure 11B:
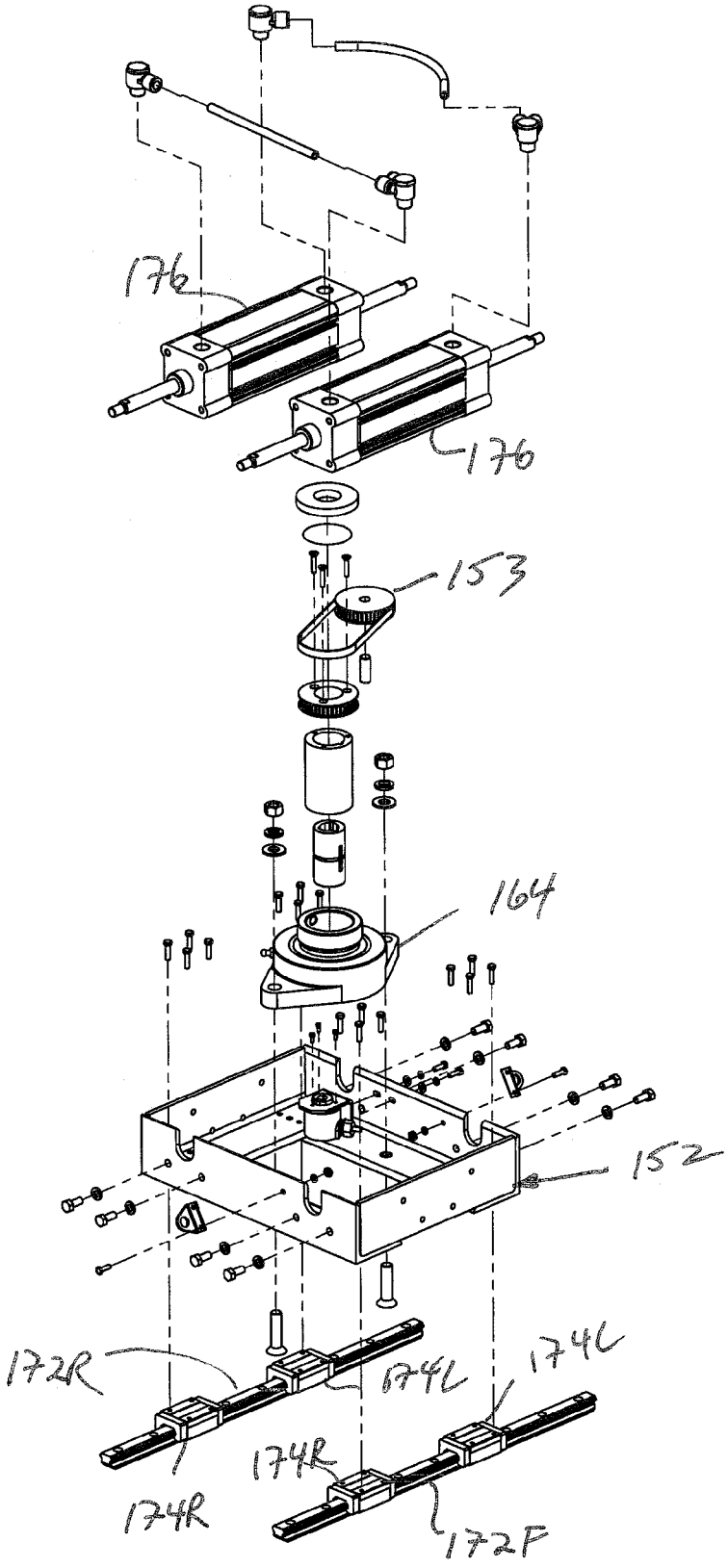

As shown in FIG. 11, the rack assembly 152 is mounted on opposing front and rear rails 172F and 172R by a pair of linear bearings 174 rigidly connected to the respective corners of the generally rectangular rack assembly 152. A pair of double-acting cylinders 176 is positioned on opposing sides of the bearing 164 to cause side-to-side movement of the rack assembly 152 along the rails 172. It is noted that preferably a pair of double-acting cylinders 176 are used in lieu of simply one cylinder to assure that there is more uniform movement along the rails 172. As more particularly described below in the fluid diagram of FIG. 13, the paired cylinders 176 are fluidly connected in parallel by conduits to act in unison.

Figure 12A:
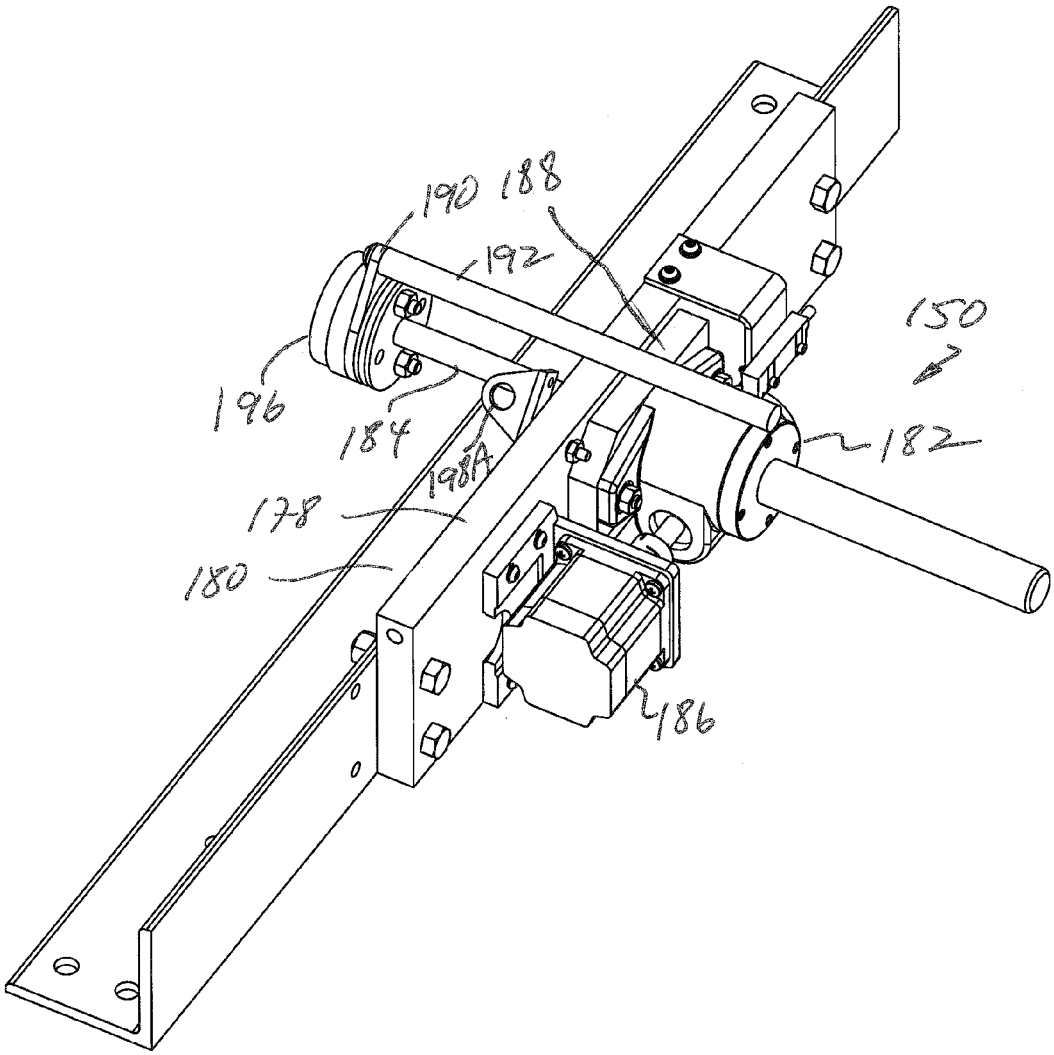
FIGS. 12A-12B illustrate the stop assemblies of the core-exercising embodiment of the present invention.
Figure 12B:
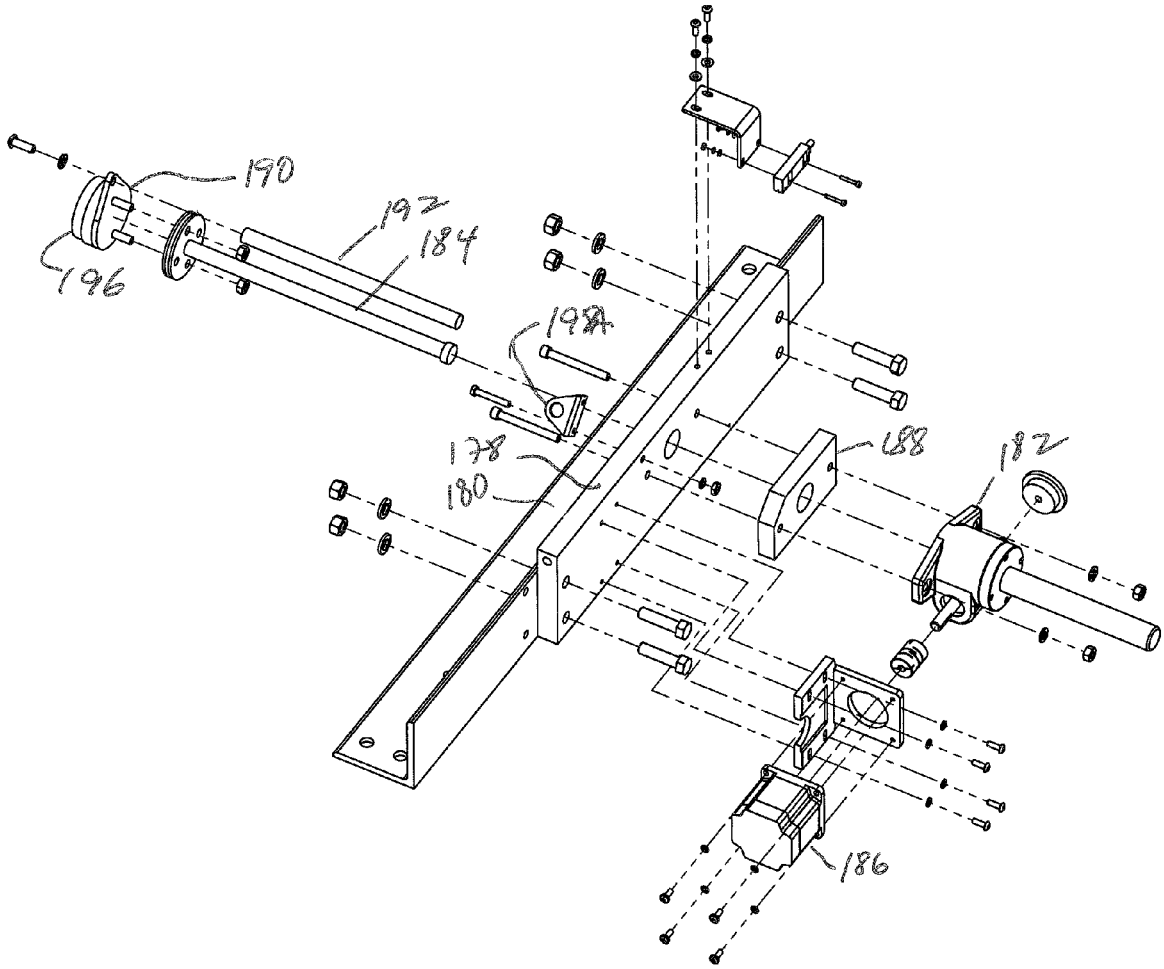

Referring to FIG. 12, each stop assembly 150 comprises a stop block 178 supported by frame member 180. A screw jack 182 is mounted over an opening in the stop block 178 to allow its center pusher shaft 184 to extend therethrough. A stepper motor 186 is mounted to the stop block 178 having its output shaft aligned with and coupled, via a coupler, to the drive shaft of the screw jack 182 such that upon rotational movement of the drive shaft of the stepper motor 186, the pusher shaft 184 of the screw jack 182 is caused to move outwardly or inwardly (a spacer 188 may be provided to assure proper alignment). The end of the pusher shaft 184 comprise a flange 190 to which is mounted an elongated stop 192. The elongated stop 194 rides above the stop block 178 to preclude rotational movement of the pusher shaft 184 during extension or contraction by the screw jack 182. A bumper assembly 196 may be mounted to the flange 190 to provide cushioning. Under computer control, the stepper motor 186 extends or retracts the pusher shaft 184 outwardly or inwardly to limit the length of travel of rack assembly 152 along the rails 172 and hence the angular rotation of the harness assembly 132. A sensor may be positioned to sense the actual position of the resistance/force assembly at it contacts its bumper assembly 196 to thereby sense left and right movement of the rack assembly 152. Another sensor may be provided to "zero" the fully retracted bumper assembly 196 to its "home" position during initial start-up or upon reset. A computer-controlled encoder 198A is provided for position monitoring and verification.

As noted above, the resistance/force assembly 148 is mounted within the upper compartment 126 and the length of lateral travel of the rack assembly 152 is limited to the length of its linear bearings 174 sliding on its rails 172. To effectively lengthen the lateral travel of the resistance/force assembly 148, the invention may additionally comprise a translational assembly 700 mounted within the upper compartment 126.

Referring to FIGS. 20A-20J, in lieu of mounting the resistance/force assembly 148 within the upper compartment 126, the resistance/force assembly 148 is mounted in the translational assembly 700 which is then mounted within the upper compartment 129.

More particularly, translational assembly 700 comprises a rodless linear pneumatic actuator 702 having a reciprocating carrier 704 that slides along a rail 706. The ends 702E of the actuator 702 are rigidly connected to the framework of the upper compartment 126. Translational assembly 700 further comprises linear bearing 703 that moves along a rail 708. The ends 708E of the rail are rigidly connected to the framework of the upper compartment 126 in a spaced-apart parallel relationship to the linear actuator 702 for receiving the resistance/force assembly 148 therebetween. The resistance/force assembly 148 is operatively connected to the translational assembly 700 by rigidly connecting one side of the resistance/force assembly 148 to the carrier 704 and the other side to the linear bearing 707. Thus, operation of the actuator 702 laterally moves the carrier, and hence the resistance/force assembly 148, from side to side. The lateral movement of the carrier 704 of the slide effectively increases the length of lateral travel of the resistance/force assembly 148. Moreover, operation of the actuator 702 may occur independently of the lateral movement of the resistance/force assembly 148 to vary the speed of lateral movement or, by working in opposite directions, compensating for the lateral movement of the resistance/force assembly 148 such that the harness assembly 132 does not move laterally.

FIG. 13 illustrates the air control assembly 200 that controls the reciprocating operation of the double acting cylinders 176 and hence provide angular resistance/force to the harness assembly 132. The air control assembly 200 comprises at least one air compressor 202 (preferably two) that supplies compressed air to a at least one air tank 204 (preferably two to accommodate condensation as described hereinafter), the output of the second tank 204 being controlled by a PSI switch 206. The air from the tanks 204 is filtered at 208 and controlled by on/off solenoid valve 209, and then provided to a slow start valve 210 to minimize air hammering. The on/off solenoid valve 209 may include a quick dump valve to allow immediate dumping of air pressure to atmosphere.

A servo regulator 214 and directional control valve 216 serve to control the direction of air flow into the double acting cylinders 176. Preferably, the servo regulator 214 comprises a proportional pressure regulator, model MPPES, and the proportional directional control valve 216, model MPYE, both sold under the trademark "Festo".

A timed electric quick dump valve 218 allows purging of condensate from the first tank 204. The purged condensate is piped to a spray head 220 mounted on a bracket 222 positioned within an electrically-resistive heated drip pan 224 (see FIG. 14 described below). Inlet and exhaust fans 226 draw airflow over the pan 224 at a rate sufficient to evaporate the condensate. It is noted that a deflector panel may be aligned with the spray head 220 to block any overspray and, doubly serving as a heat radiator itself, to increase the evaporation rate.

Figure 14A:
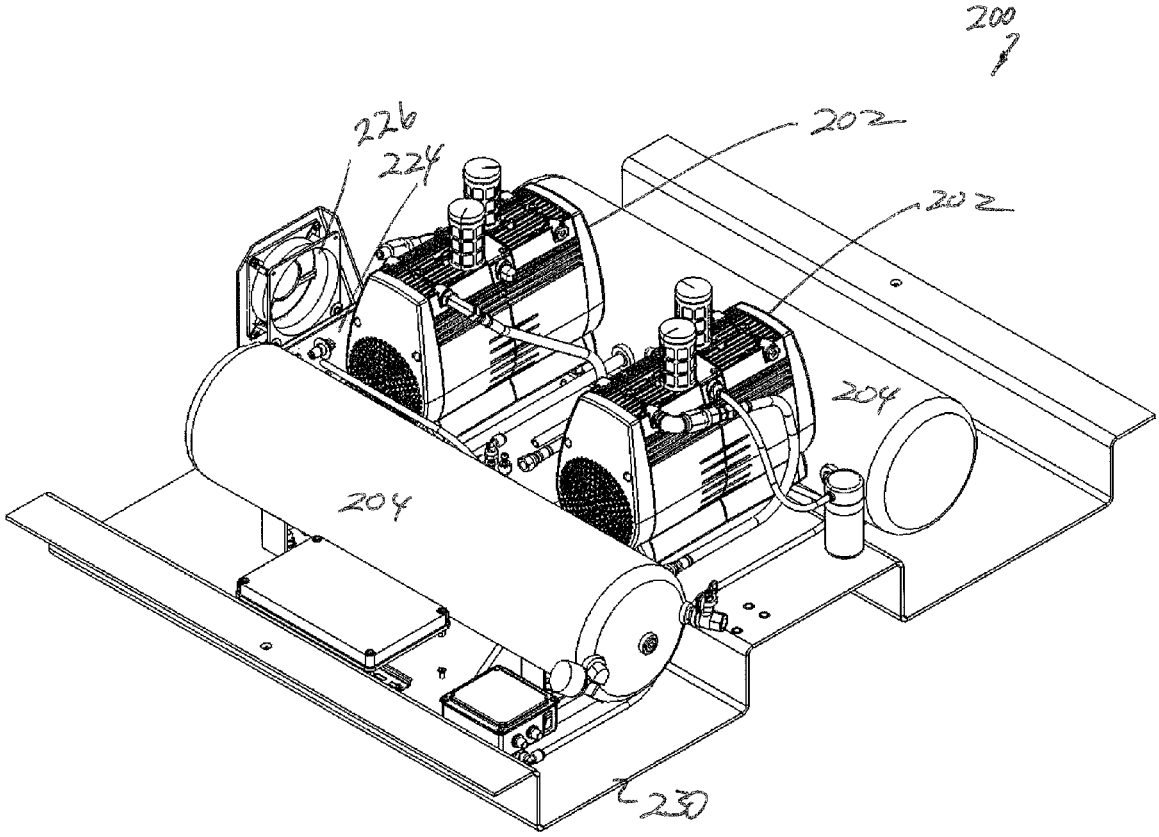
FIGS. 14A-14B illustrate the air control assembly of the core-exercising embodiment of the present invention.
Figure 14B:
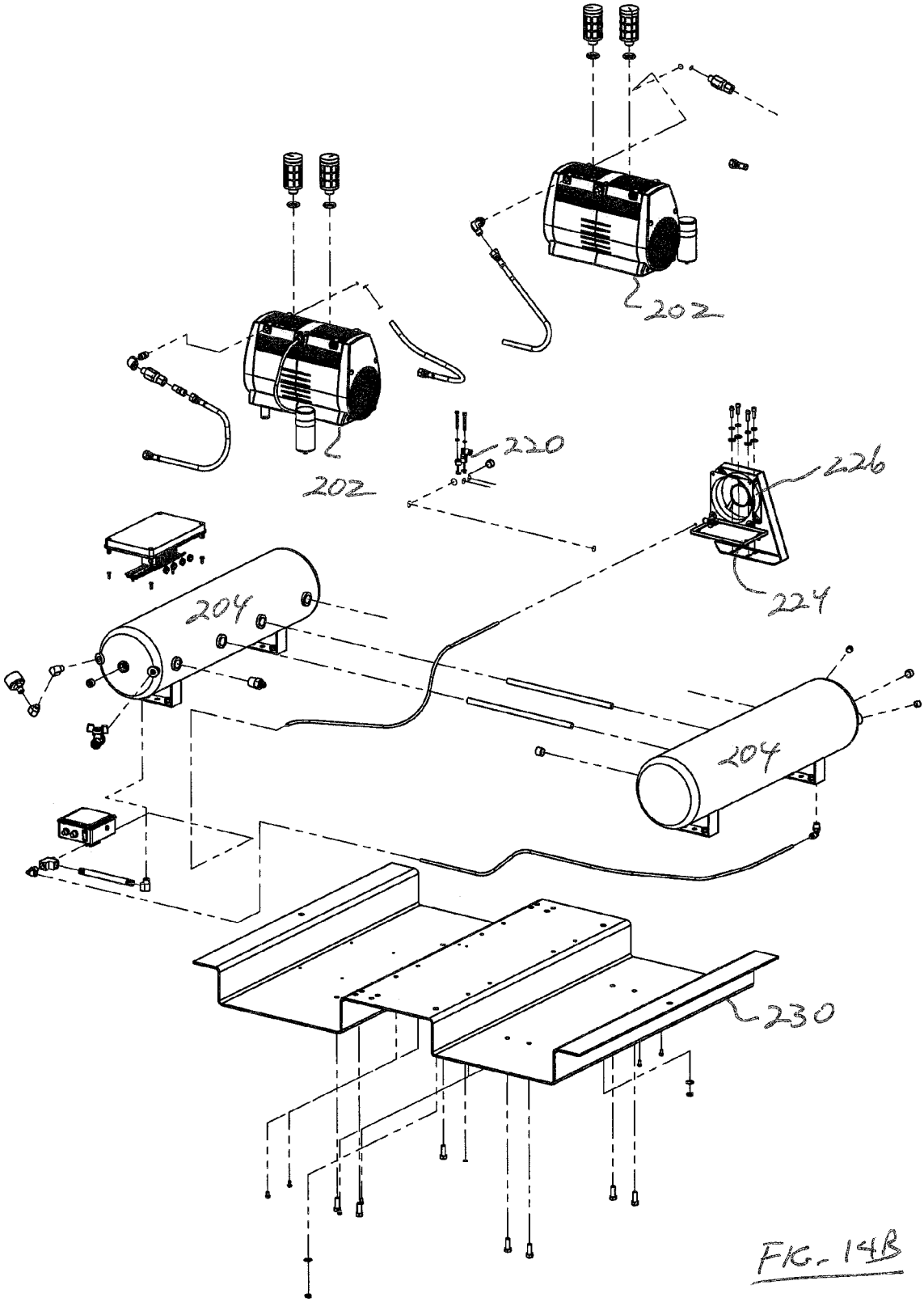

As shown in FIGS. 14A-14B, most of the components of the air control assembly 200, in particular the compressors 202, air tanks 204 and the quick dump valve 218/drip pan 224 are preferably mounted onto a removable base 230 and positioned within the lower compartment 124. The removability of the base 230 allows it to be removed, via quick disconnect fittings, when the exercising machine 110 is installed within a facility that already has a compressed air supply. As noted above, the air lines to the cylinders 176 may run in the upstanding supports 118 acting as raceways.

Returning to FIG. 7, the exercise pad 115 preferably comprises closed cell foam that enhances range of motion to exercise the toe muscles and connective tissues concentrically and eccentrically, in plantar flexion and dorsiflexcion. In addition, by virtue of lower leg rotation, the foam pad 115 allows the foot it deflect from the horizontal line of a fixed base which results in a broader range of ankle motion through ankle inversion (turning the sole of the foot inward) and eversion (turning the foot outward) as the lower leg rotates about the ankle joint. As more degrees of eversion take place, there is a pronation of the foot (outer sole turning upward). By virtue of the resistance at the ankle being introduced from the upper body, the intrinsic muscles and the extrinsic muscles of the feet are exercised simultaneously. The intrinsic muscles utilized include flexors (plantar flexors), extensors (dorsiflexors), abductors, and adductors of the toes. The primary extrinsic muscles of the feet which receive additional recruitment through the use of the foam pad 115 are the gastrocnemius, soleus, tibiolis posteriar, tibialis anteriar, peroneus brevis, peroneus longus, flexar hallucis longus, flexar digitorum longus and extensor hallucis longus. The preferred characteristics are reflected in FIG. 15 (Product Code MLC-2 being the most preferred, AHC the next most preferred and FBC being the next most preferred).

FIGS. 16A-16G illustrates the graphical user interface computer screens 110S presented to the user on the computer monitor 130 for the core exercising embodiment 11C.

Figure 16A:
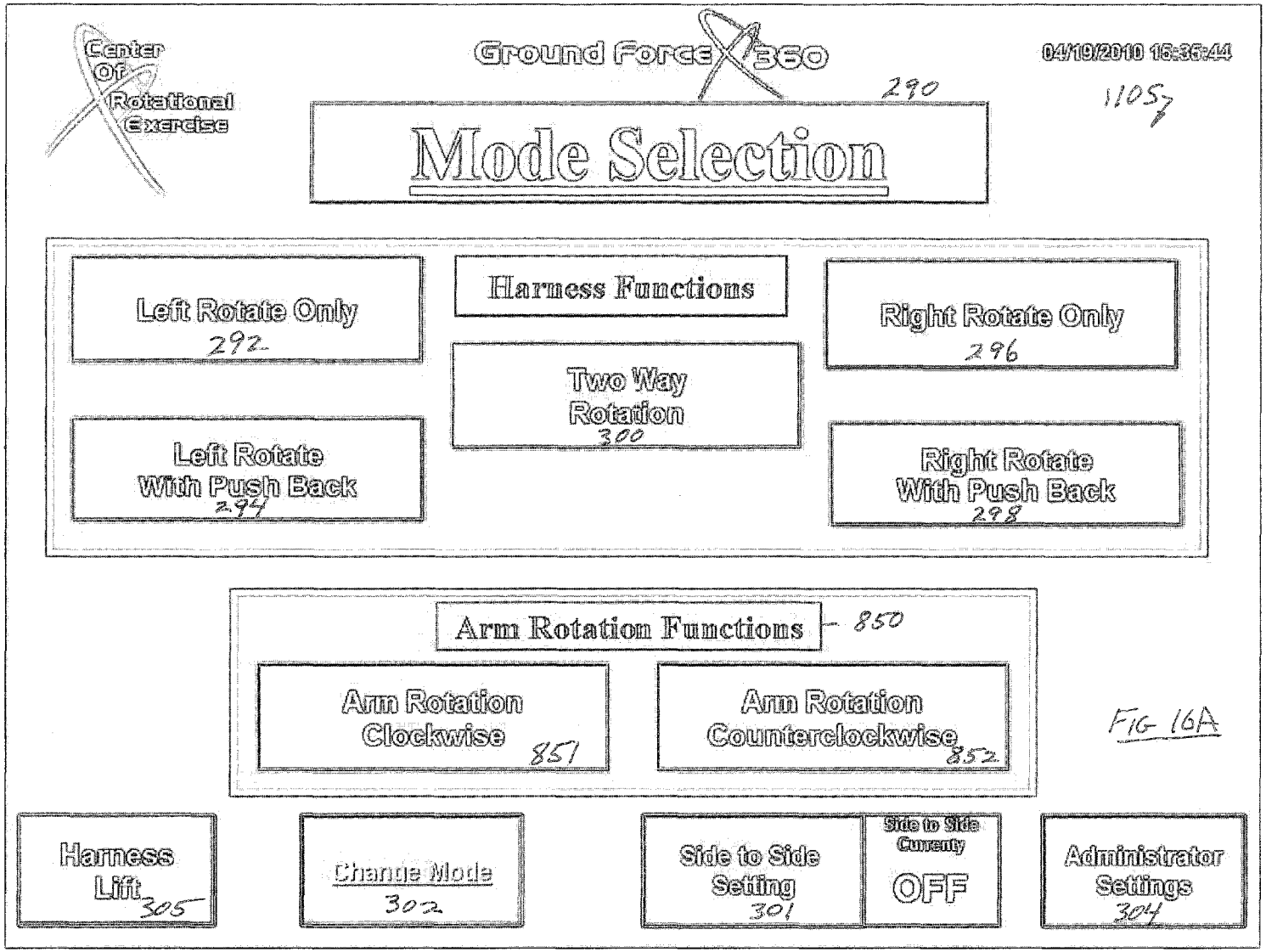
Figure 16A:
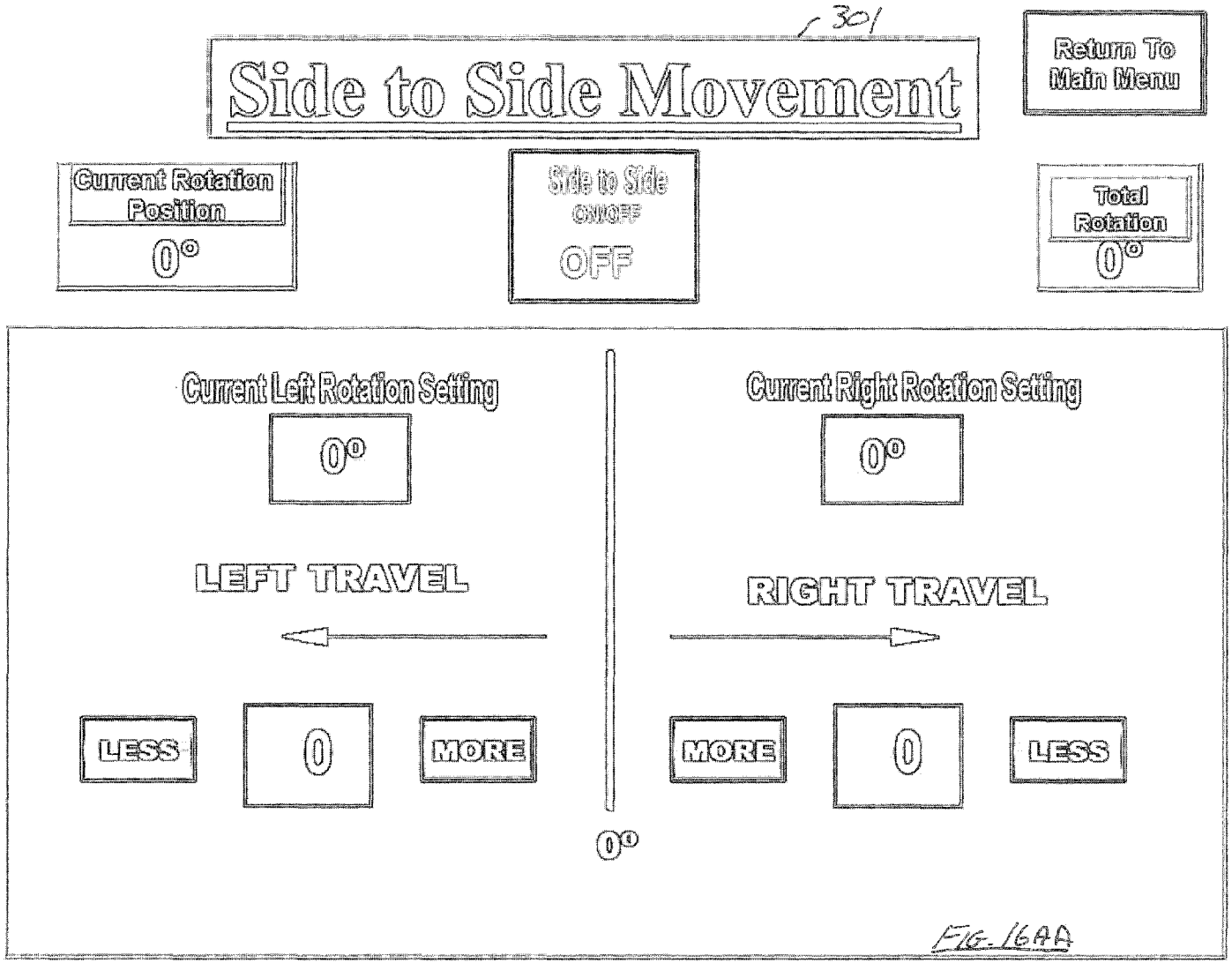
Figure 16B:
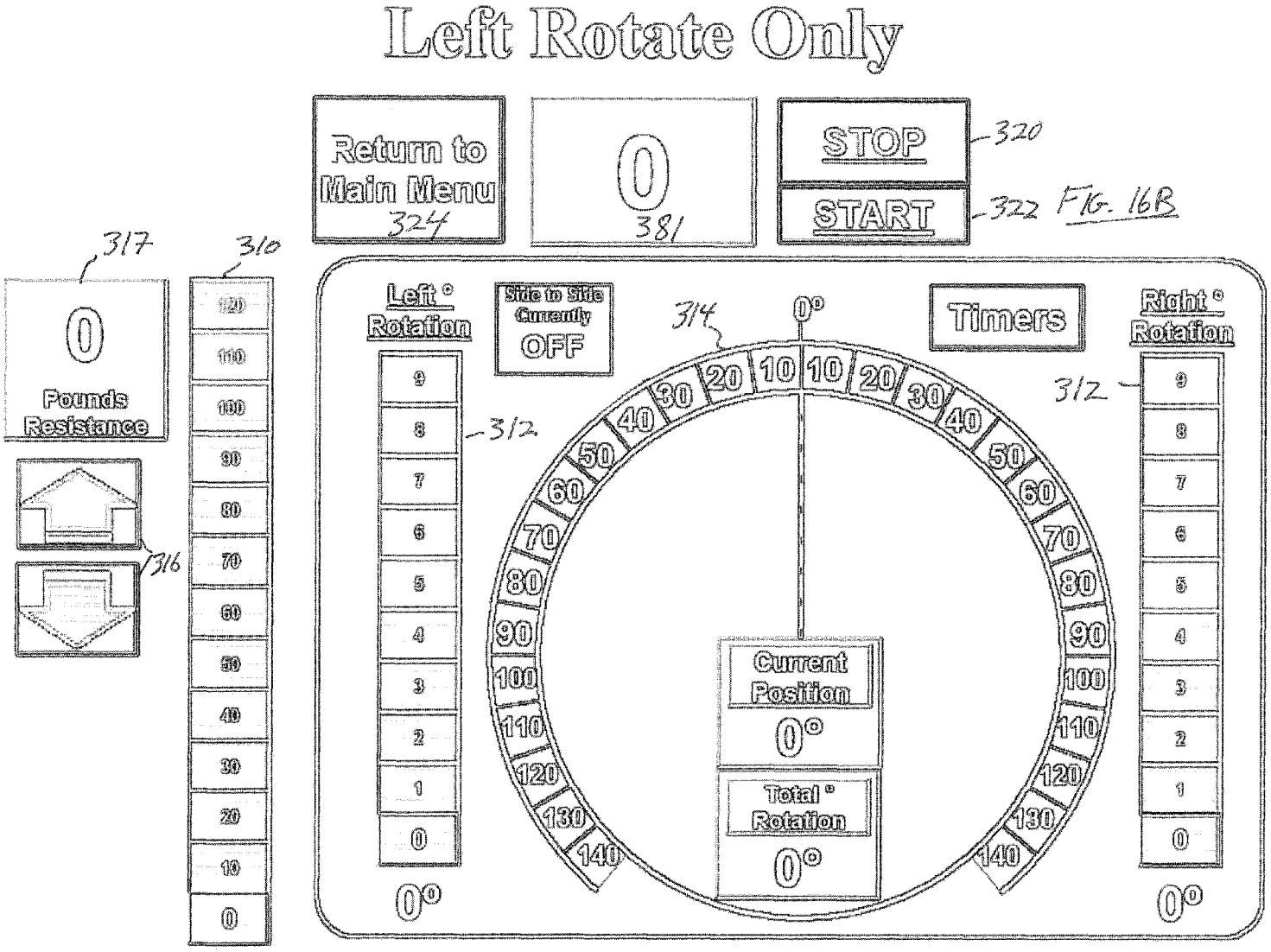
Figure 16C:
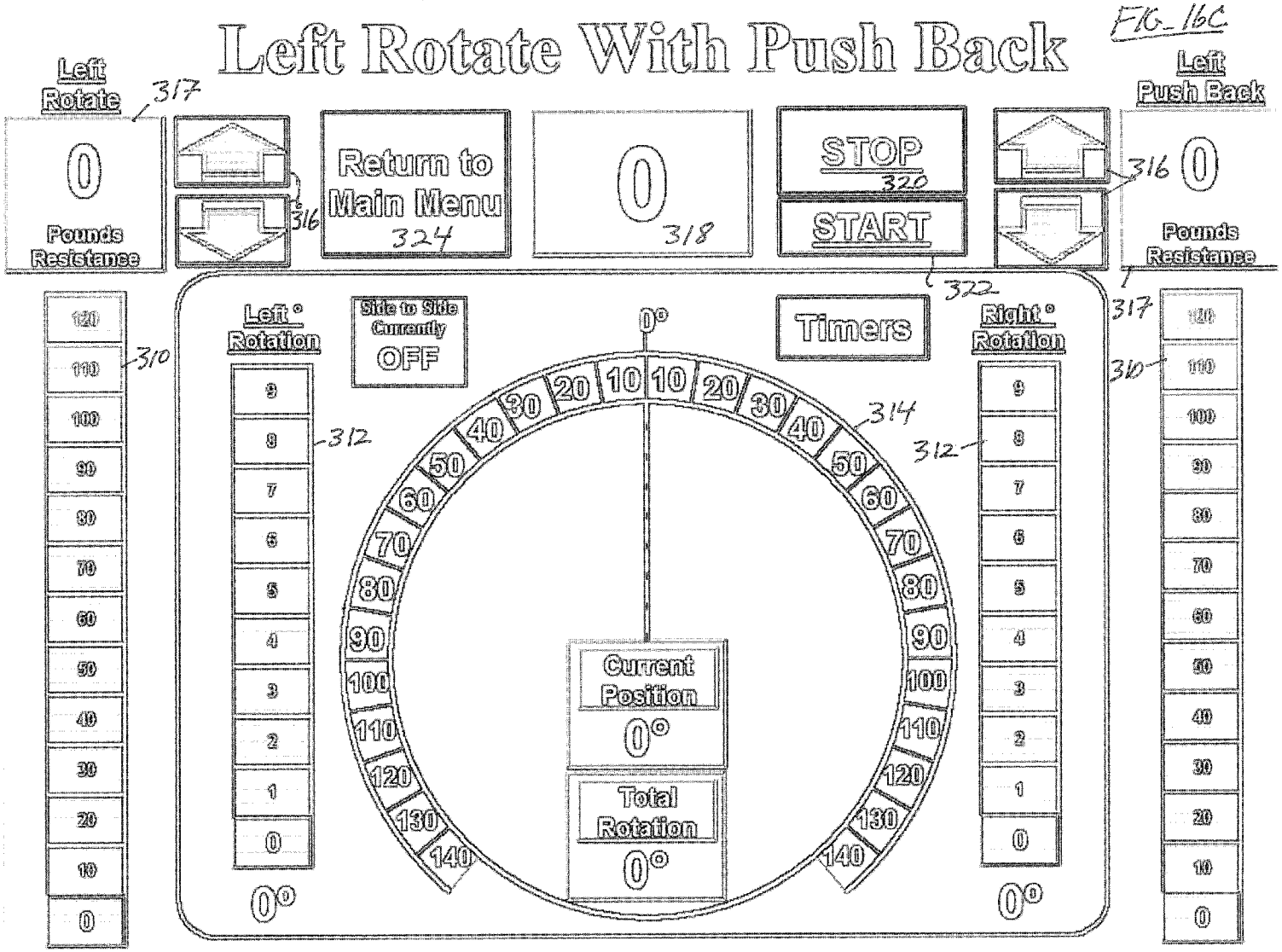
Figure 16D:
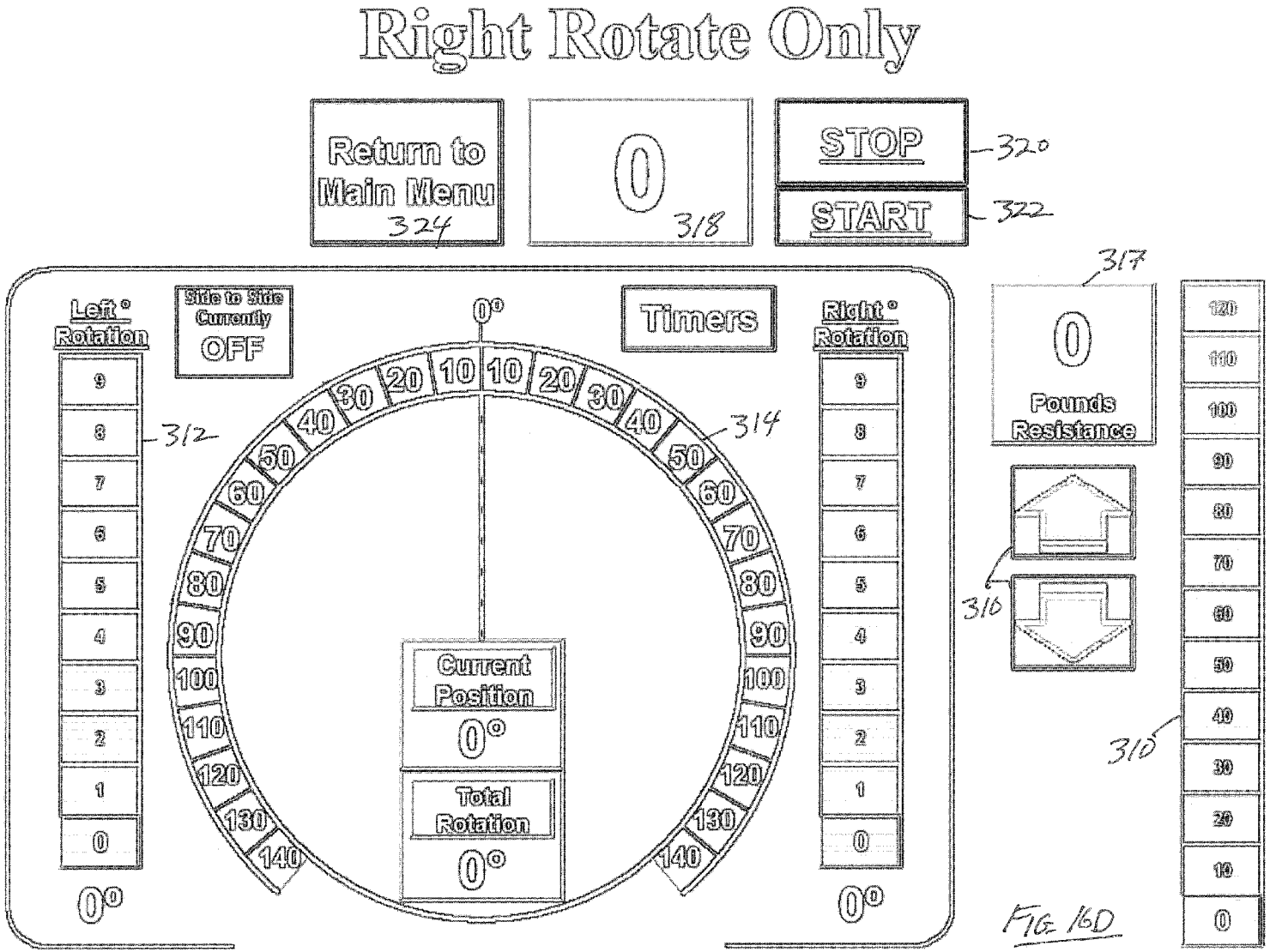
Figure 16E:
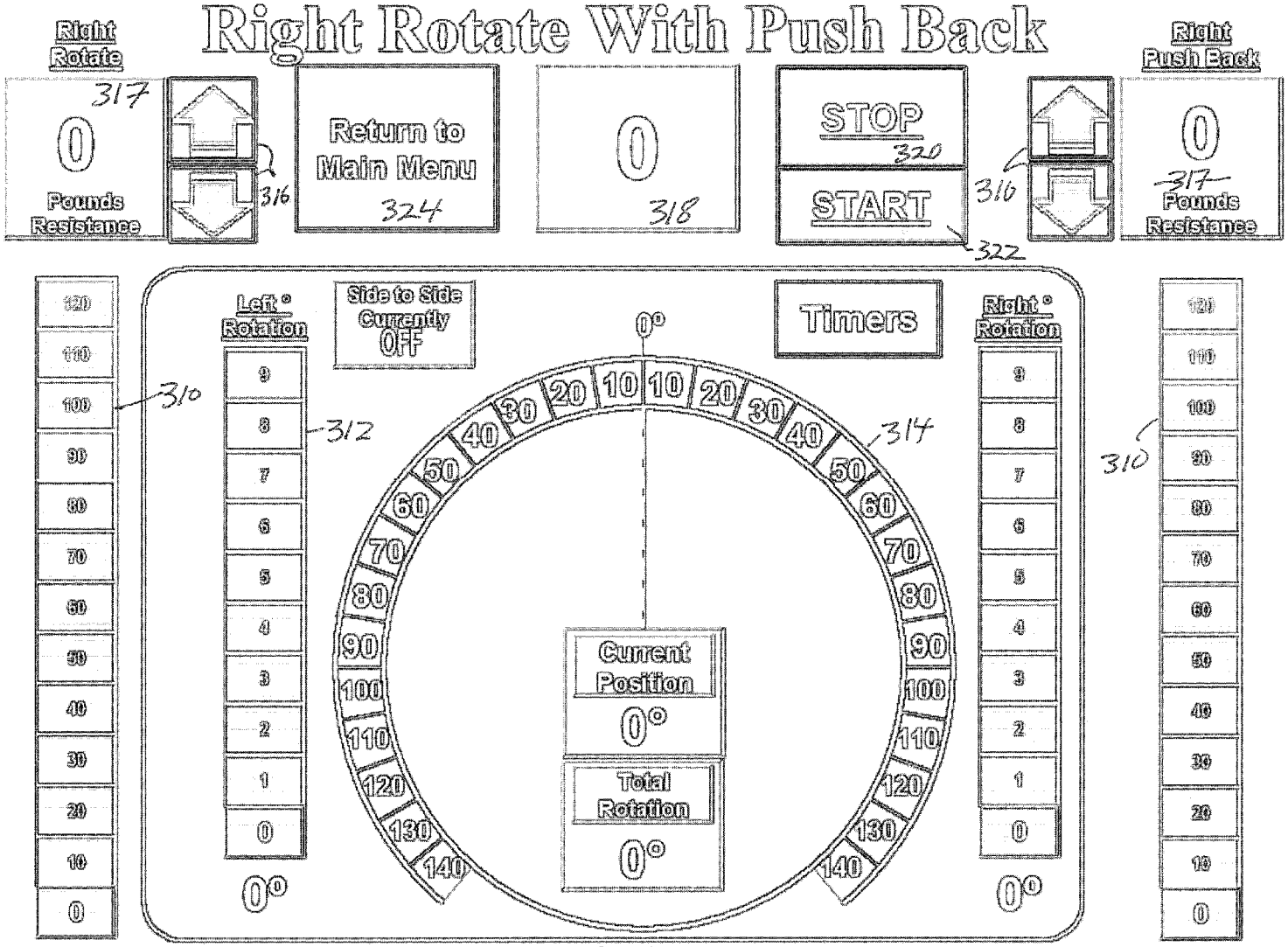
Figure 16F:
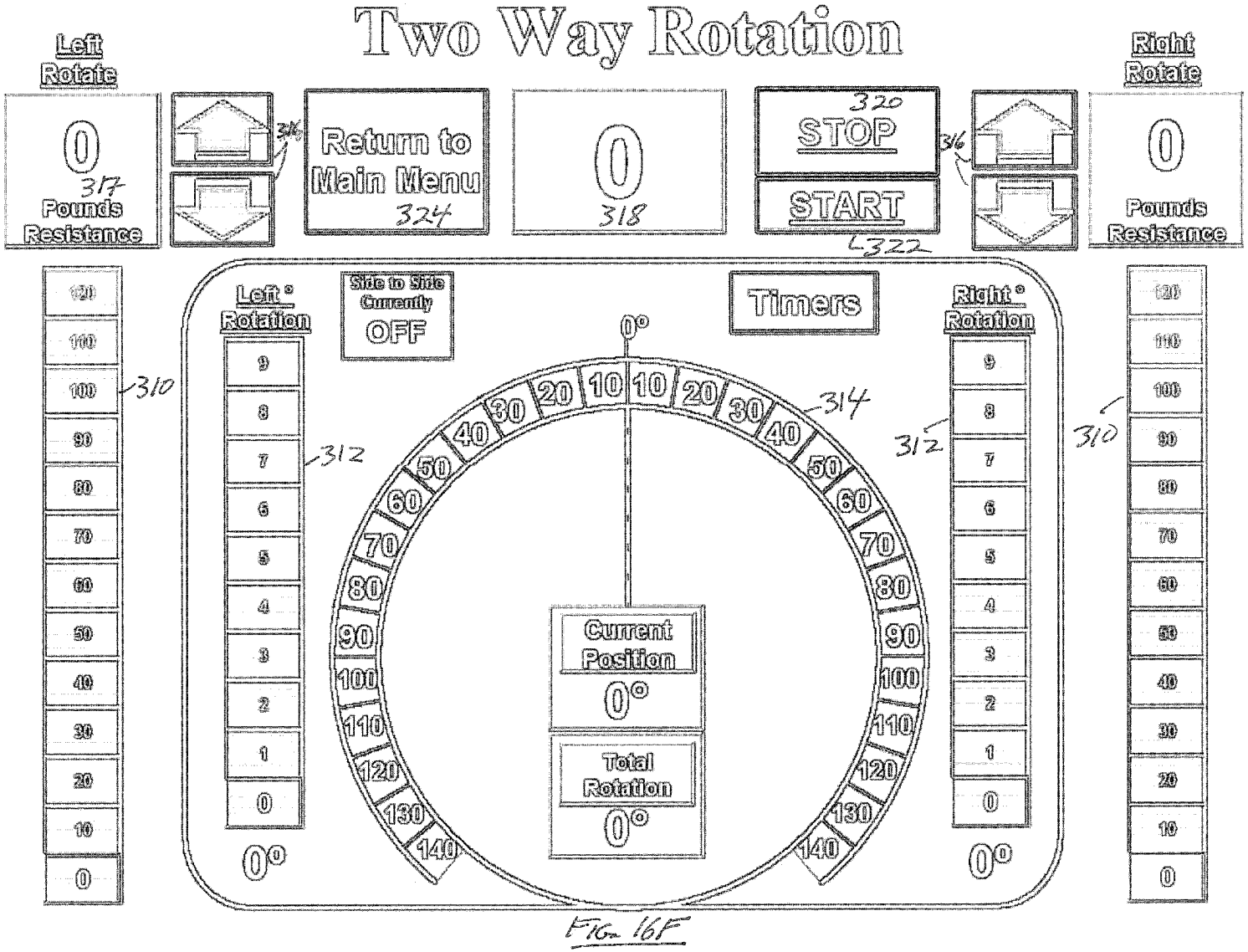

More particularly, referring to FIG. 16A, the main screen 290 comprises a graphical user interface having mode selection buttons representing left rotate only mode 292, left rotate with push back mode 294, right rotate only mode 296, right rotate with pushback mode 298 and two-way rotation mode 300 that displays their respective screens as shown in FIGS. 16B through 16F. A side-to-side setting 301 allows the length of the lateral travel of the translational assembly 700 to be selected. A timer/counter setting 303 allows timing of the workout. A harness lift setting 305 allows the user to select the weight of the harness. A change mode button 302 allows clearing of the modes. An administrator button 304 displays an administrator screen. An Arm Rotation Functions 850 including Arm Rotation Clockwise button 851 and Arm Rotation Counterclockwise button 852 that displays their respective screens shown in FIGS. 21D-21G discussed below.

Selection of the side-to-side setting button 301 presents the side-to-side screen of FIG. 16AA, which allows the length of the left and right lateral travel of the translational assembly 700 to be selected.

The layout of the screens of the respective modes of FIGS. 16B through 16F comprises a graduated two- or three-digit resistance column 310 and a graduated single digit resistance column 312 allowing the user to select the desired angular movement for each direction (e g., select the two (or three) digits 60 then select the single digit 5 for a total of 65 degrees) which is then angularly displayed in the center circle 314. It is noted that the two columns are employed due to the limited computing power of the microprocessor; however, if a more robust computer is employed, the two columns may be integrated or the circle may be made interactive allowing the angular movement to be "dragged" to the desired position. Up and down resistance buttons 316 allows selection of the desired resistance for each direction to be displayed via respective resistance windows 317. Push back force is likewise selected by the up and down force buttons 316 and be displayed via respective force windows 317. A counter window 318 displays the number of repetitions and a total rotation window 319. A stop button 320 resets the counter whereas a start button 322 allows the user to clear the selected angular and resistances and restart from the beginning. A return to home button 324 returns to the main screen 290.

Figure 16G:
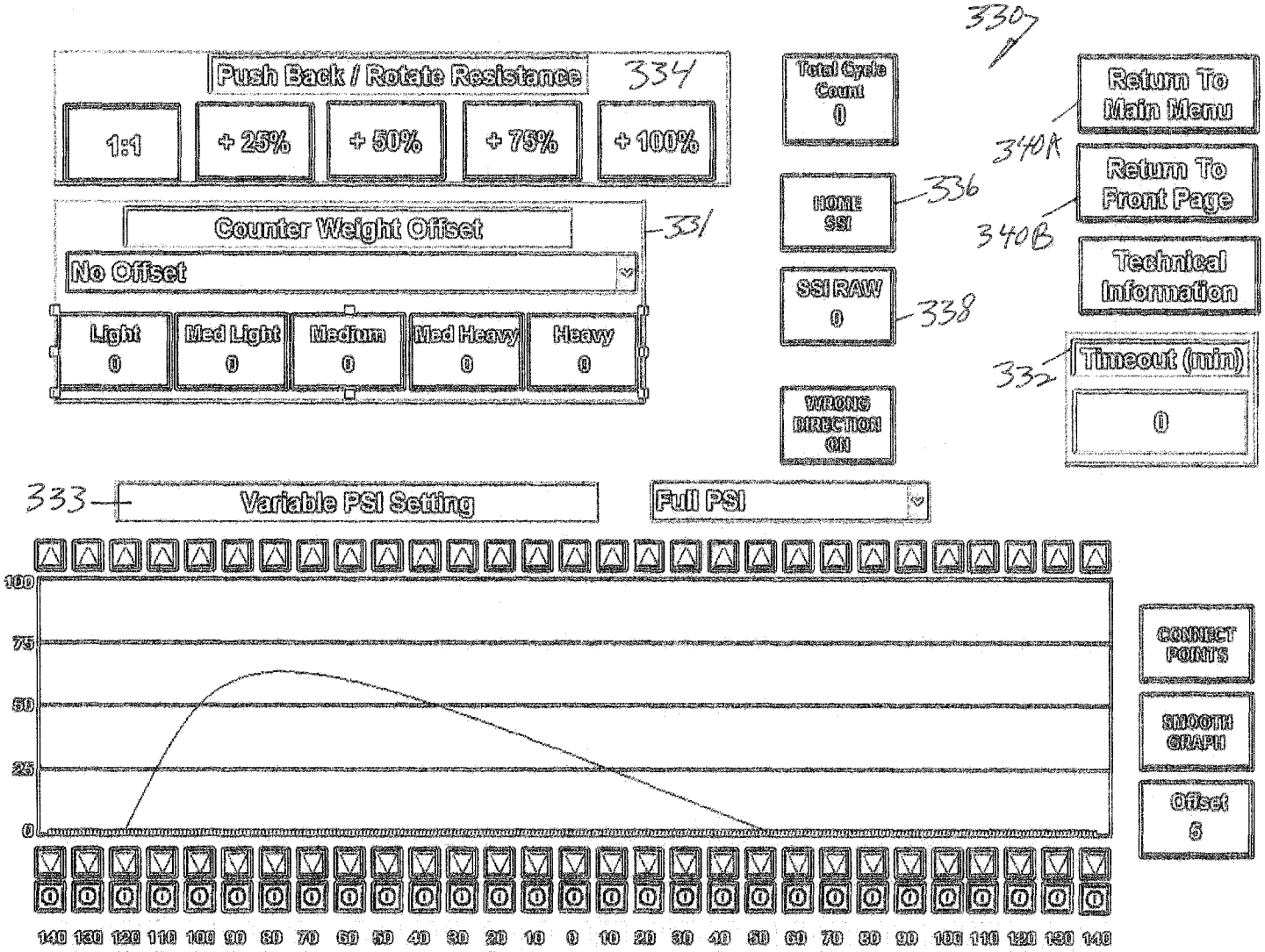

FIG. 16G illustrates the administrator screen 330. A time-out button 332 is displayed to adjust the time out period. The Counter Weight Offset buttons 331 allows adjustment of the weight of the harness felt by the user. The Variable PSI Setting sub-screen 333 graphically displays variable resistance throughout the distance of the stroke (e.g., see FIG. 6) and allows the user to adjust them upwardly or downwardly as desired. The push back/rotate pressure may be limited by buttons 334 to limit the push back pressure that may be selected by the user. Home SSI (synchronous-serial-interface) button 336 allows re-zeroing the SSI and SSI RAW button 338 allows zeroing the encoder. Return buttons 340A & B return to the Main Menu or Front Page, respectively.

Figure 16H:
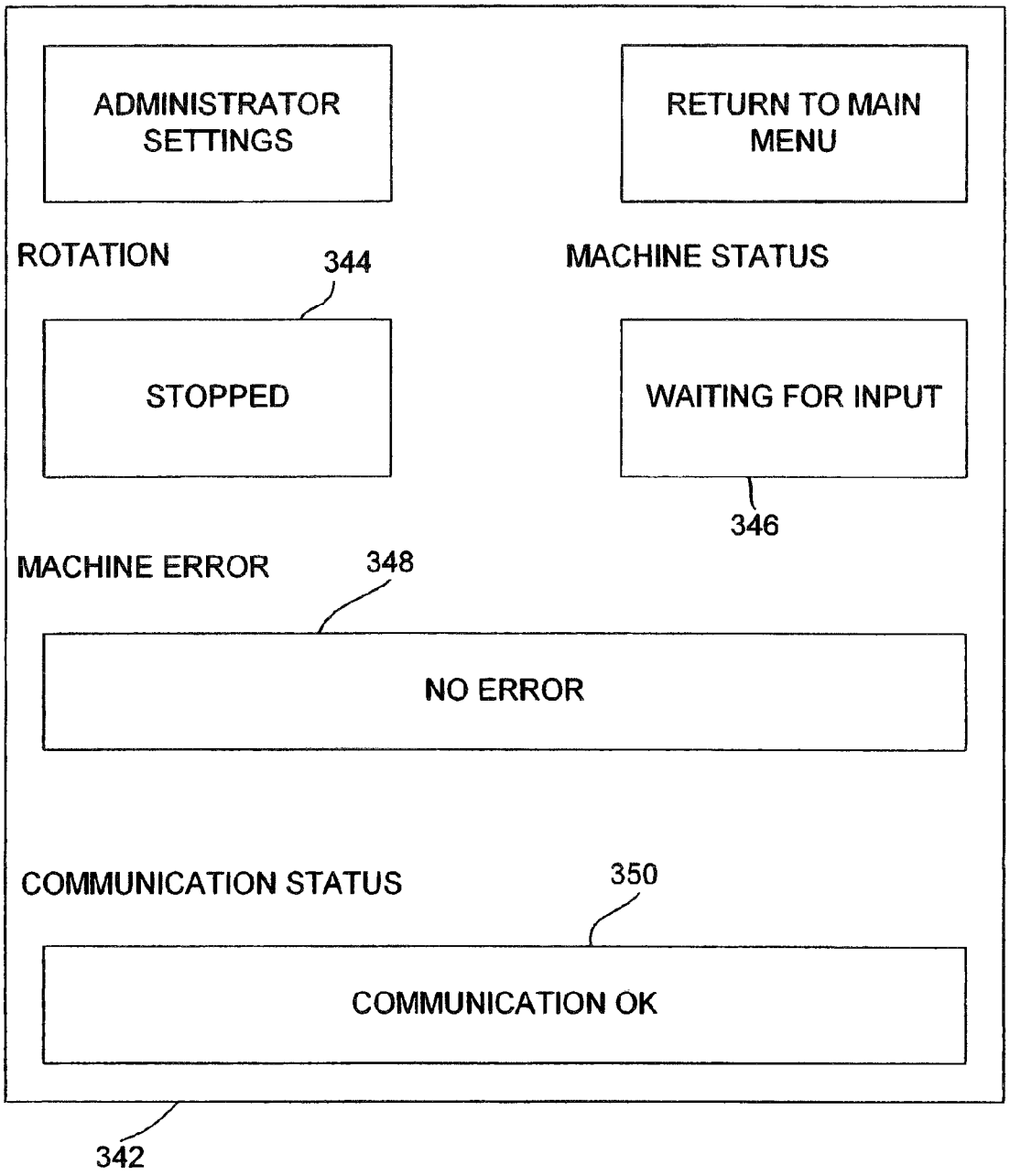
Figure 165:
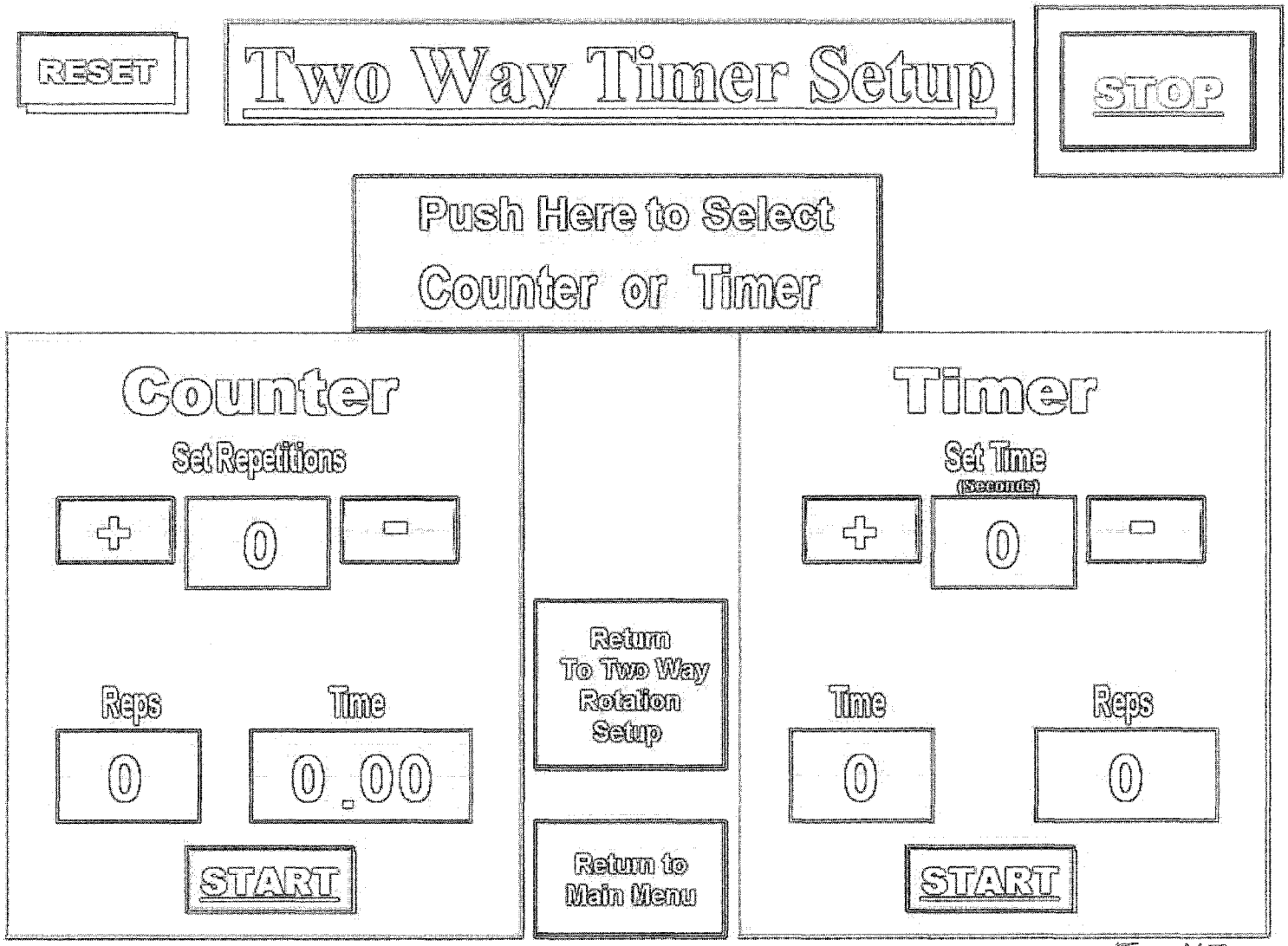
Figure 16K:
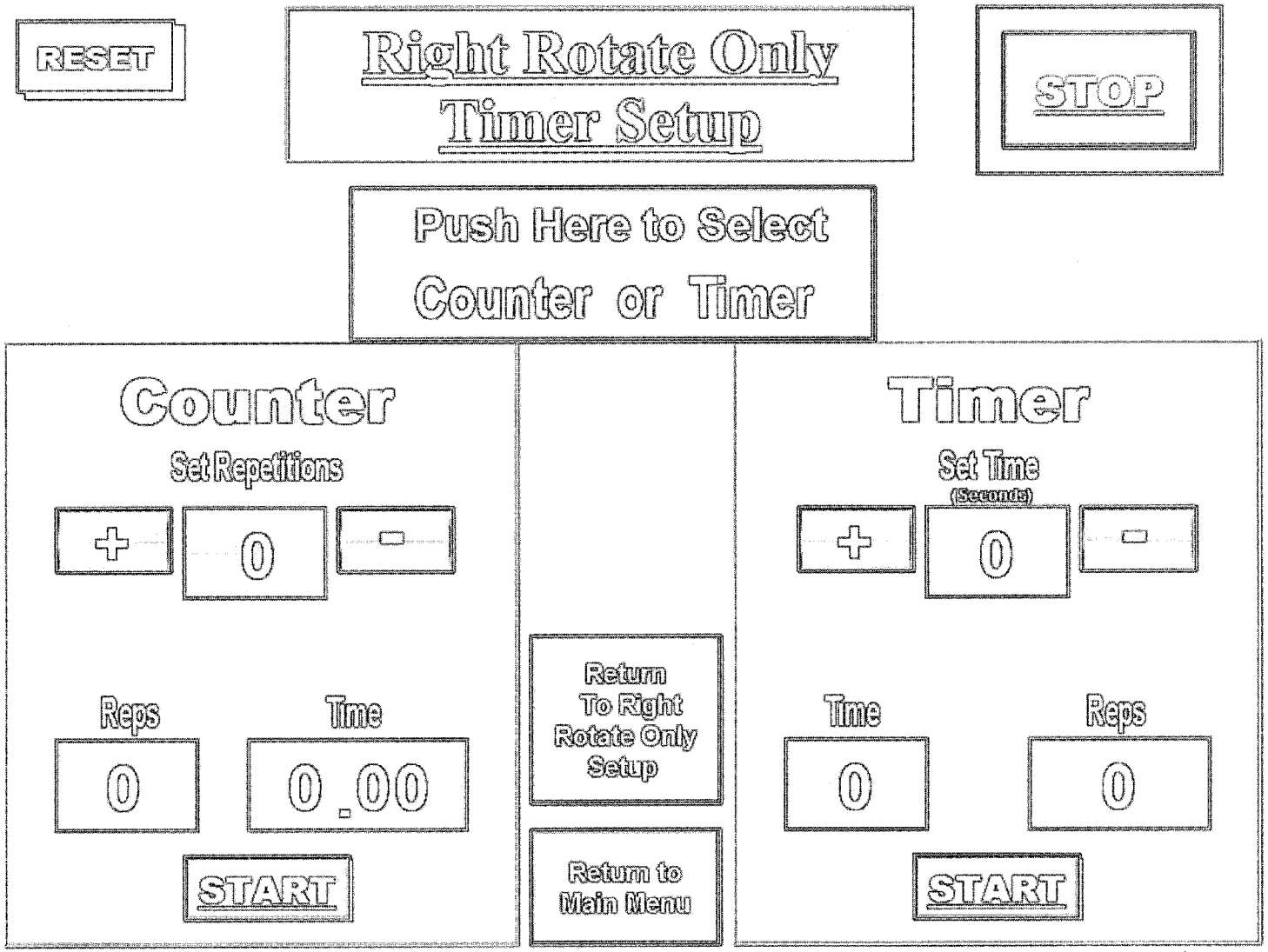
Figure 16L:
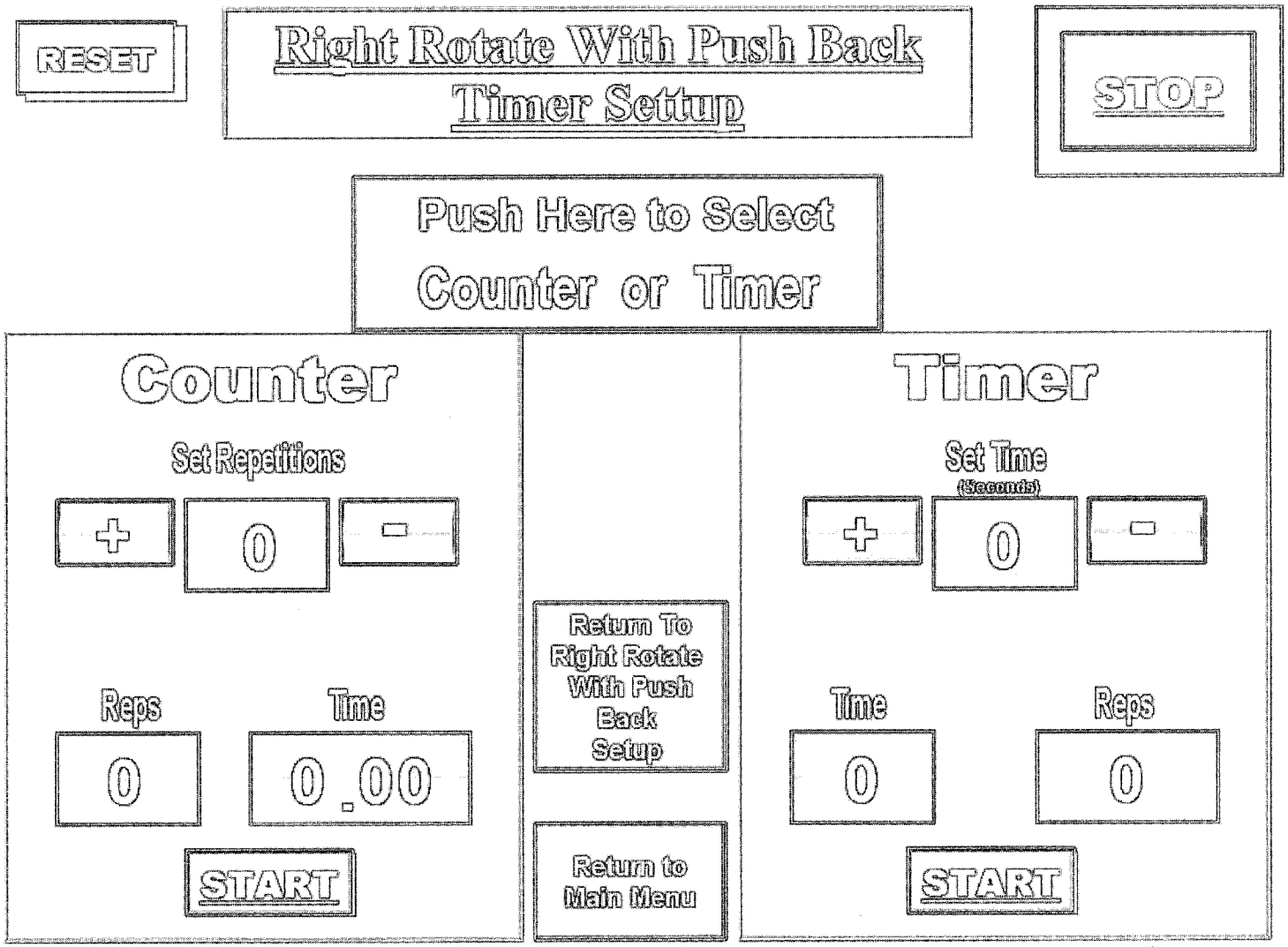
Figure 16M:
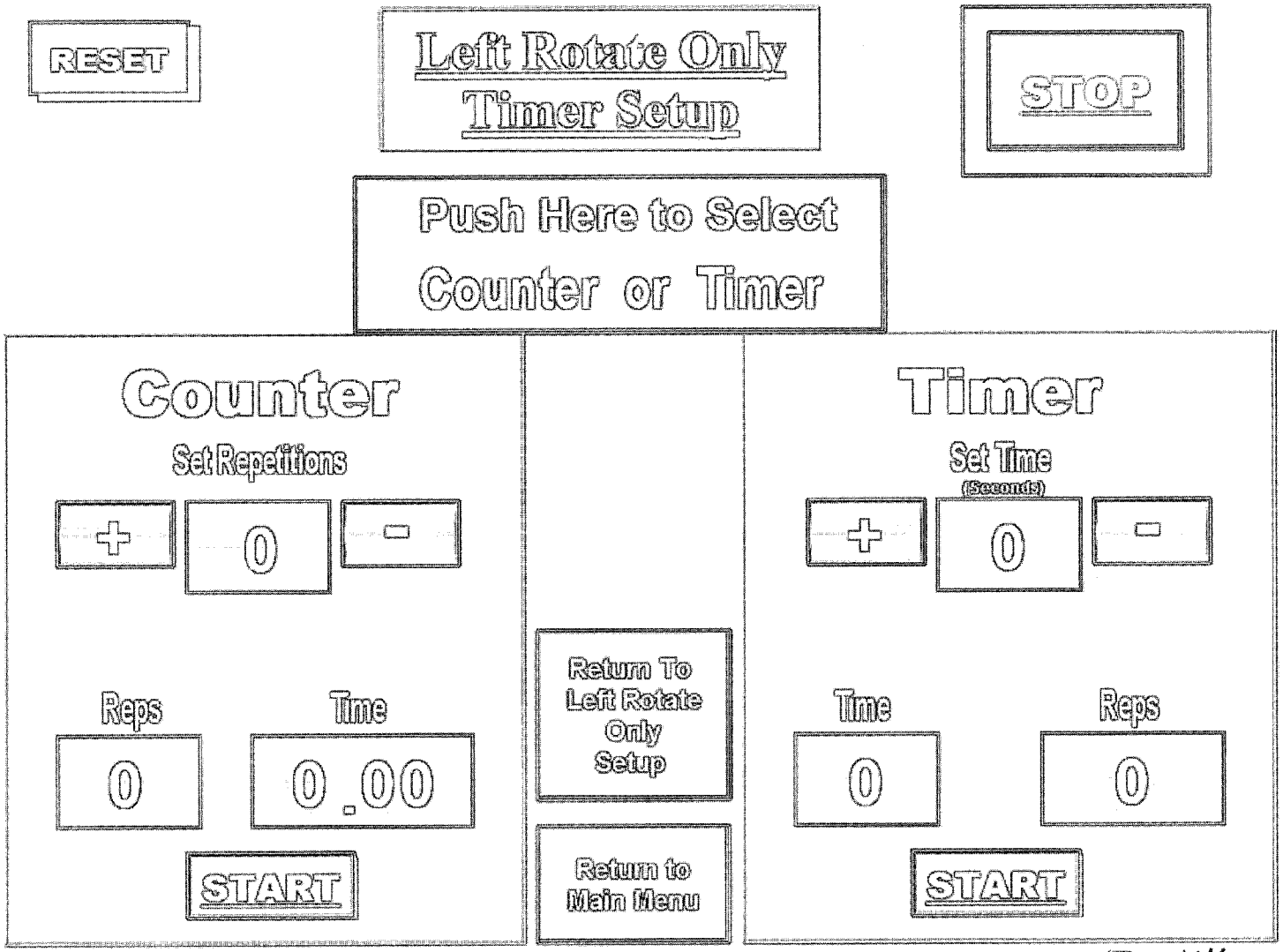
Figure 16N:
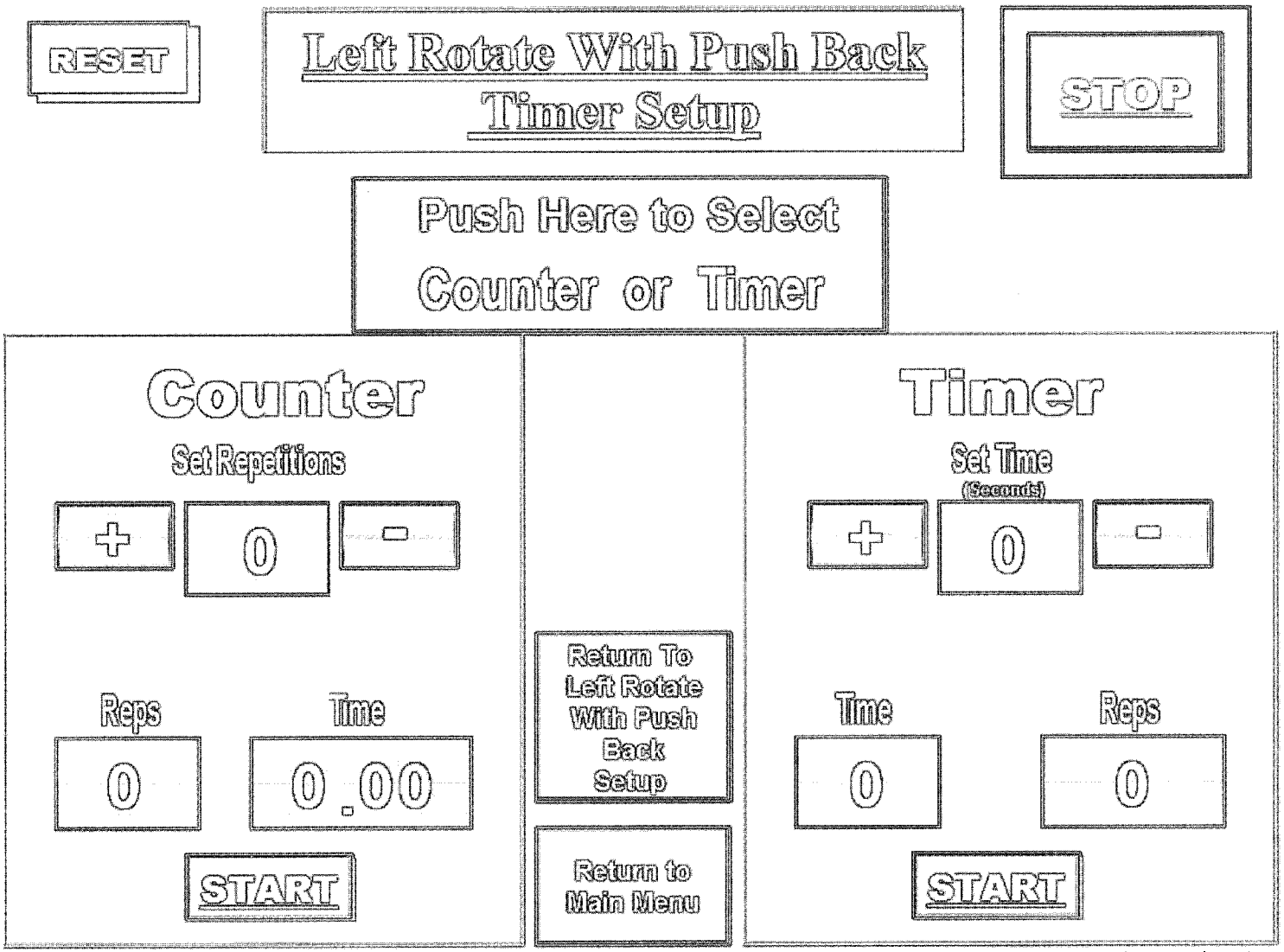

FIG. 16H illustrates the status screen 342 containing the rotation status 344, machine status 346, machine error status 348 and communication status 350 windows and a return button 352 to return to the home screen 290.

FIGS. 16J-N illustrate the Timer/Counter Setup screens that allows the user to select the workout to be based upon the number of repetitions (e.g., how fast can the user do 10 reps?) or based upon time (e.g., how many reps can the user do in 10 seconds?) for two-way exercising, right only exercising (and with push-back) and left only exercising (and with push-back).

FIGS. 17A-L illustrate the electrical wiring for powering the system. FIG. 17M shows schematically the interface of the computer 350 on which a computer program rims with the various components of the exercising machine 110C.

Arm Rotation Embodiment

Figure 13A:
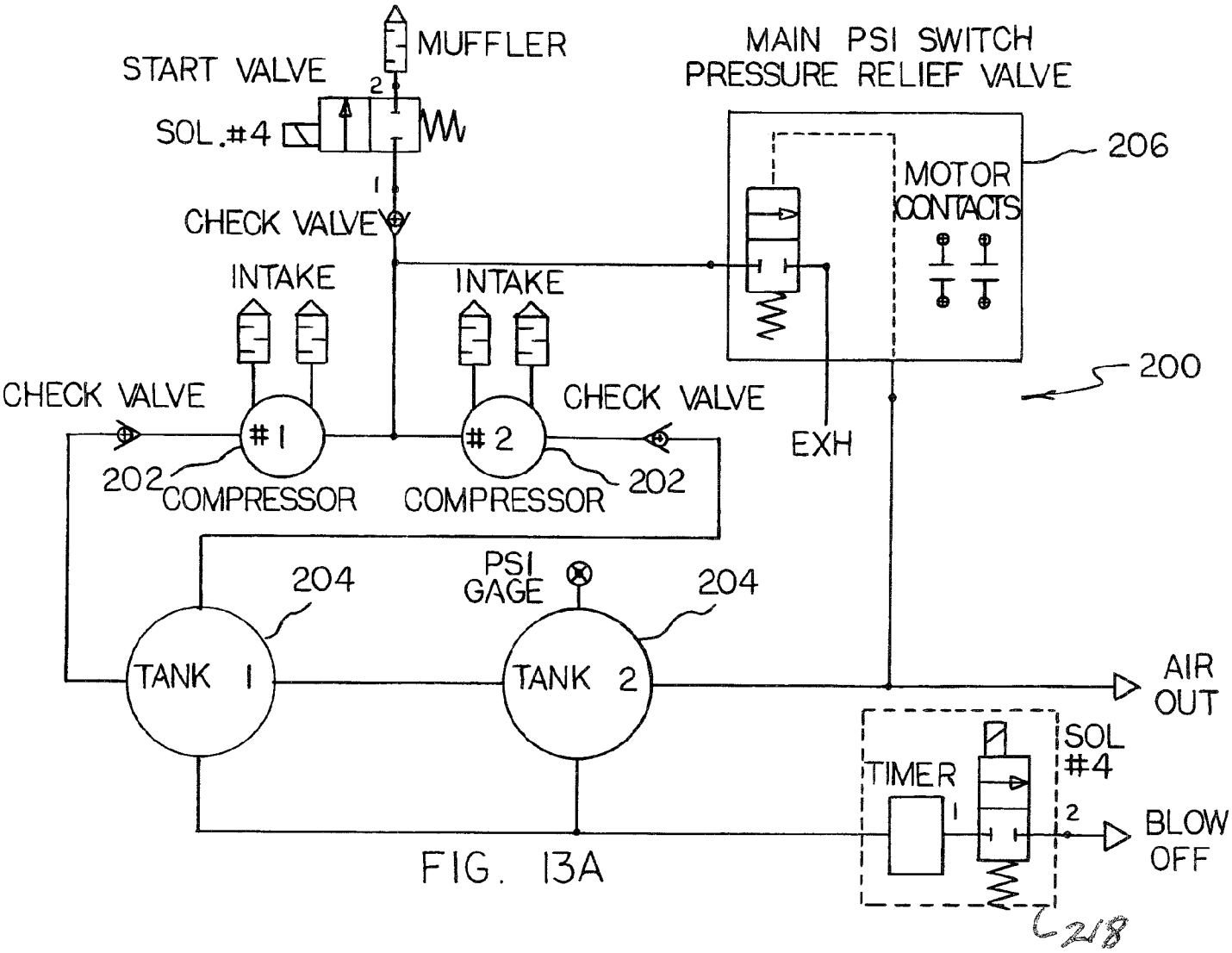
FIGS. 13A-13D illustrate the pneumatics of the core-exercising embodiment of the present invention.
Figure 13B:
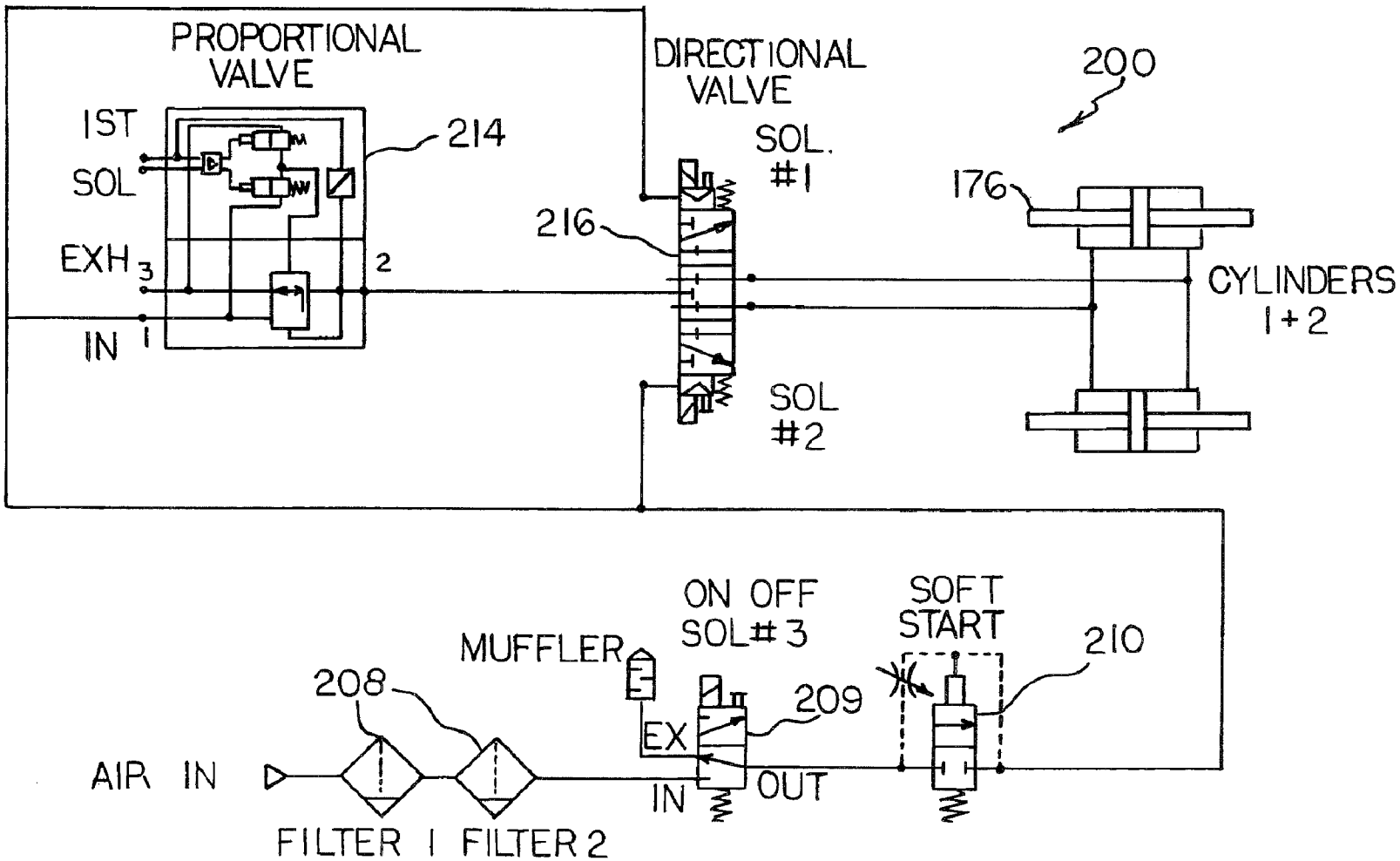
Figure 13C:
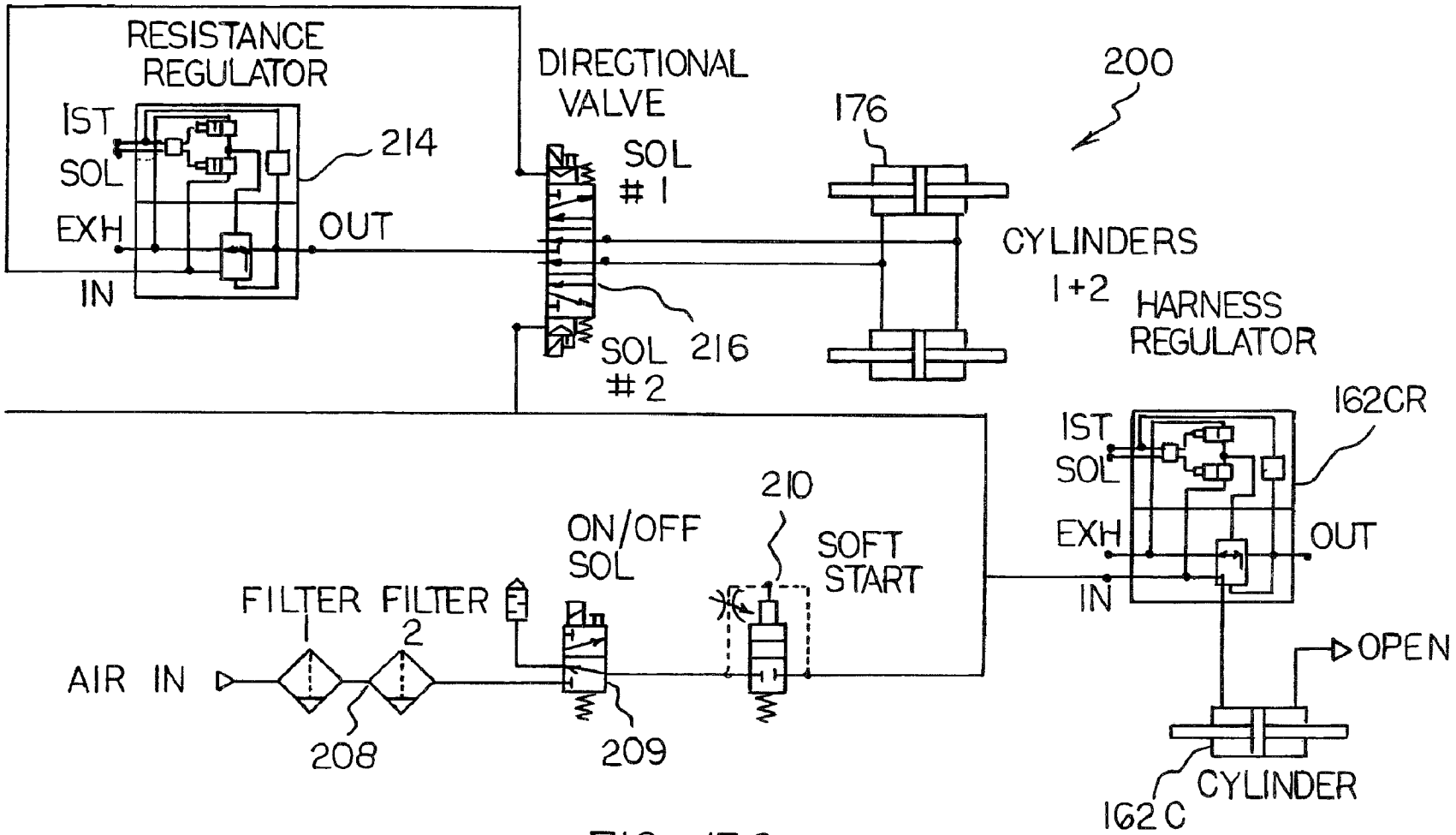
Figure 13D:
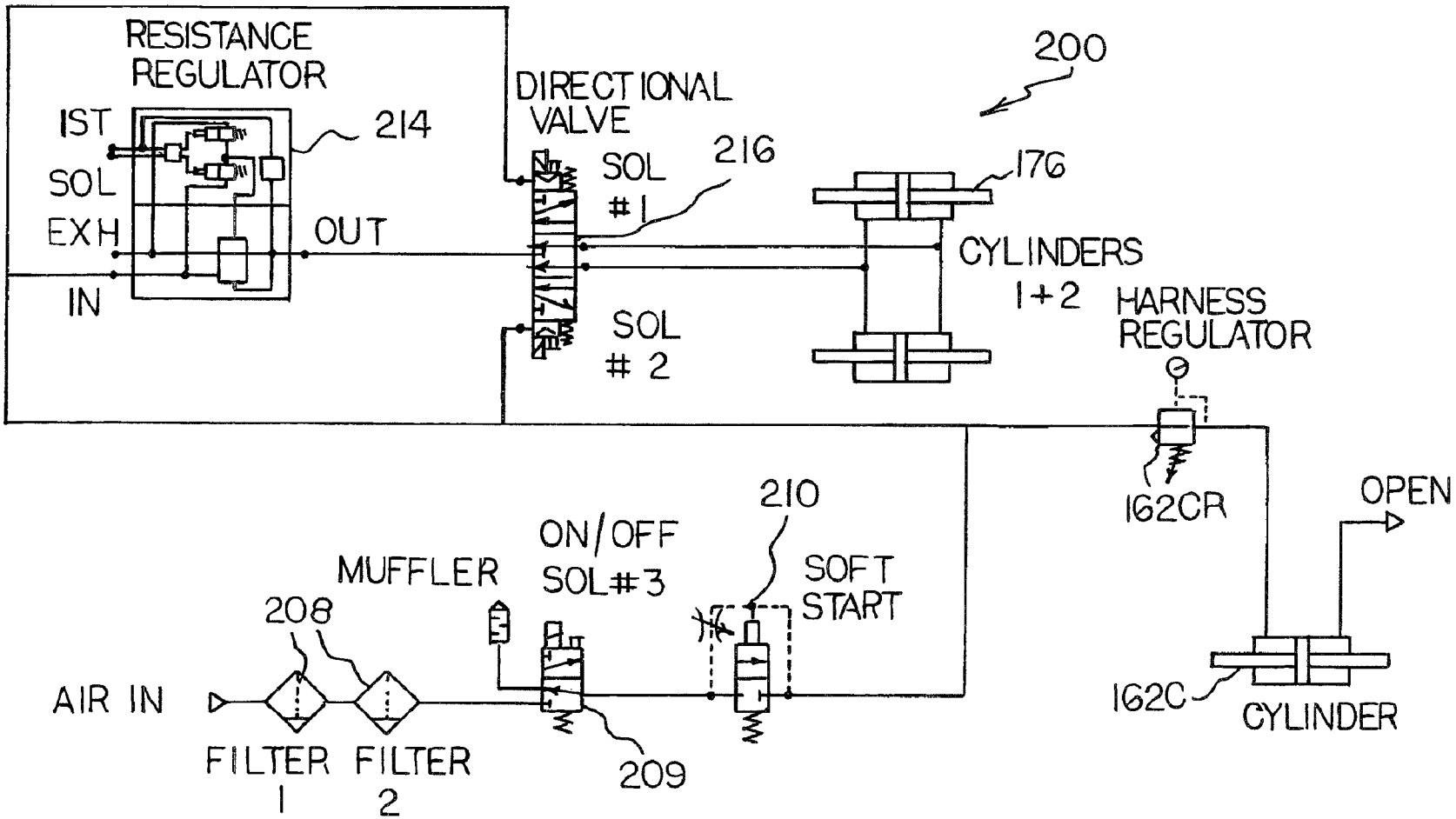

As shown in FIGS. 21A-G, the arm rotation embodiment 800 of the invention comprises a rotational actuator 802 powered by an arm resistance regulator 802R and directional switching valve 802V (see FIG. 13D). The rotational actuator 802 is rigidly mounted between a pair of arms 804 that are in turn pivotably connected to vertical adjustment assembly 806. The vertical adjustment assembly 806 is then mounted to one of the upstanding side supports 118. An adjustment knob 804K allows adjustment of the arms 804 whereas adjustment knob 806K allows vertical adjustment. A handle 808 is connected to the drive shaft 802S of the actuator 802.

Figure 21B:
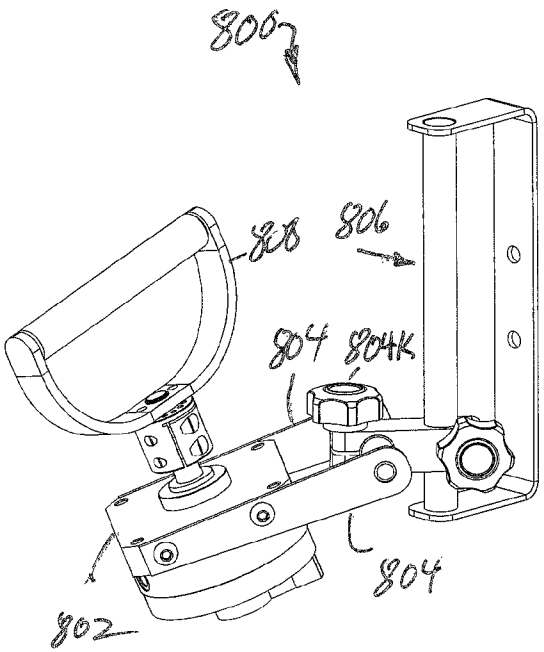
Figure 21C:
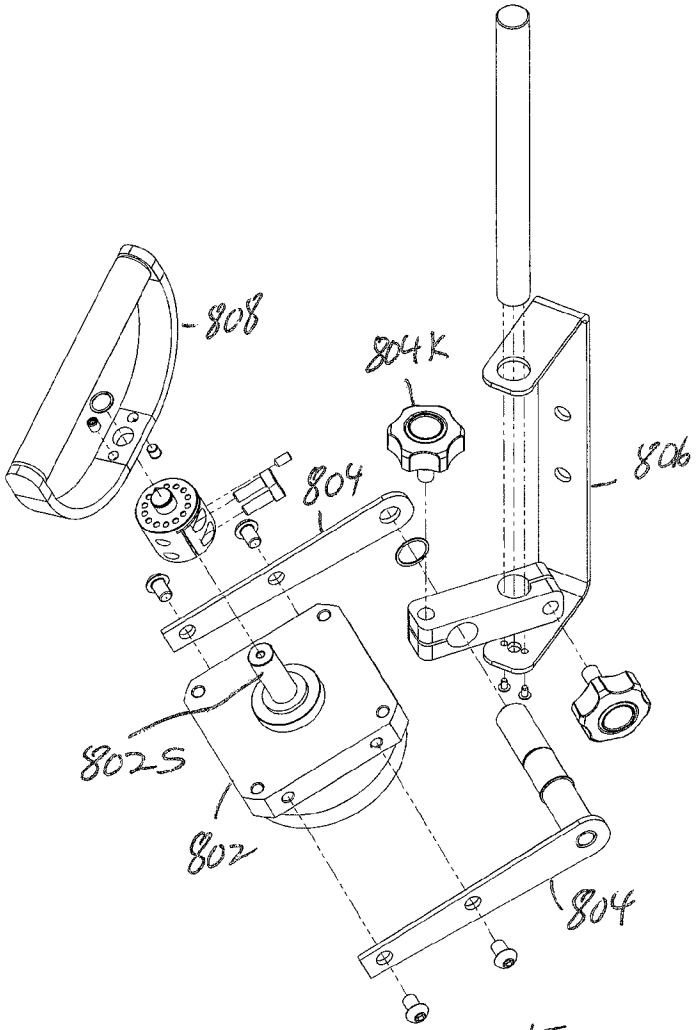
Figure 21D:
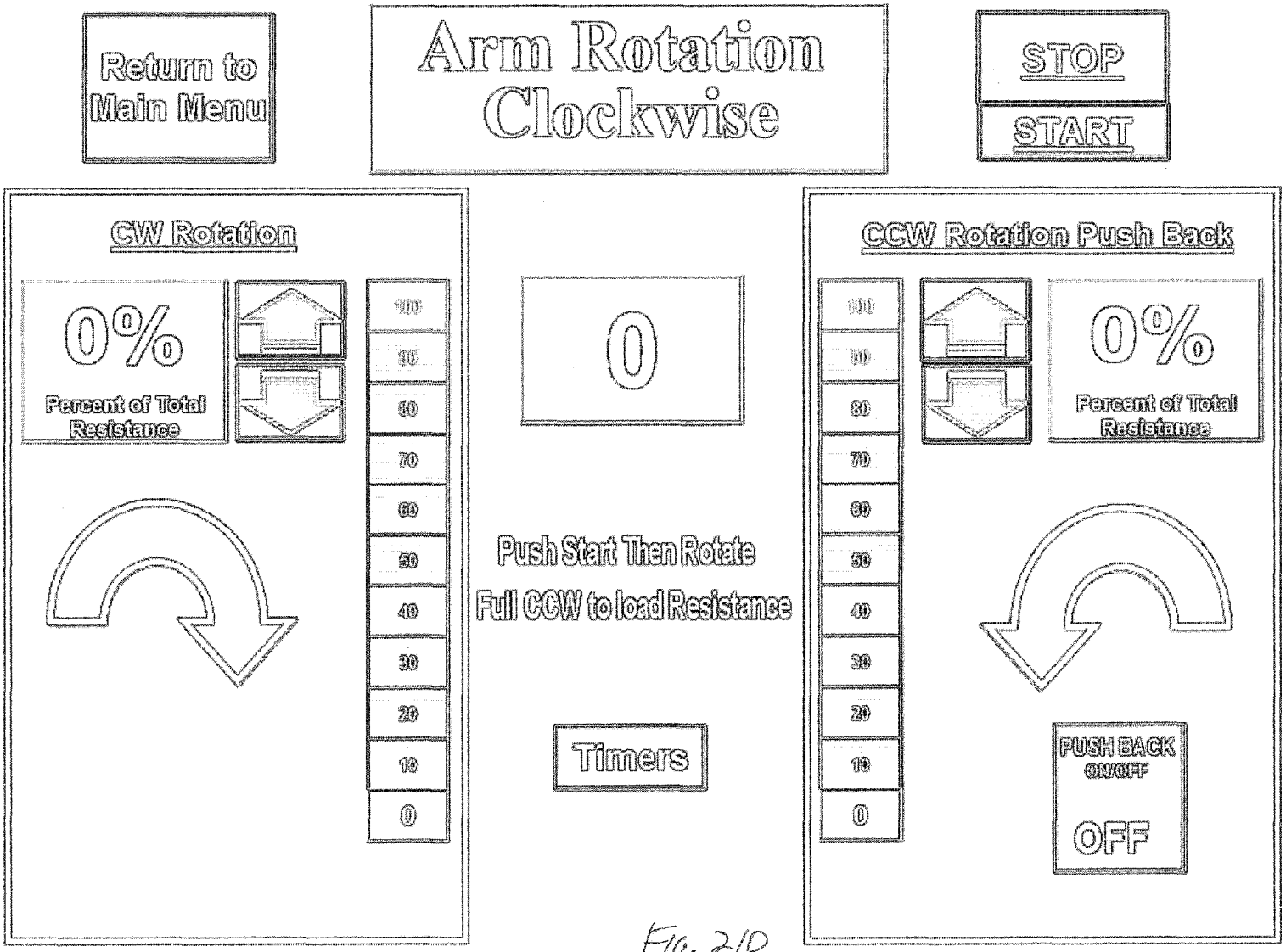
Figure 21E:
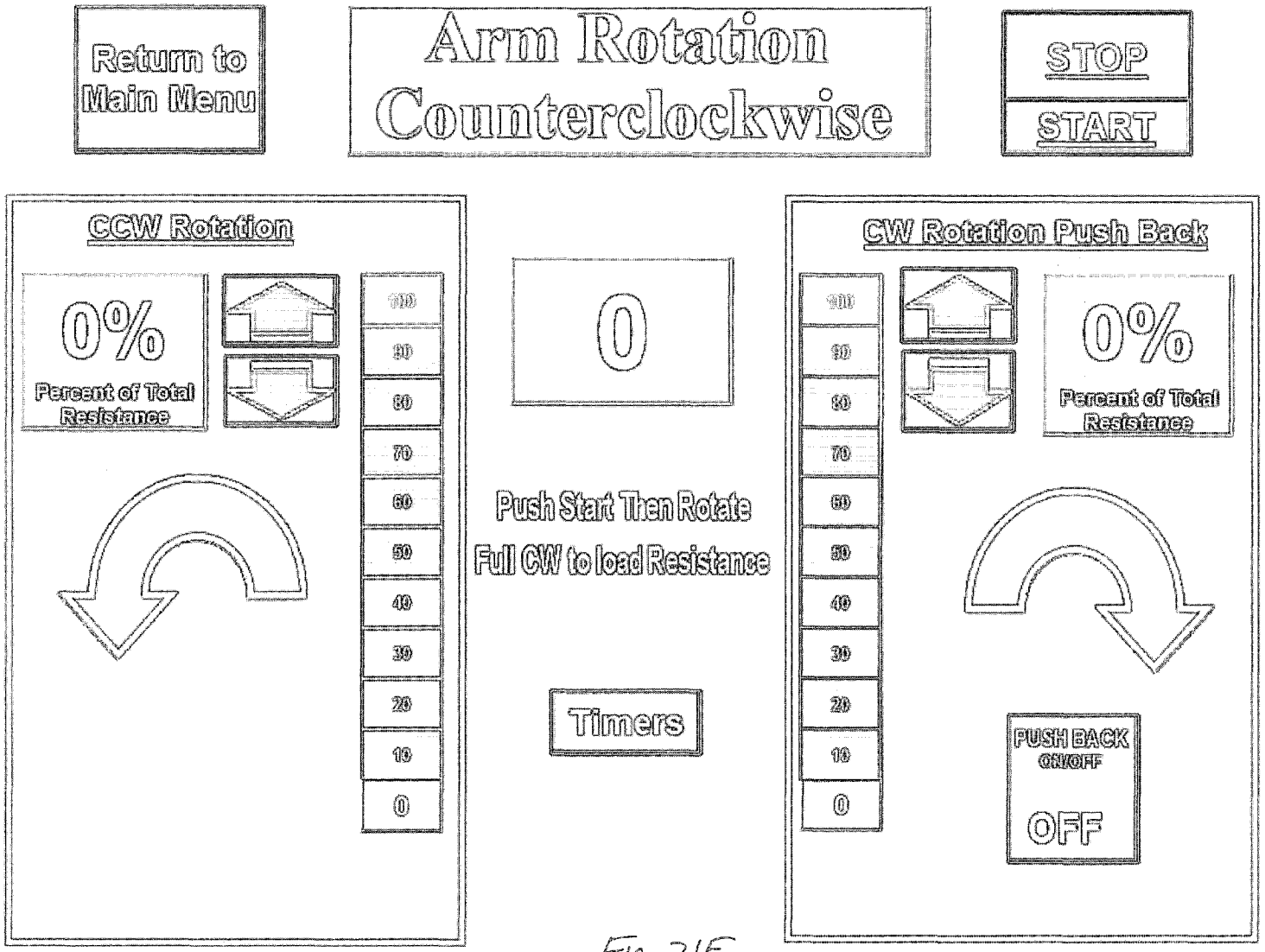
Figure 21F:
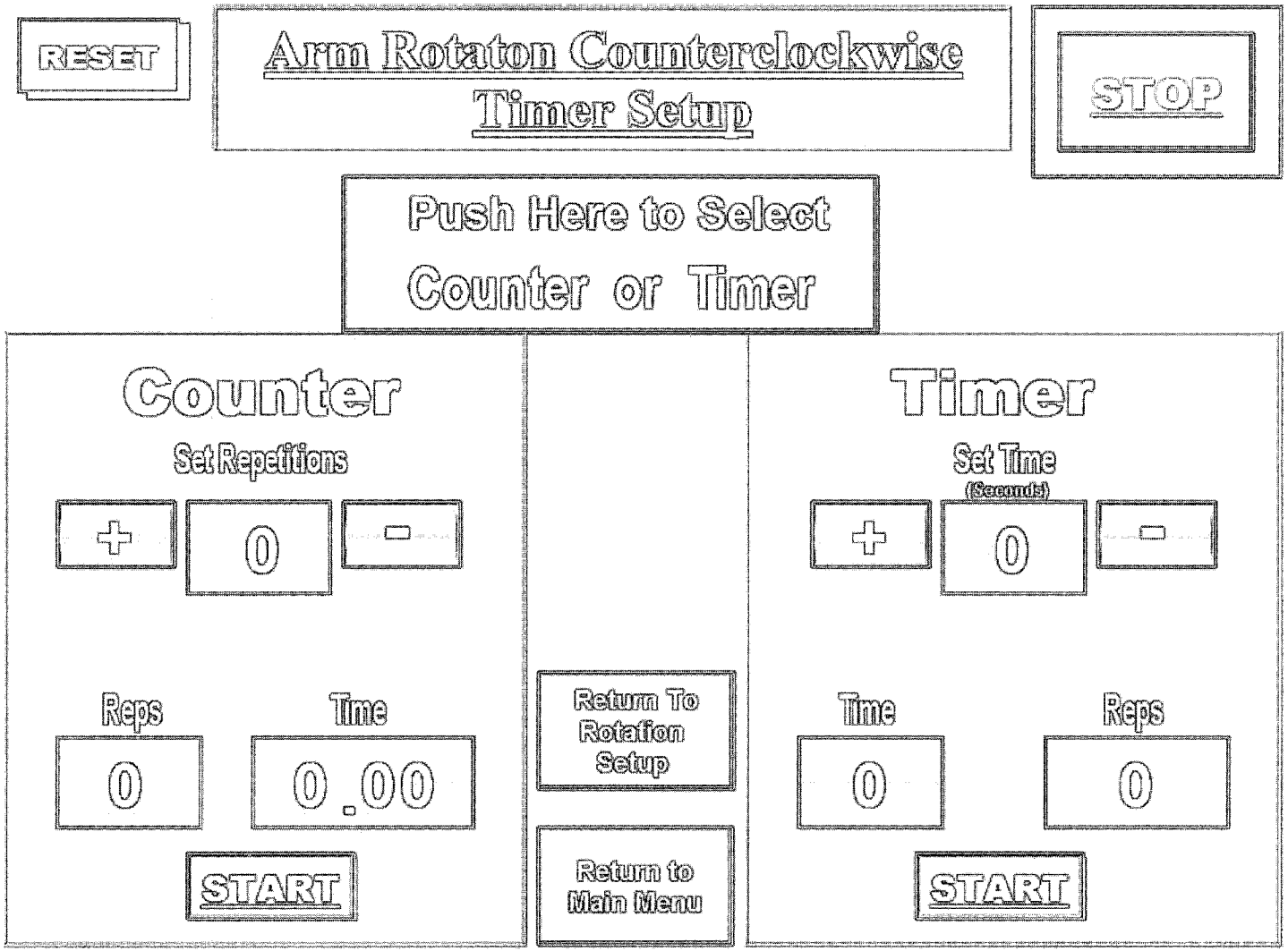
Figure 21E:
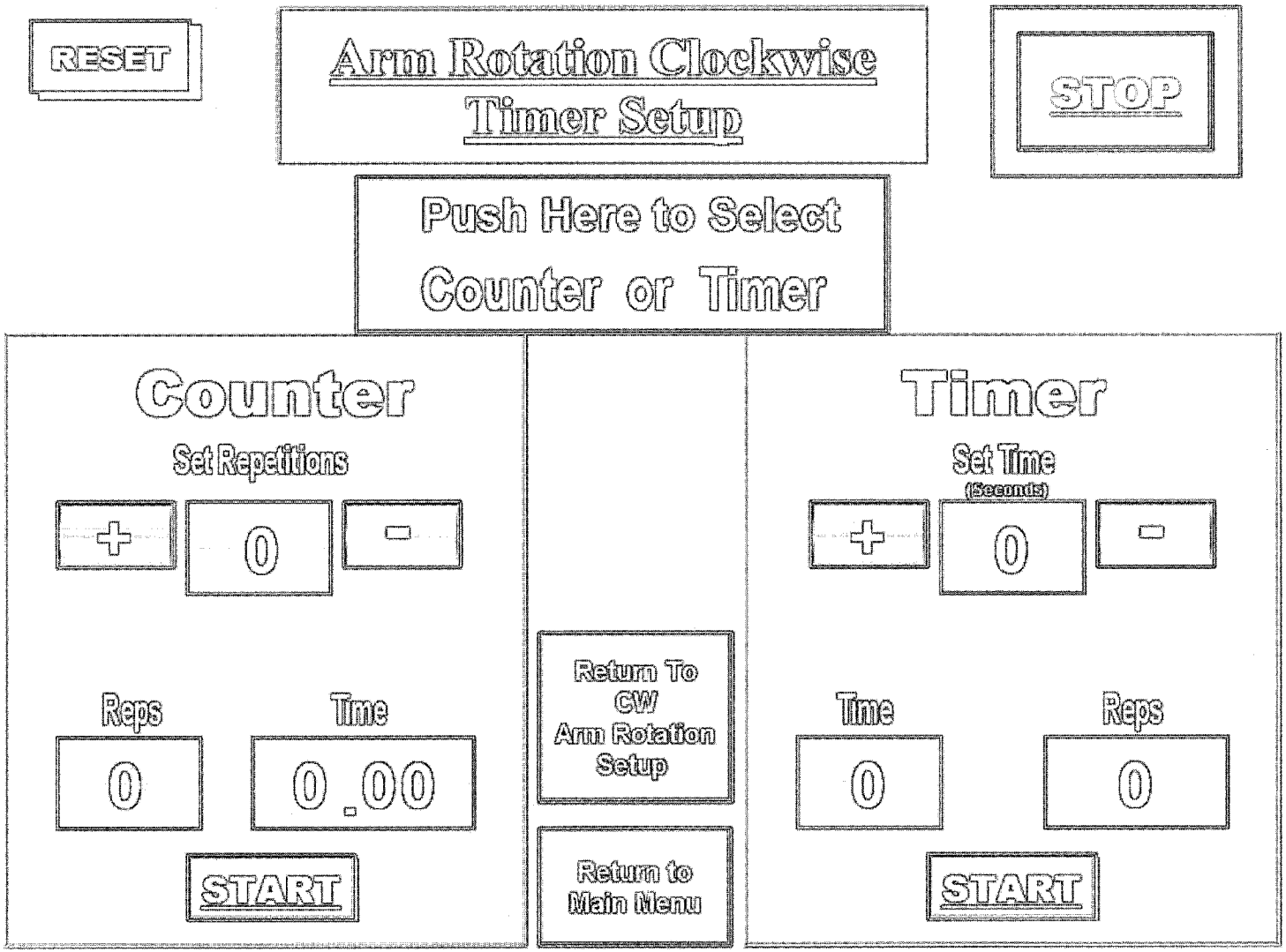

As shown in the screens of FIGS. 21D-G, during exercising or training the arm rotation embodiment 800 allows a user to rotate the handle clockwise or counter-clockwise against selectable resistance (with or without push back). Further, as seen in the screens of FIGS. 21F and G, the arm rotational exercising or training may be based upon a preselectable number of repetitions or time.

Vertical-Lift Embodiment

Referring to FIG. 18, the vertical-lift exercising embodiment 110V of the exercising machine of our present invention 110 comprises an ergonomic structure having a base platform 412 with a front deck area 414 on which the user is intended to position himself for exercising, and a rear area 416. The front deck area 414 of the platform 112 supports opposing upstanding side supports 418 in which a vertically-movable bar 420 is operatively entrained. The rear area 416 supports a rear compartment 424 defined by side members 424S enclosed by front, rear and side gusset panels 422. The rear compartment 424 contains the air control assembly 200. Preferably, the opposing upstanding side supports 418 are hollow to define raceways for the pneumatic lines and electrical control extending from the rear compartment 424. Preferably, one of the side members 424S extends upwardly to support a computer monitor bracket 428 for a touch screen computer monitor 430 at a convenient level for operation by the user while standing on the deck 414 of the platform 412 to view the various graphical user interface screens 110S as they are displayed Notably, vertical-lift exercising embodiment 110V shown in FIG. 18 is disassemable for shipping in conventional-sized shipping containers by separating the front deck area 414 from the rear area 416 of the platform 412, separating the upstanding supports 418, removing the touch screen monitor 430, removing the screen's bracket 428, and positioning such components in a plurality of shipping containers.

The opposing upstanding side supports 418 each contain a vertically-mounted double acting cylinder 454 comprising a reciprocating pillow block 456. The opposing ends of a horizontal bar 420 are rigidly connected to the respective pillow blocks 456 between the supports 418. Upon operation of cylinders 454 under computer control, the horizontal bar 420 moves vertically up or down at a variable (or fixed) resistance/force along its vertical path of motion. It should be appreciated that the vertically-reciprocating horizontal bar 420 may be used for exercising any muscle group that benefits from a variable lifting or pushing force (e.g., dead-lift, squat, shoulder press).

The pneumatics of the vertical-lift embodiment 110V are similar in function to FIG. 13 of the core embodiment 110C. Likewise, as shown in FIG. 18C, the computer interface of the vertical-lift embodiment similar in function to the computer interface of FIG. 17B of the core embodiment 110C. Therefore the similar functioning components thereof are numbered the same.

Figure 18A:
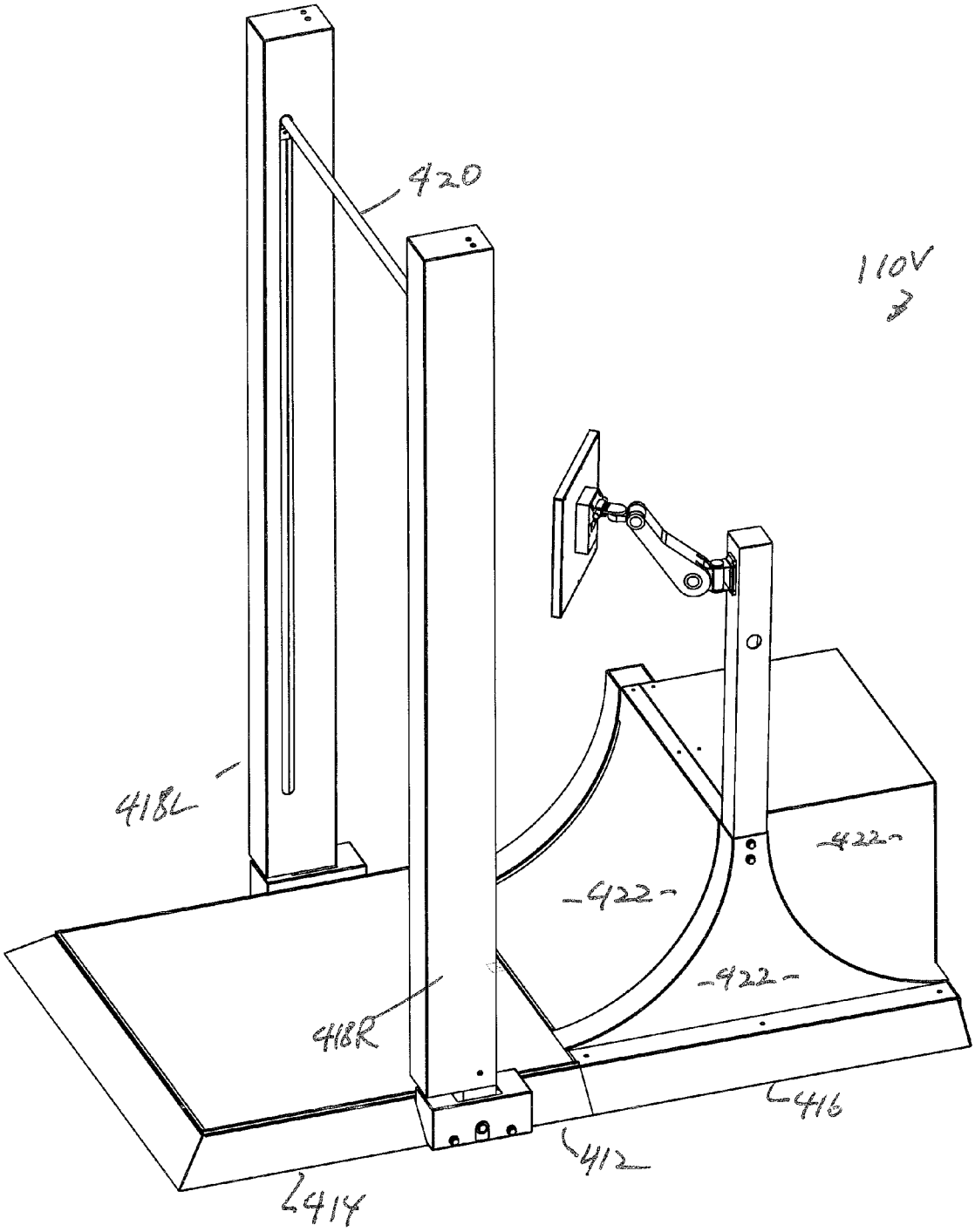
FIGS. 18A-18D illustrate the vertical-lift embodiment of the present invention.
Figure 18B:
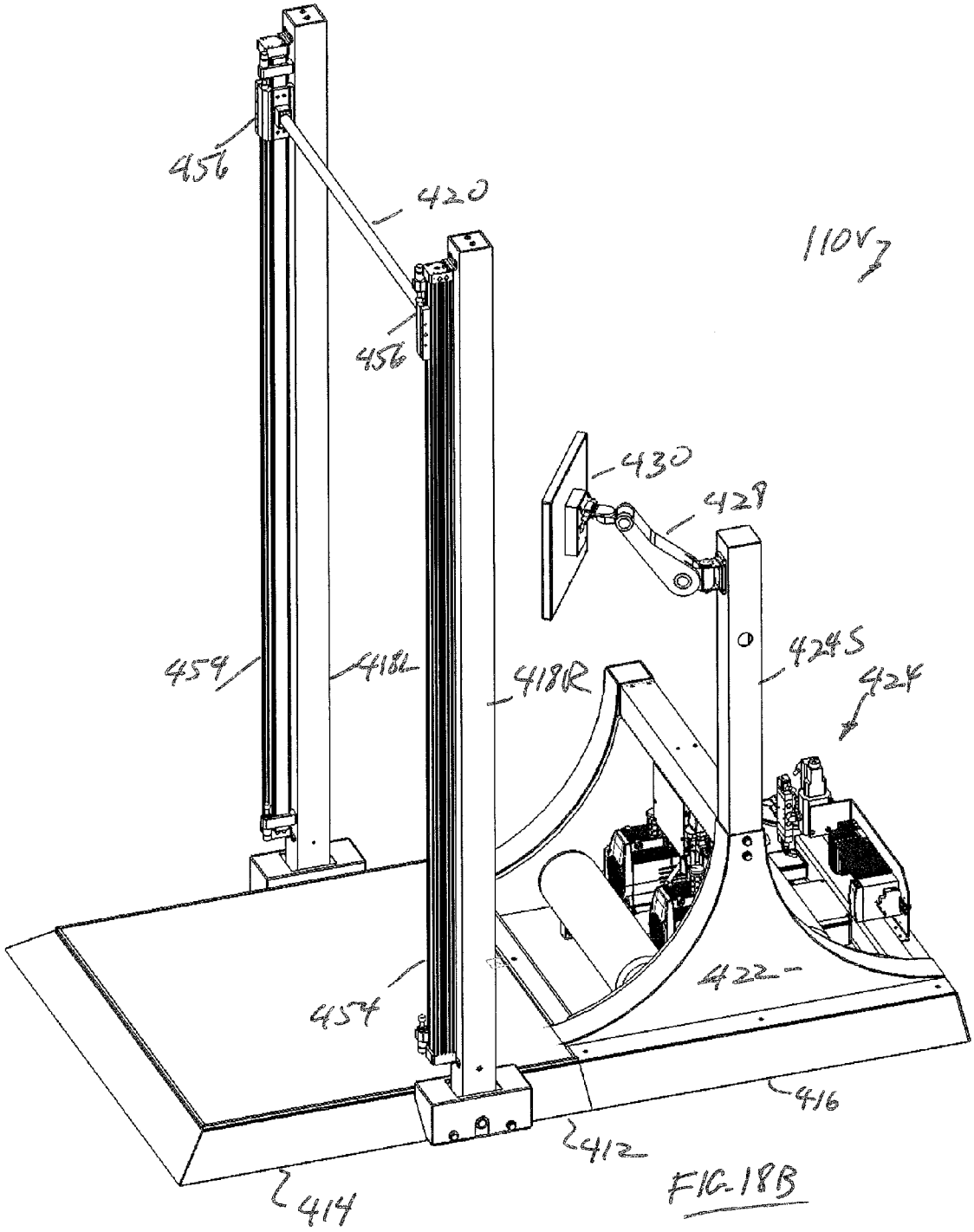
Figure 18C:
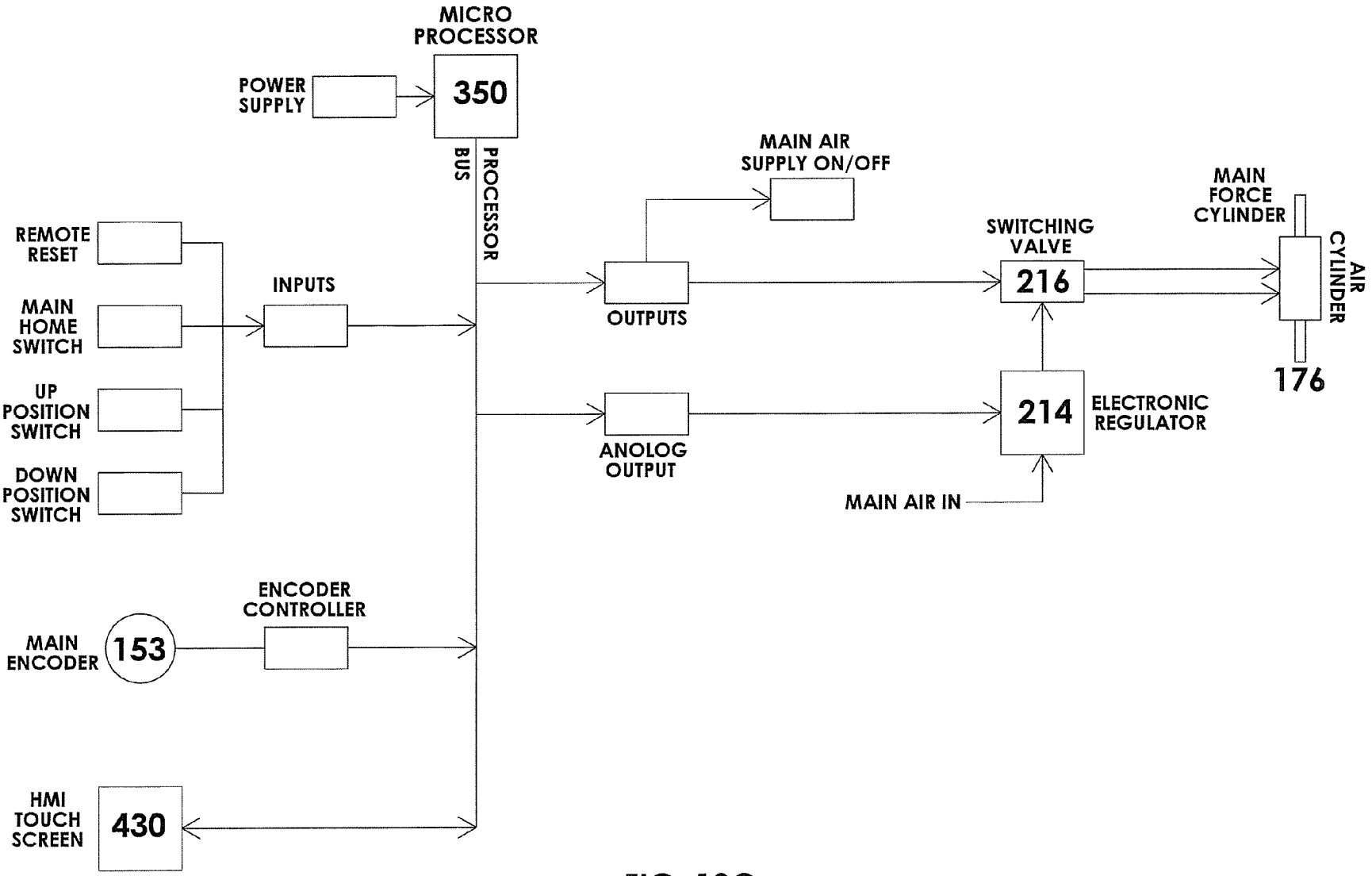
Figure 18D:
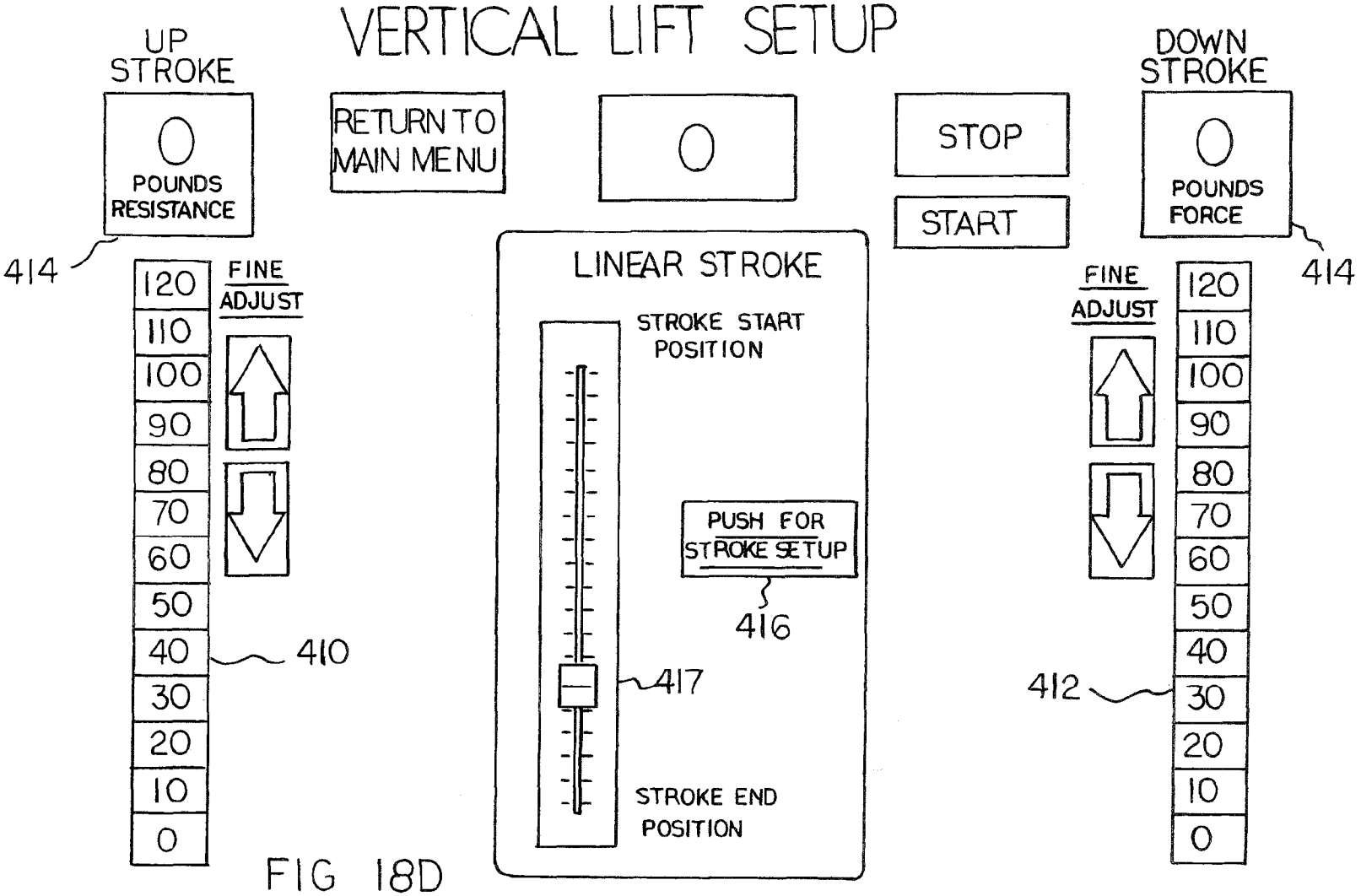

Referring now to FIG. 18D, the main screen 490 of the graphical user interface for the vertical-lift embodiment 110V comprises a graduated two- or three-digit up-stroke resistance column 410 and a graduated two- or three digit down-stroke force column 412 allowing the user to select the desired resistance for lifting the bar 420 and the desired force to be exerted during lowering of the bar 420. The resistance/force columns 410 and 412 may include fine-adjust incremental buttons (e.g., select the two (or three) digits then increment by single digits). The selected resistance is then displayed in the respective resistance/force windows 414. A stroke setup button 416 is provided to select the ranges (i.e., stroke distances) of vertical movement of the bar 420 upwardly and downwardly, via a slider 417. The main screen 490 may include other buttons and links to other screens as more particularly described above in connection with the core embodiment 110C.

Multi-Function Embodiment

Referring to FIG. 19, like the vertical-lift embodiment 110V, the multi-function embodiment 110M of the exercising machine of our present invention 110 comprises an ergonomic structure having a base platform 612 with a front deck area 614 and a rear area 616. The rear area 616 supports opposing upstanding rear side supports 618 in which a vertically-movable bar 620 is operatively entrained. The rear area 616 supports a rear compartment 624 defined by opposing middle side supports 625 enclosed by front, rear and side gusset panels 622. The rear compartment 624 contains the air control assembly 200 as more particularly described above. A generally-rectangular upstanding framework 626 is supported at its four corners by the middle and rear side supports 618 and 625. A computer monitor bracket 628 is mounted to one of the middle side supports 625 for a touch screen computer monitor 630 such that the monitor 630 is positioned at a convenient level for operation by the user while standing on the deck 614 of the platform 612 to view the various graphical user interface screens 110S as they are displayed.

Mounted to the framework 626 is a multi-function extension machine 632. The machine 632 is of similar design to a conventional resistance weight machine having a butterfly attachment 632B, a lat-pull down attachment 632L, a chest press attachment 632C, an arm curl attachment 632A and a leg-extension attachment 632E operatively connected to a conventional weight stack by one or more cables. However, in lieu of the conventional weight stack, the various attachments 632A-E are operatively connected by the one or more cables to the vertically-movable bar 620. Consequently, in lieu of the resistances/forces being provided by the conventional weight stack, the vertically-movable bar 620 provides the resistances/forces under computer control as described in connection with the vertical-lift embodiment 110V.

More specifically, similar in function to FIG. 18B, the opposing upstanding side supports 618 each contain a vertically-mounted double acting cylinder 654 comprising a reciprocating pillow block 656. The opposing ends of the horizontal bar 620 are rigidly connected to the respective pillow blocks 656 between the supports 618. Upon operation of cylinders 654 under computer control, the horizontal bar 620 provides upward resistance and downward force along its vertical path of motion.

Figure 19A:
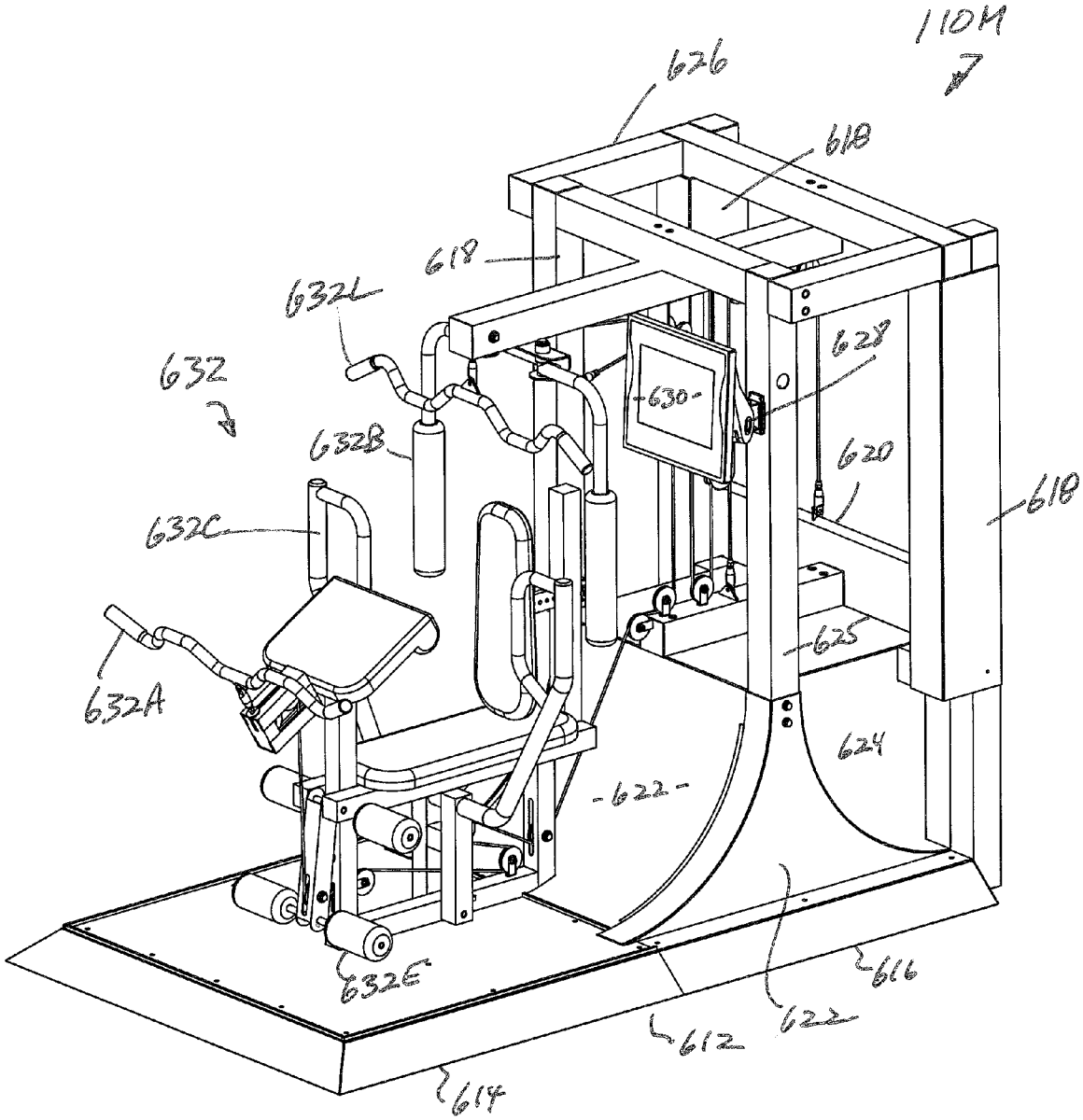
FIGS. 19A-19H illustrate the multi-function embodiment of the present invention.
Figure 19B:
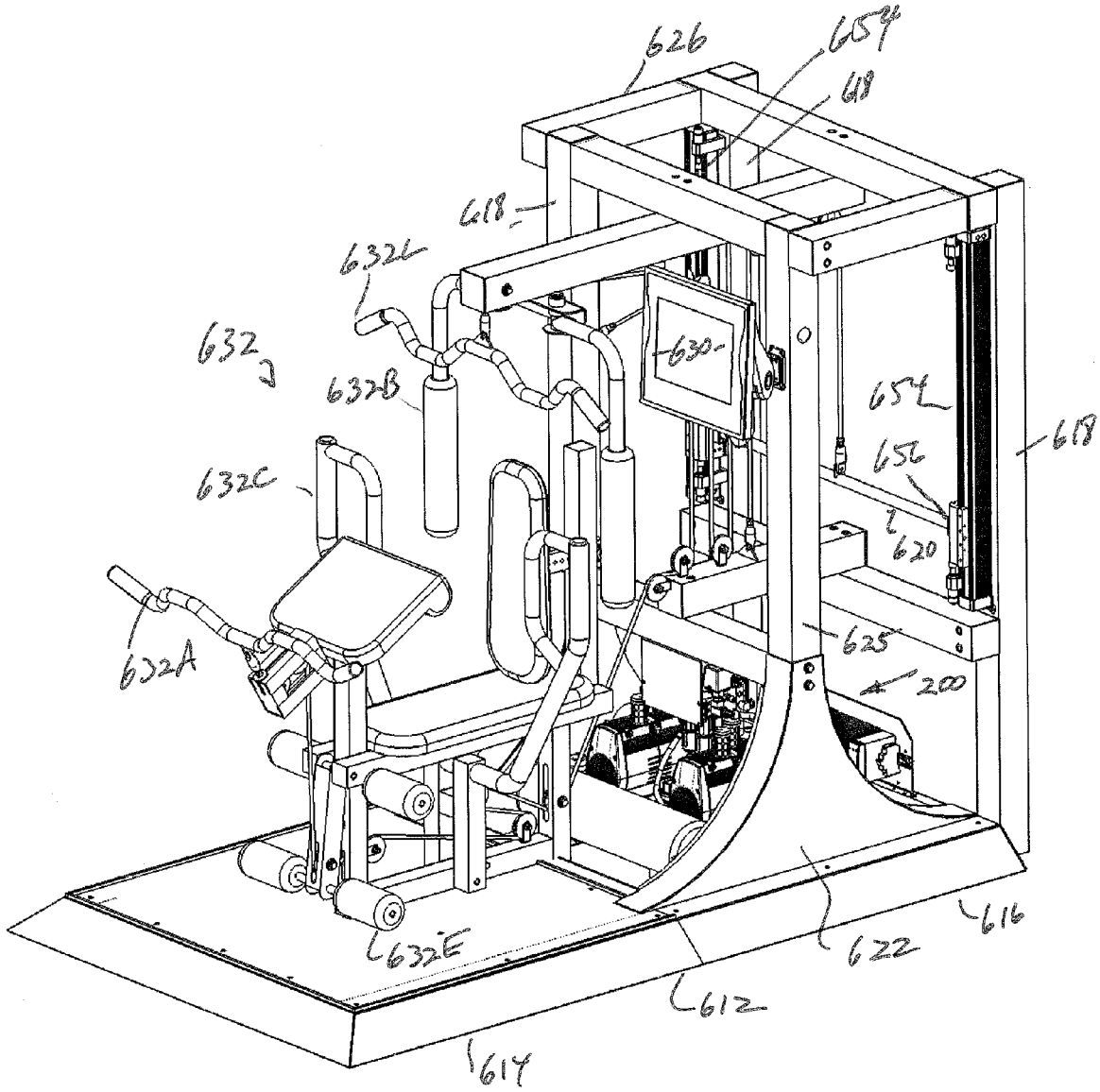

The multi-function embodiment 110M employs the various pneumatic components similar in function to FIGS. 19A and 19B of vertical-lift embodiment 110V. Likewise, the multi-function embodiment 110M employs the various electrical components similar in function to those shown in FIGS. 20A and 20B for the vertical-lift embodiment 110V.

Figure 19C:
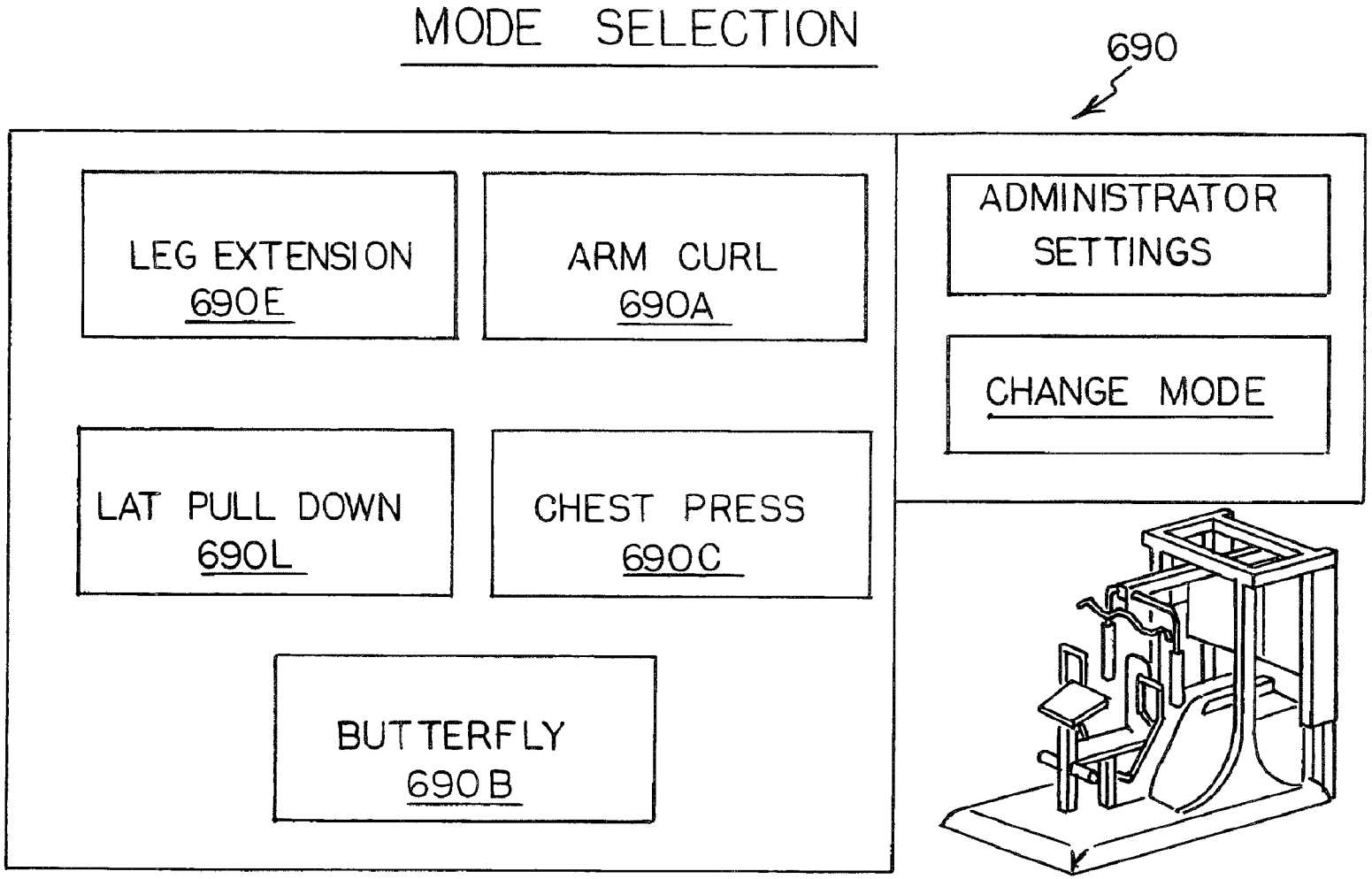
Figure 19D:
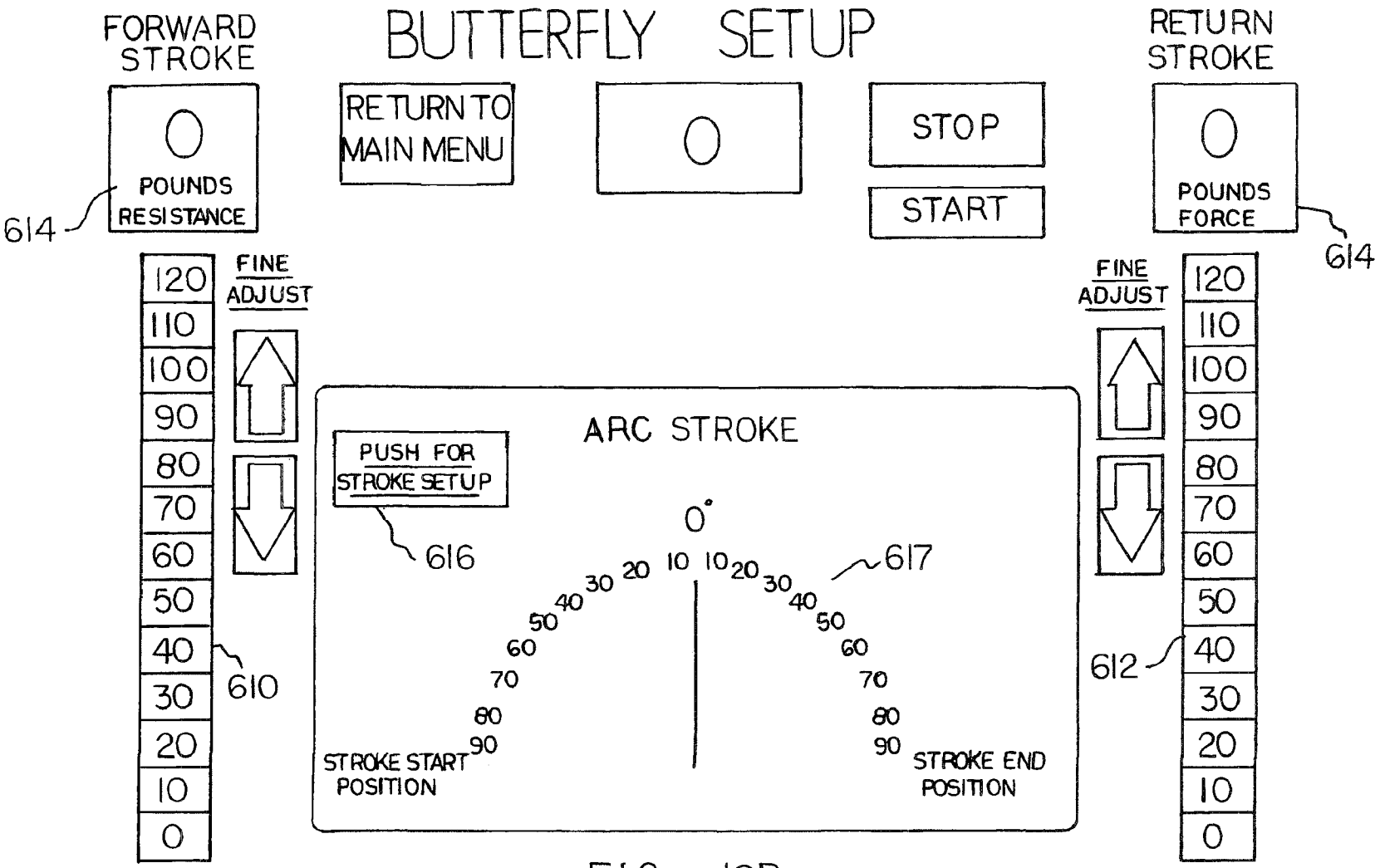
Figure 19E:
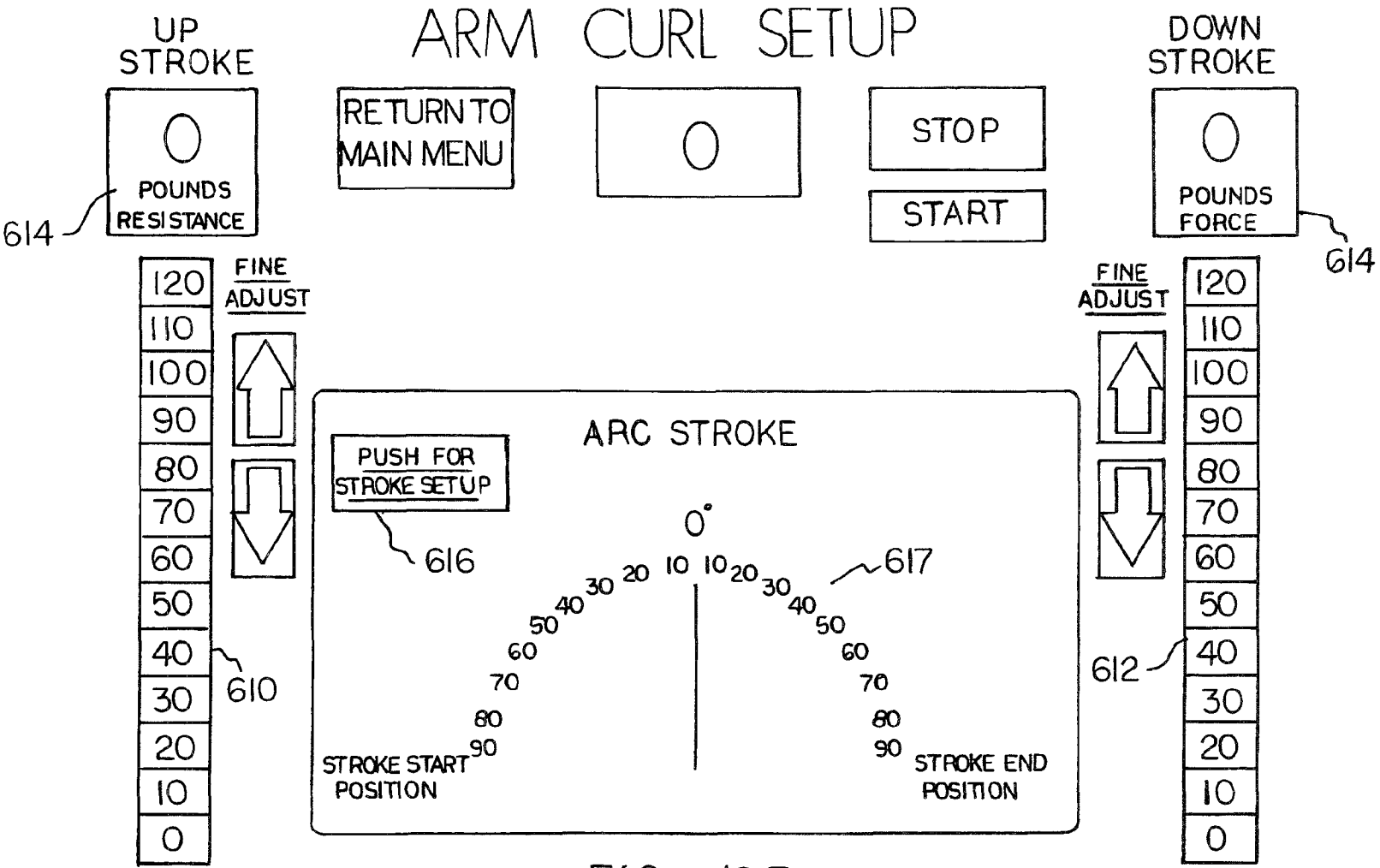
Figure 19F:
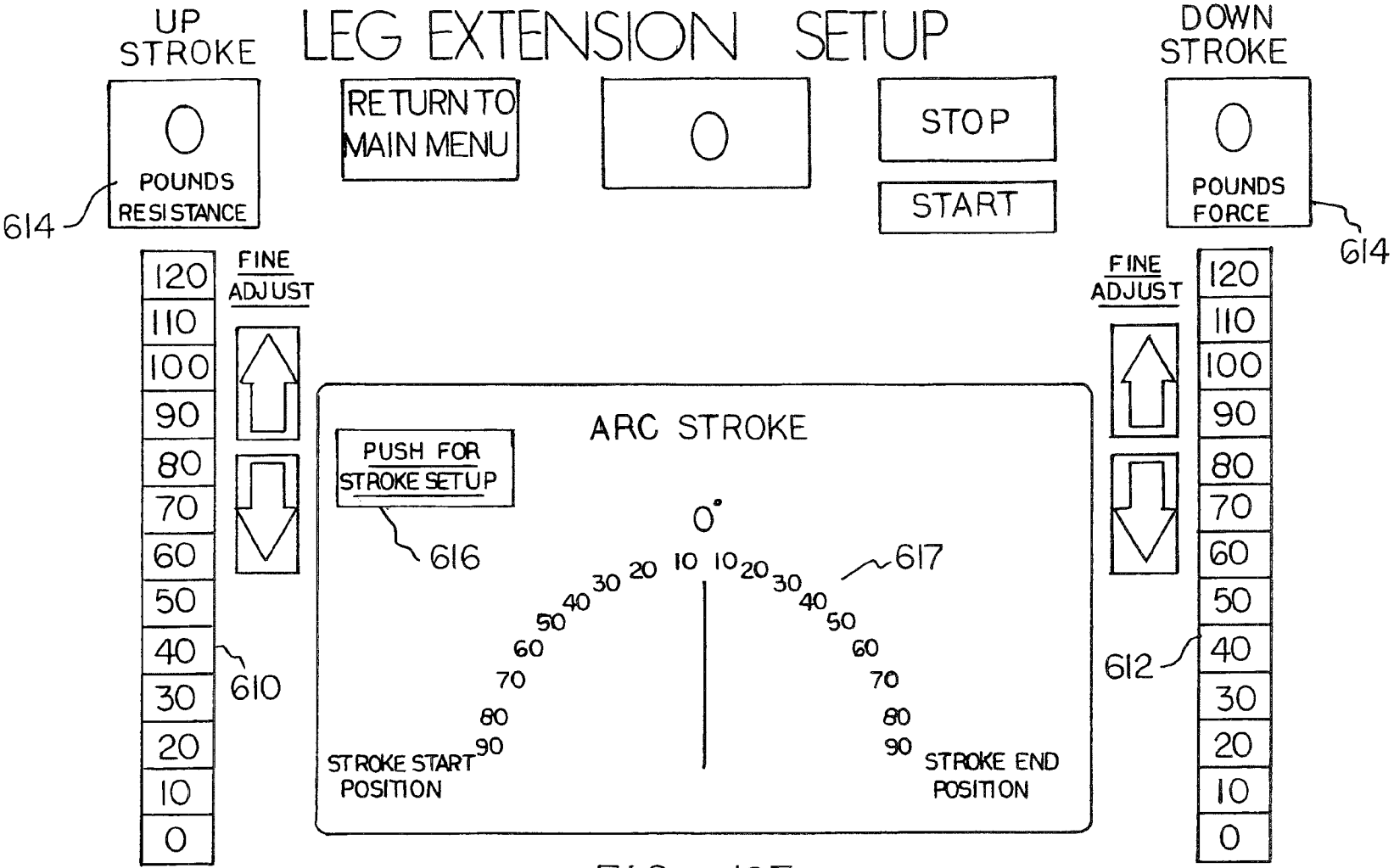
Figure 19G:
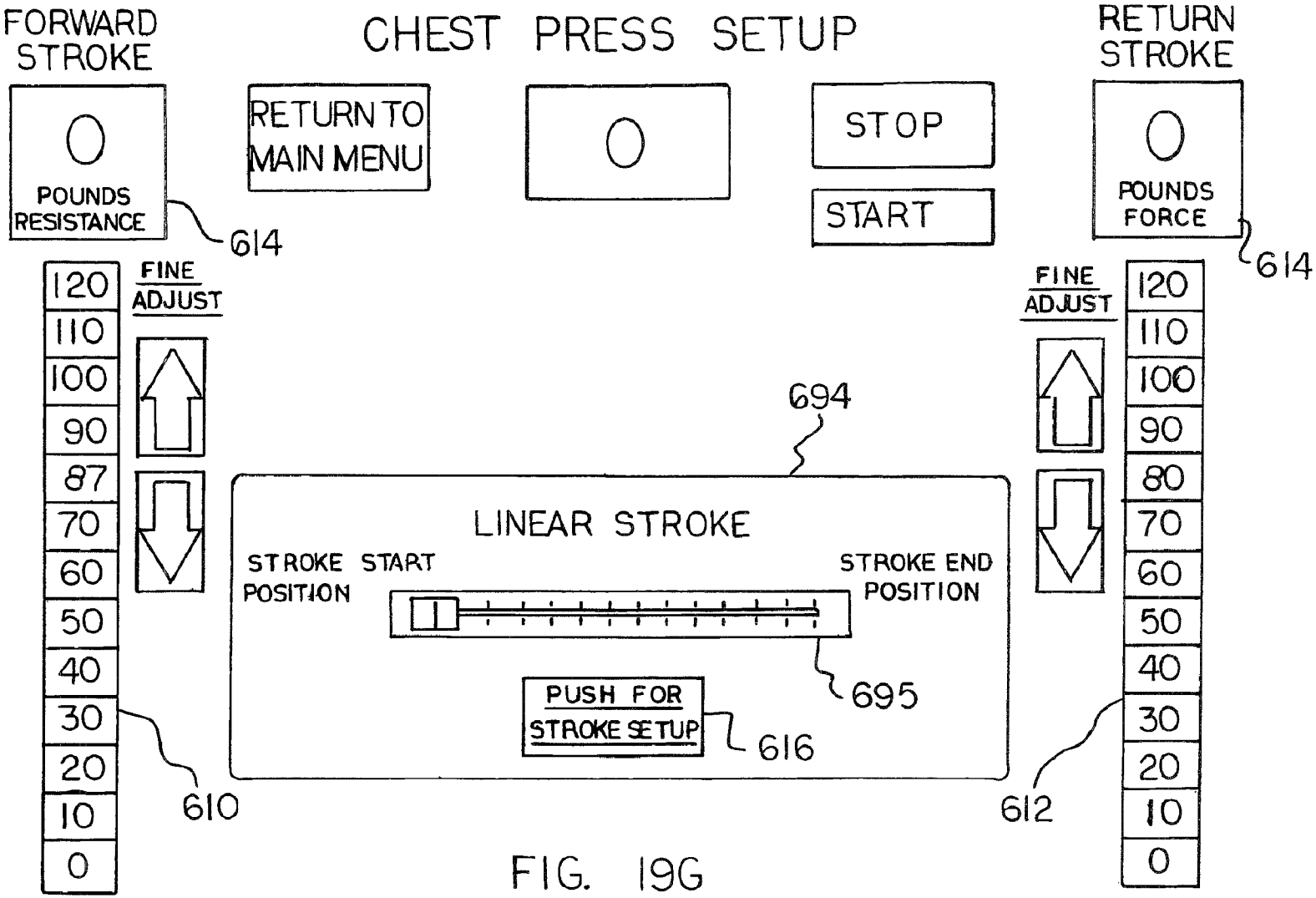
Figure 19H:
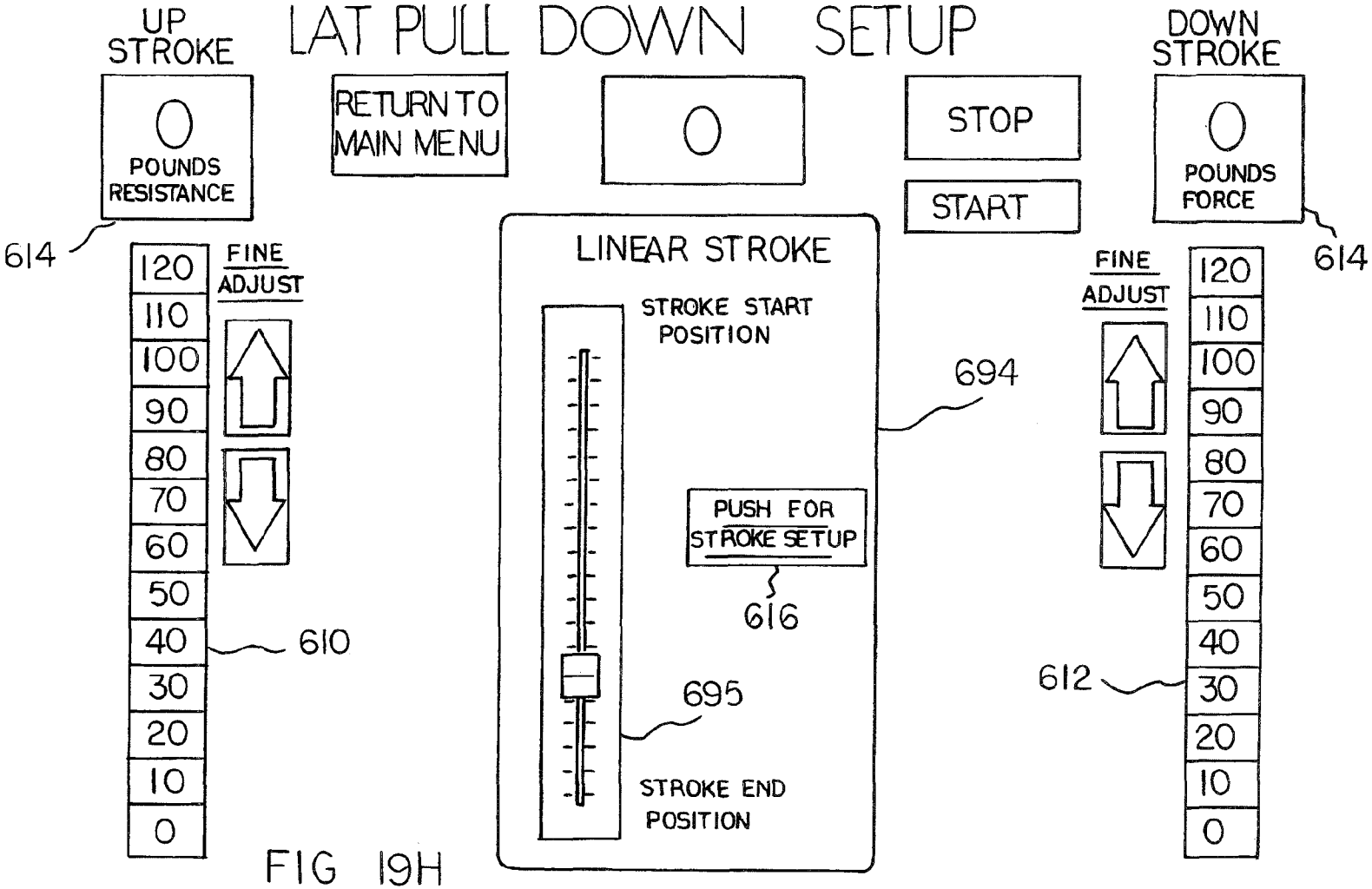
Figure 20A:
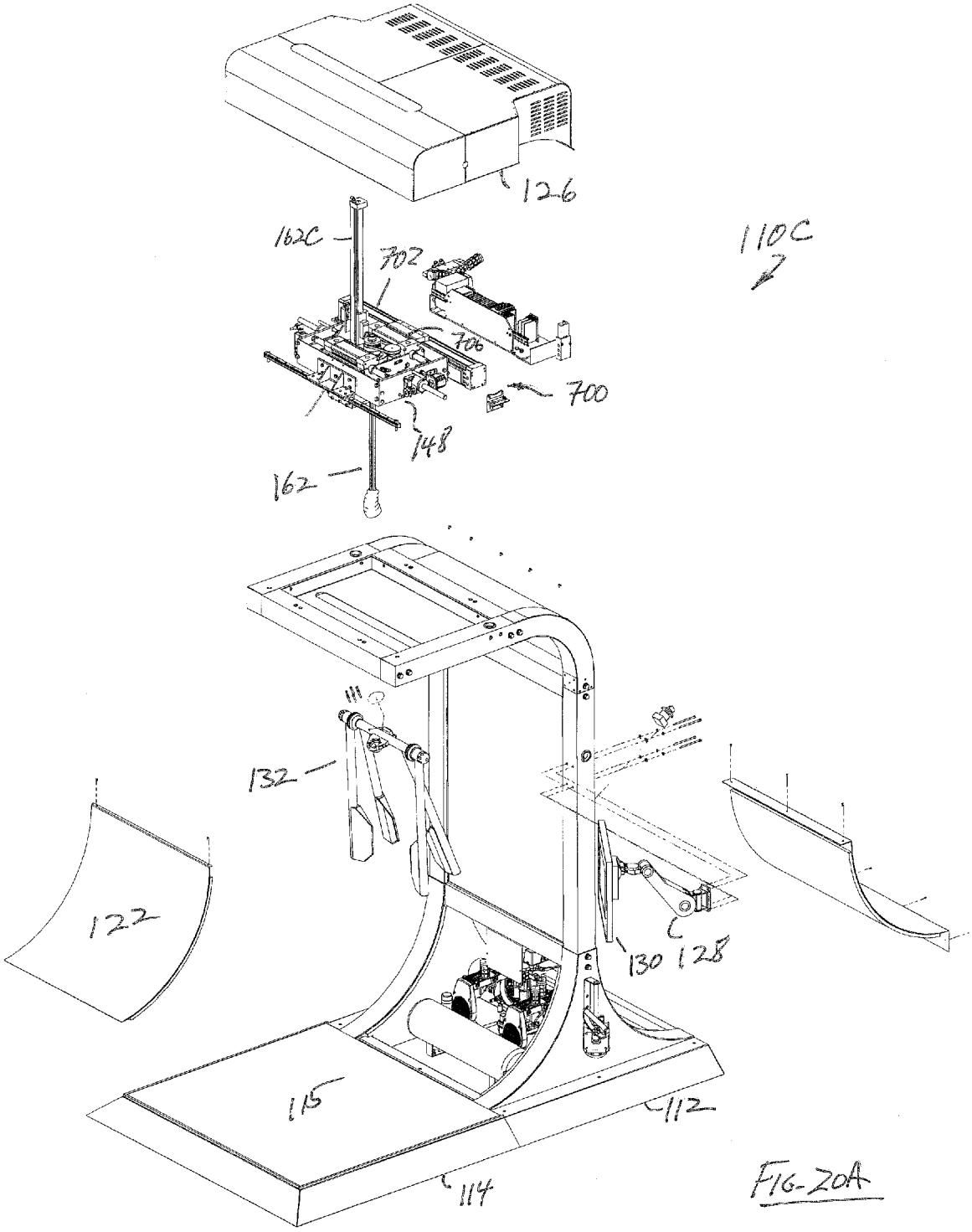
FIGS. 20A-20J illustrate a translational assembly in which is positioned the resistance/force assembly of the core-exercising embodiment to increase the range of motion thereof.
Figure 20B:
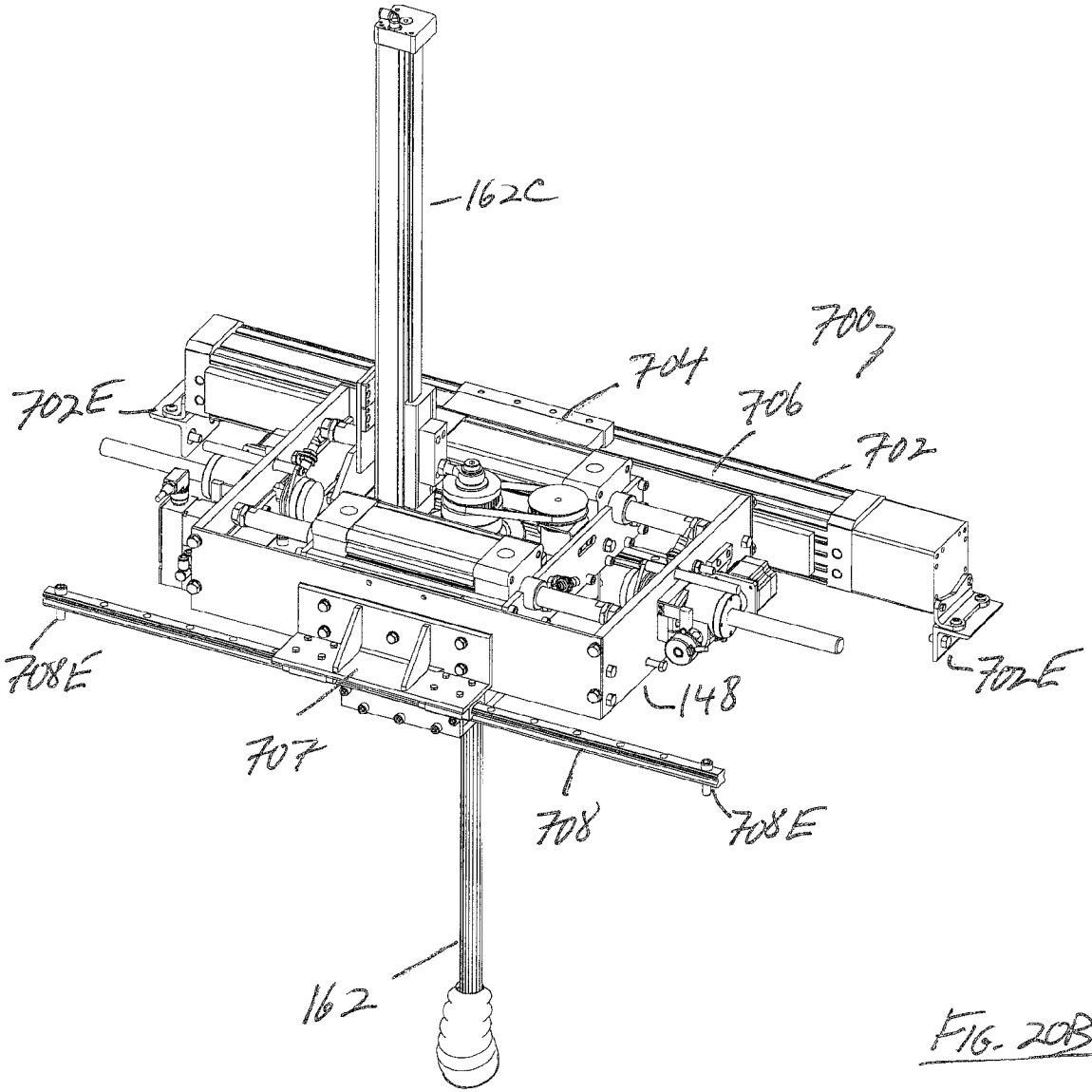
Figure 20C:
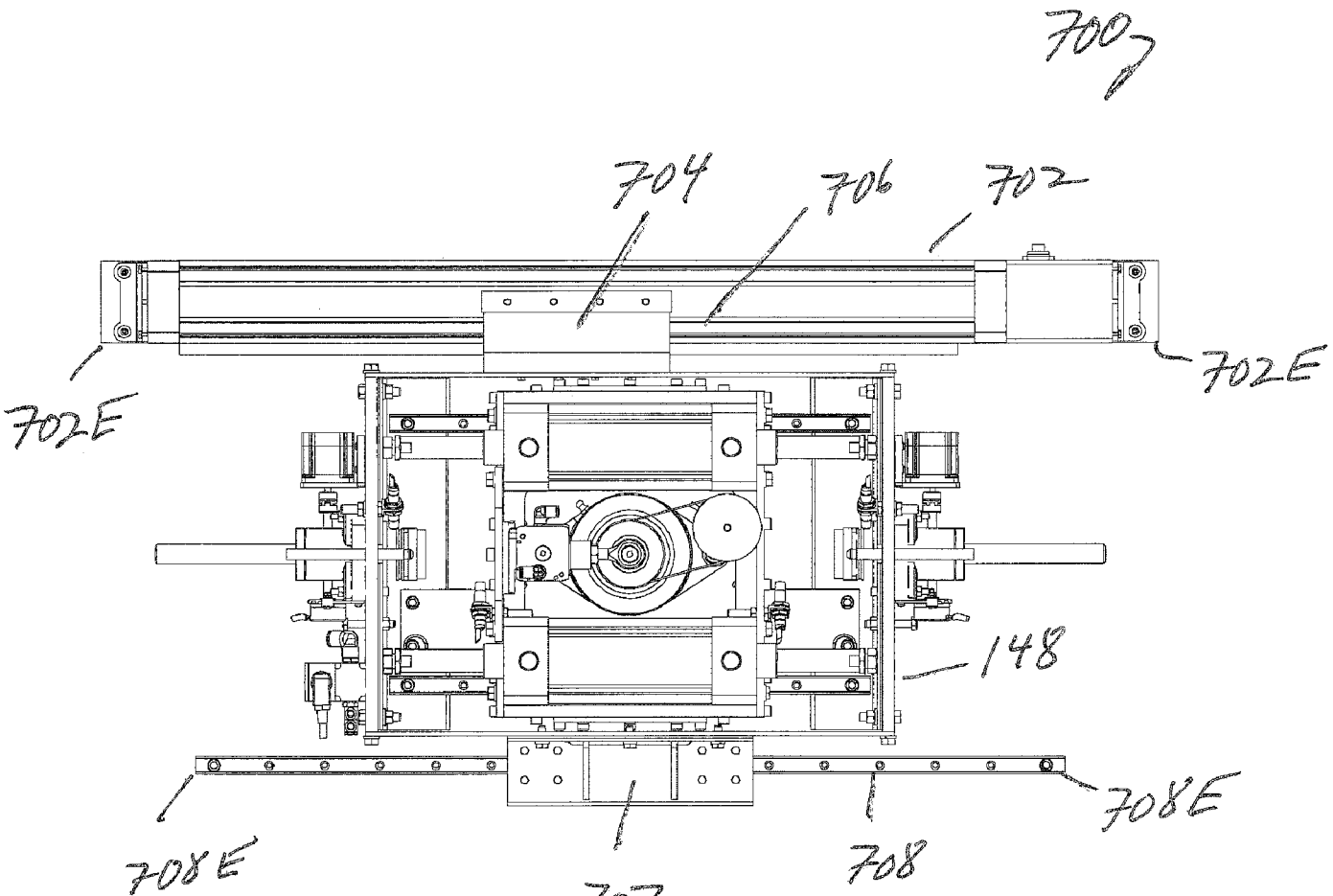
Figure 20D:
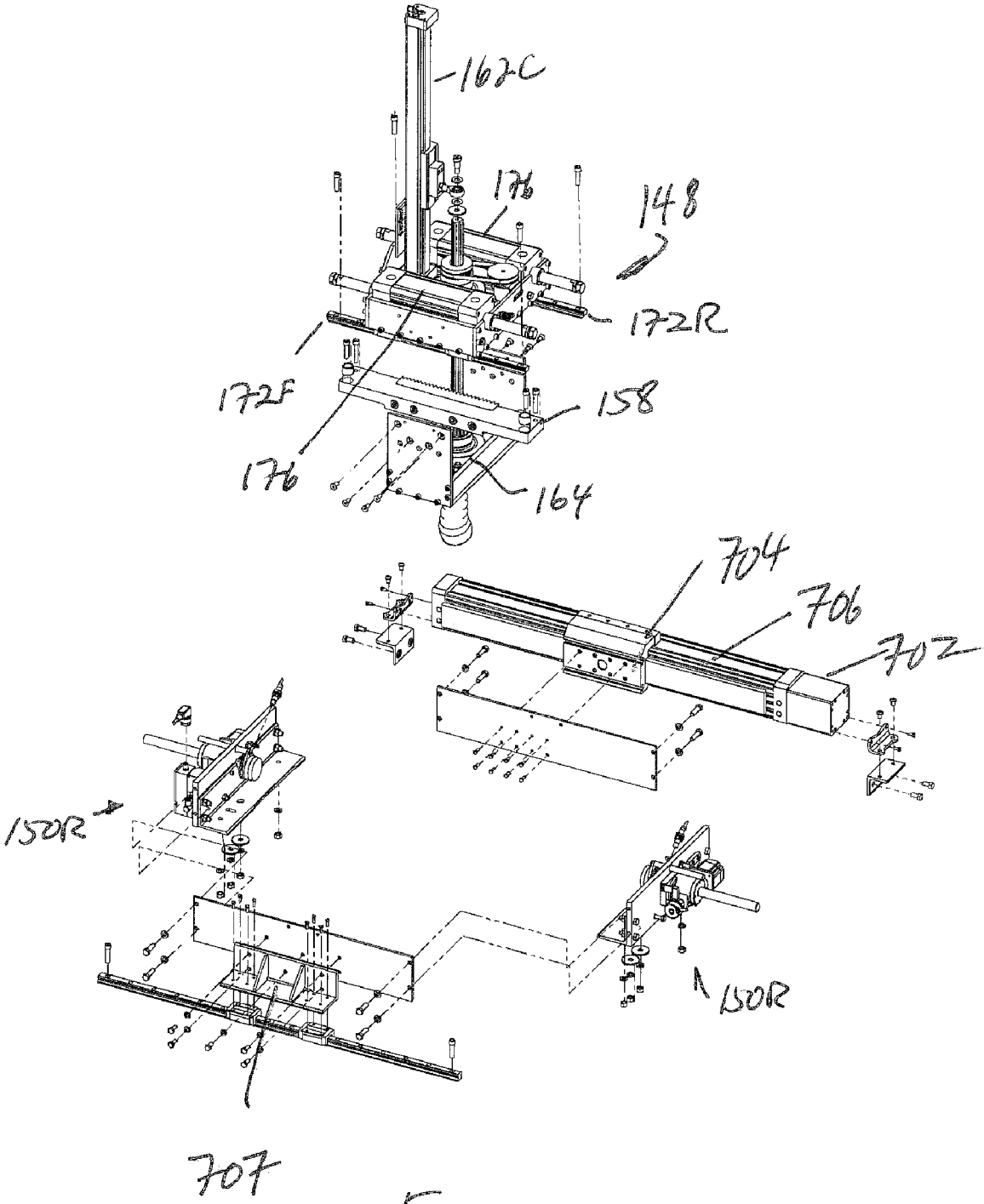
Figure 20E:
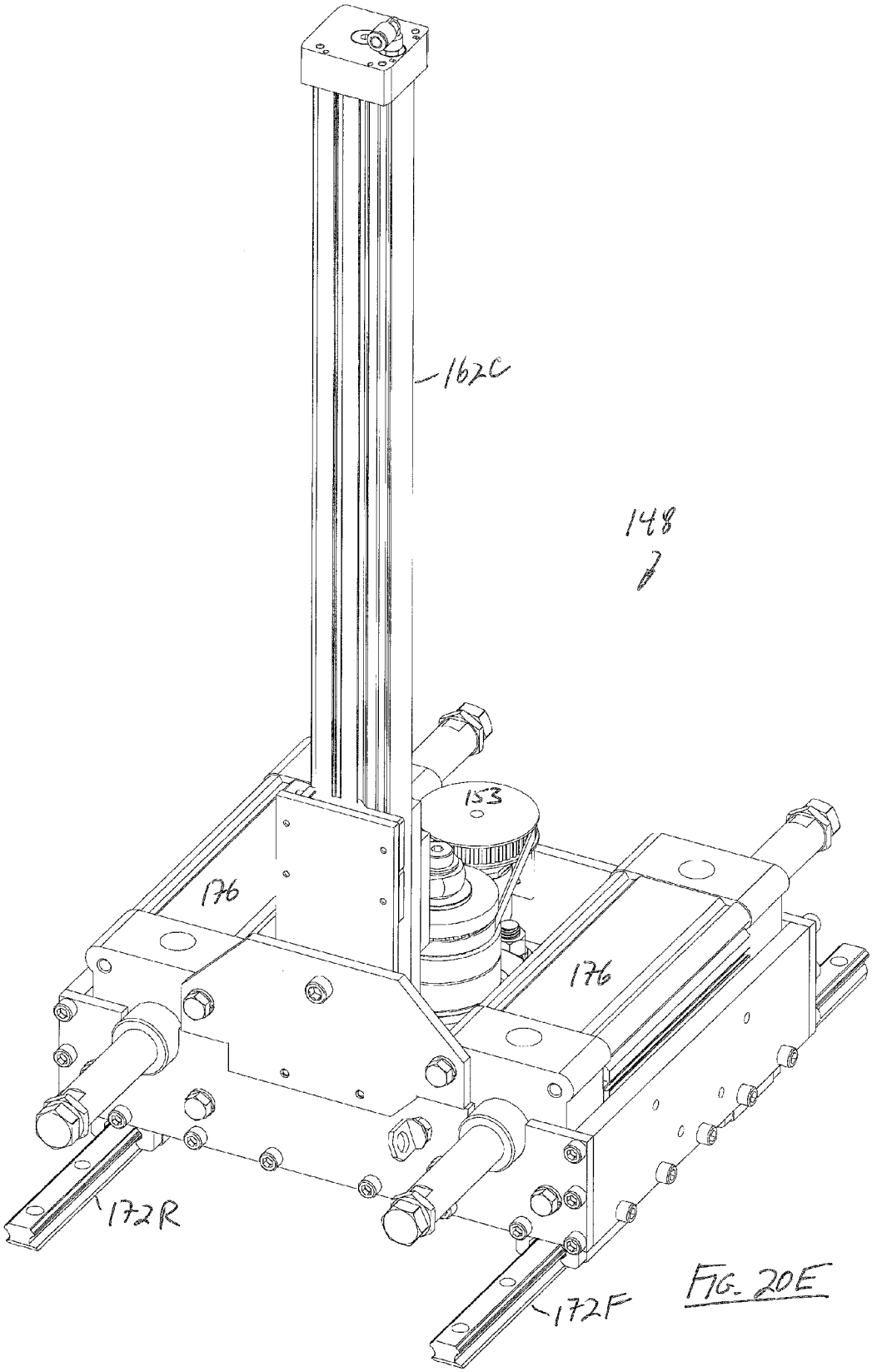
Figure 20F:
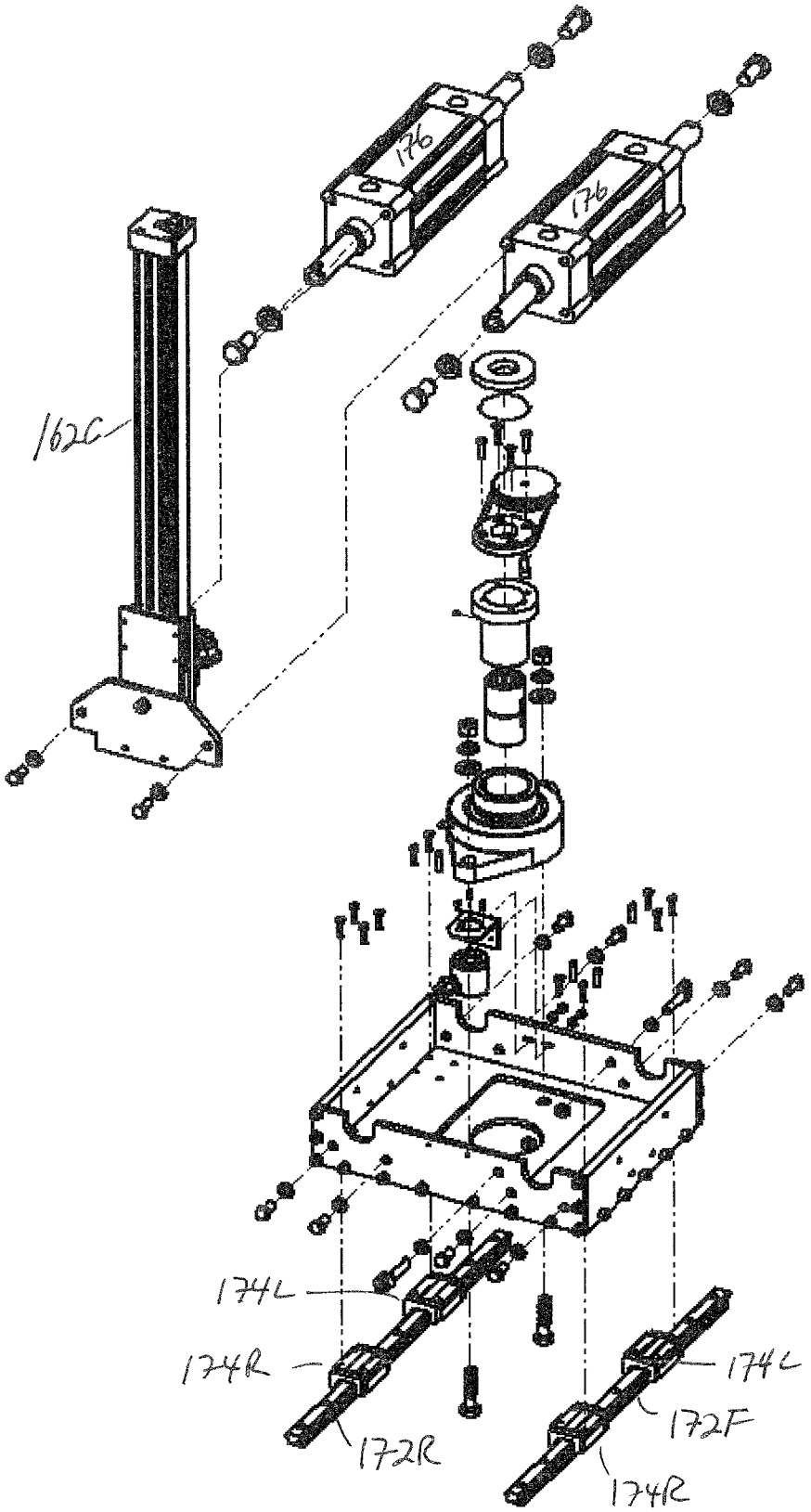
Figure 20G:
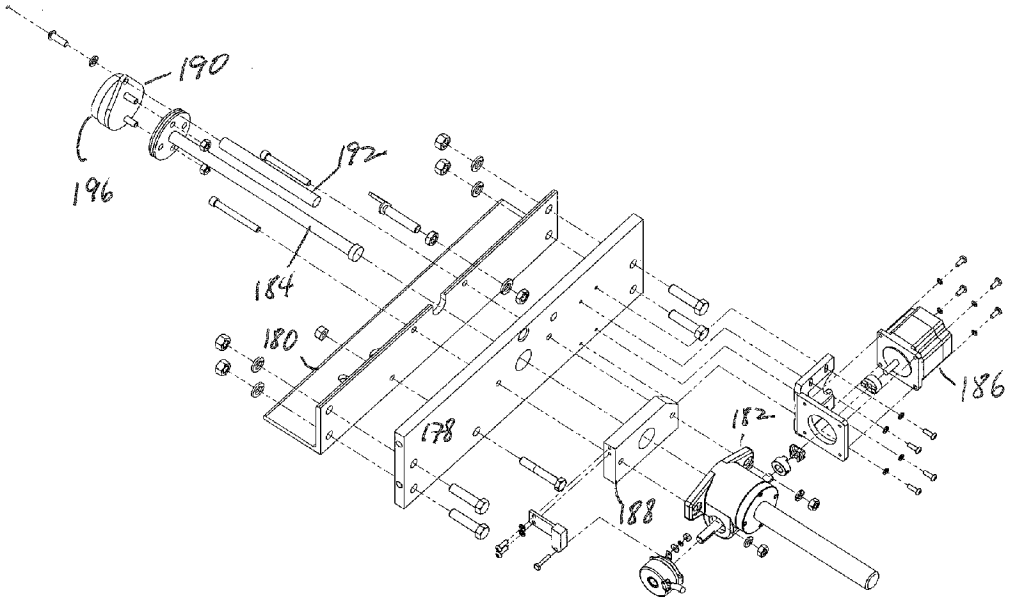
Figure 20H:
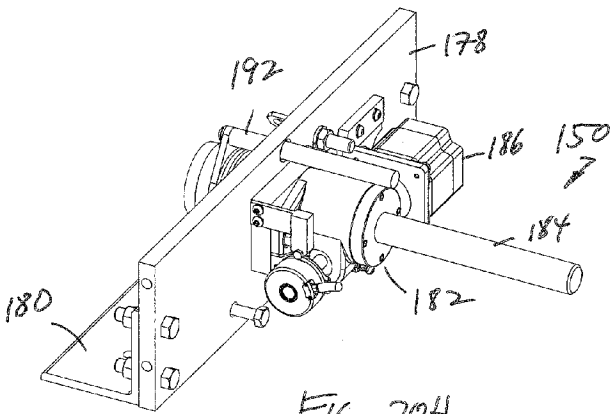
Figure 20I:
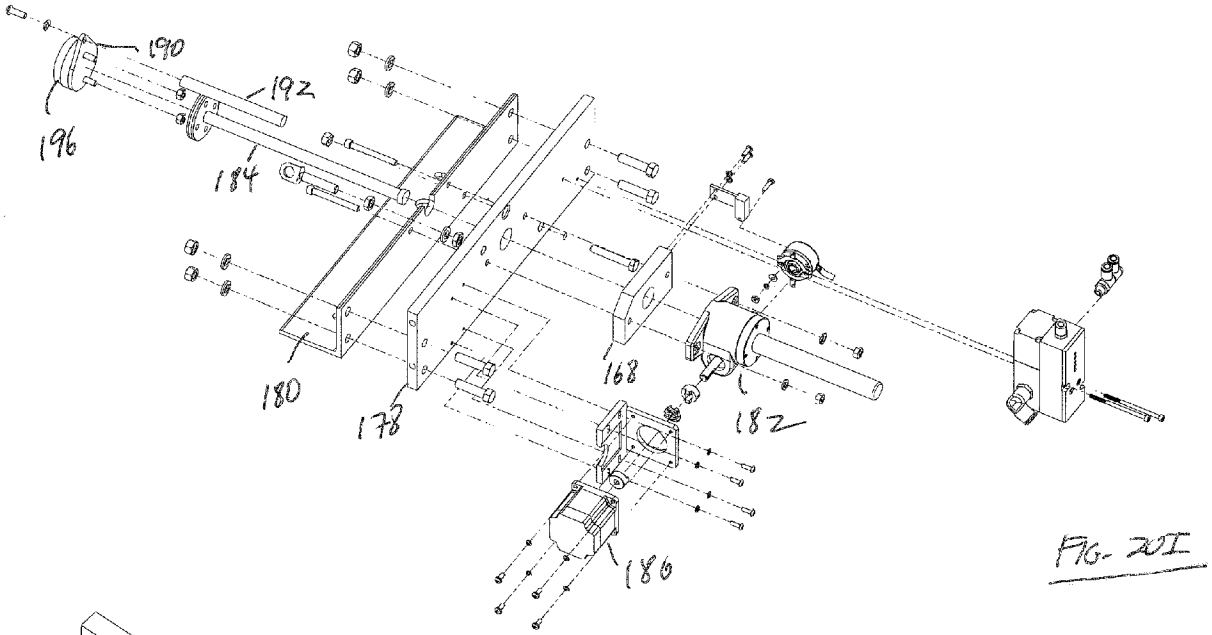
Figure 20J:
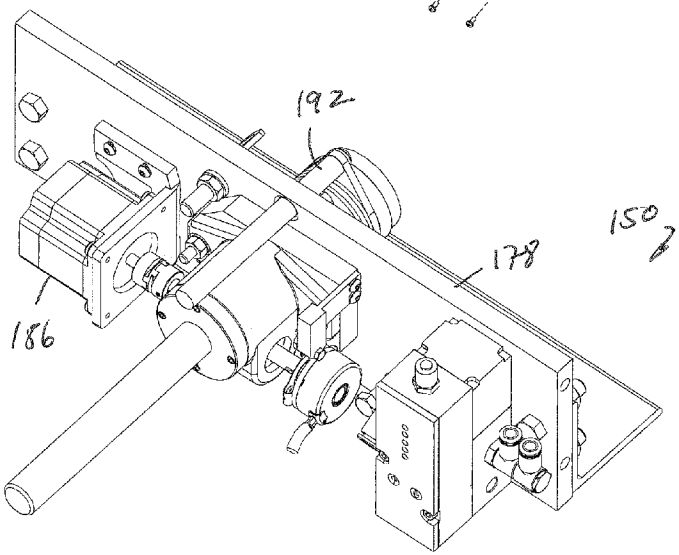
Figure 71A:
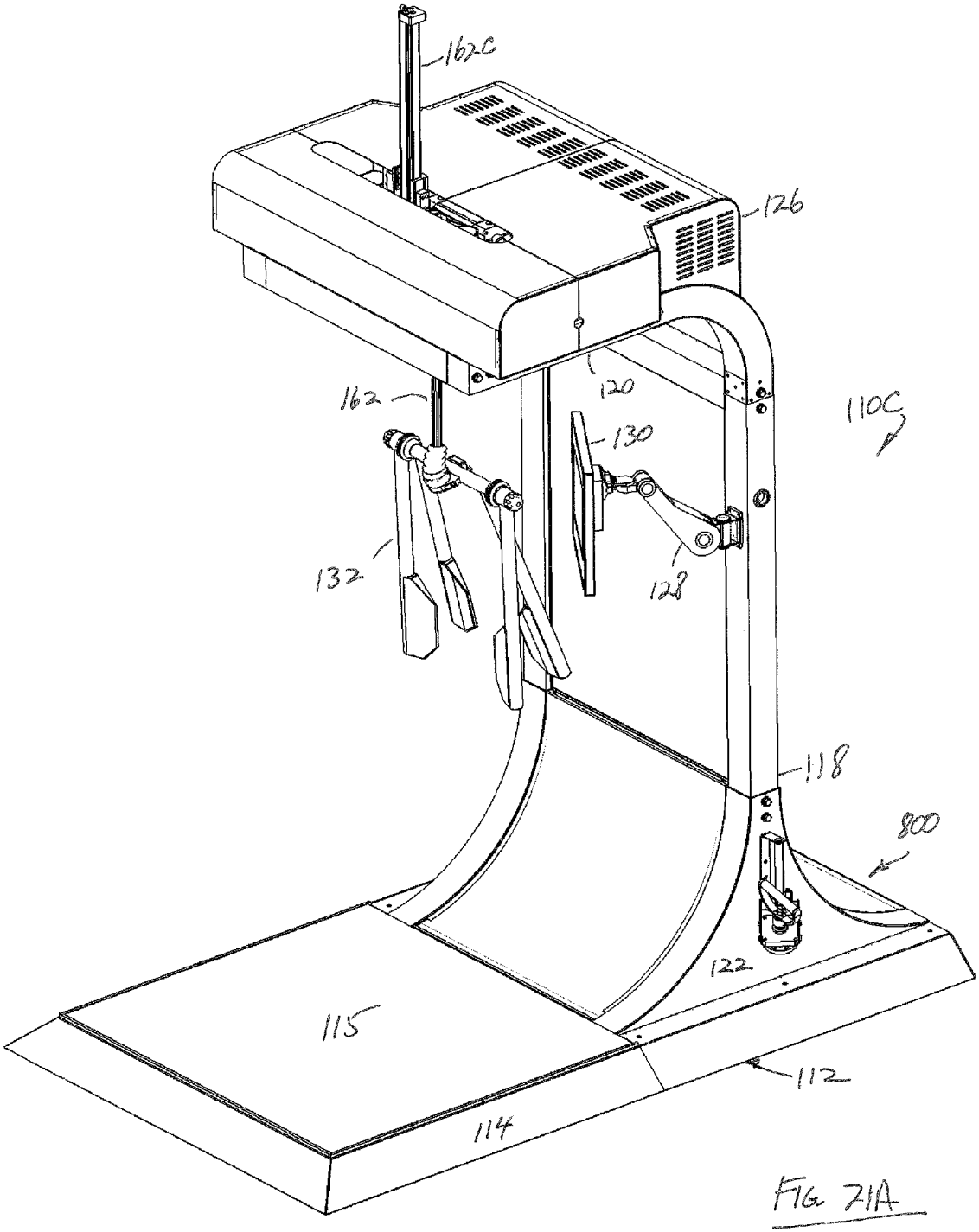

Referring now to FIG. 19C, a mode selection screen 690 of the graphical user interface for the multi-function embodiment 110M allows the user to select the desired attachment to be used by selecting a butterfly attachment button 690B, a lat-pull down attachment button 690L, a chest press attachment button 690C, an arm curl attachment button 690A or a leg-extension attachment button 690E.

The setup screens for the selected attachment are shown in FIGS. 19D-H and each include a graduated two or three-digit up-stroke resistance column 610 and a graduated two- or three digit down-stroke force column 612 allowing the user to select the desired resistance/force encountered during operatively lifting the bar 620 or lowering the bar 620. Each resistance column 610 and 612 may include fine-adjust incremental buttons (e.g., select the two (or three) digits then increment by single digits). The selected resistance is then displayed in the respective resistance windows 614. The setup screen may include other buttons and links to other screens as more particularly described above in connection with the core embodiment 110C.

The setup screens for the attachments comprising a rotary motion, namely, the butterfly attachment 632D, the an arm curl attachment 632E and the leg-extension attachment button 632F, each include a stroke setup button 616 to allow the user to select ranges of rotational movement via an arcuate scale 617. The setup screens for the attachments comprising a linear motion, namely, the chest press attachment and the lat pull-down attachment include a linear stroke window 694 including a linear display 695 allowing the user to select the desired linear range of motion.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. An exercising machine for exercising of a user's torso, comprising in combination:

an exercising attachment for concentric exercising of the user's torso while the user is standing through a forward range of motion and for eccentric exercising of the user's torso while the user is standing through a reverse range of motion in a direction opposite to the forward range of motion, a computer-controlled force double-acting actuator or two oppositely mounted single-acting actuators operatively connected to said exercising attachment to impart a resistance for concentric exercising of the user's torso through the forward range of motion and to impart a force for the eccentric exercising of the user's torso, through the reverse range of motion; and a computer for controlling said double-acting actuator or two oppositely mounted single-acting actuators.

2. The machine as set forth in claim 1, further including an input device to said computer allowing the user to select at least one of said ranges of motion.

3. The machine as set forth in claim 1, wherein said ranges of motion are the same.

4. The machine as set forth in claim 1, wherein said forward range of motion is different from said reverse range of motion.

5. The machine as set forth in claim 1, wherein said the amount of said resistance is fixed throughout said forward range of motion.

6. The machine as set forth in claim 1, wherein said the amount of said resistance varies throughout said forward range of motion.

7. The machine as set forth in claim 6, further including an input device to said computer allowing the user to select said variable resistance.

8. The machine as set forth in claim 1, wherein said the amount of said force is fixed throughout said reverse range of motion.

9. The machine as set forth in claim 1, wherein said the amount of said force varies throughout said reverse range of motion.

10. The method as set forth in claim 9, further including an input device to said computer allowing the user to select said variable force.

11. The machine as set forth in claim 1, wherein said exercising attachment comprises at least one of a core-exercising attachment.

12. The machine as set forth in claim 11, wherein said core-exercising attachment comprises a harness assembly that fits over the user's shoulders.

13. The machine as set forth in claim 1, further including an encoder interfaced to said computer for detecting movement of said exercising attachment.

14. The machine as set forth in claim 1, wherein said double-acting actuators or two oppositely mounted single-acting actuators comprise electric actuators, pneumatic actuators or hydraulic actuators, or a mixture thereof.

15. The machine as set forth in claim 1, wherein said actuators under computer control provide a fixed or variable concentric resistance along a fixed or variable path of motion in one direction or a fixed or variable eccentric force along a fixed or variable path of motion in an opposite direction.

* * * * *